US006879336B2

(12) United States Patent
Sugiyama et al.

(10) Patent No.: US 6,879,336 B2
(45) Date of Patent: Apr. 12, 2005

(54) LASER THERMAL TRANSFER RECORDING METHOD AND APPARATUS THEREFOR

(75) Inventors: Susumu Sugiyama, Shizuoka (JP); Akihiro Shimomura, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 194 days.

(21) Appl. No.: 10/100,017

(22) Filed: Mar. 19, 2002

(65) Prior Publication Data

US 2003/0035043 A1 Feb. 20, 2003

(30) Foreign Application Priority Data

Mar. 19, 2001 (JP) ..... P. 2001-079157
Mar. 19, 2001 (JP) ..... P. 2001-079158
Mar. 19, 2001 (JP) ..... P. 2001-079602
Mar. 13, 2002 (JP) ..... P. 2002-068607

(51) Int. Cl.[7] ..... B41J 13/00
(52) U.S. Cl. ..... 347/262; 347/264
(58) Field of Search ..... 347/171, 224, 347/172, 174, 176, 262, 264, 212; 346/138; 271/211, 278, 207

(56) References Cited

U.S. PATENT DOCUMENTS 5,053,381 A 10/1991 Chapman et al.
5,126,760 A 6/1992 DeBoer
5,300,398 A 4/1994 Kaszczuk
5,376,954 A * 12/1994 Kerr ..... 346/138
5,512,931 A 4/1996 Nakajima et al.
5,580,693 A 12/1996 Nakajima et al.
5,593,808 A 1/1997 Ellis
5,611,881 A 3/1997 Kimura et al.
5,852,464 A * 12/1998 Hebert et al. ..... 347/224
6,027,850 A 2/2000 Kawakami et al.
6,124,874 A * 9/2000 Kinjou et al. ..... 347/171
6,522,841 B2 * 2/2003 Horikoshi ..... 271/211

FOREIGN PATENT DOCUMENTS

JP 4-296594 A 10/1992
JP 5-96863 A 4/1993
JP 5-162469 A 6/1993
JP 6-79980 A 3/1994
JP 8-267944 A 10/1996
JP 9-86773 A 3/1997
JP 10-151860 A 6/1998

(Continued)

OTHER PUBLICATIONS

JP–A–6–79980, Translation of claims, Mar. 22, 1994.

*Primary Examiner*—Huan Tran
(74) *Attorney, Agent, or Firm*—Sughrue Mion, PLLC

(57) ABSTRACT

A laser thermal transfer recording method comprises: dispensing a thermal transfer sheet and an image-receiving sheet to an exposure recording device; cutting each of the sheets into pieces of a predetermined length; superposing each of the cut pieces of the image-receiving sheet on each of the cut pieces of the thermal transfer sheet; loading an exposure drum installed in the exposure recording device with the thus superposed pieces of sheets; and irradiating the sheets loaded on the exposure drum with a laser beam according to image information, in which the laser beam is absorbed in the thermal transfer sheet and converted into a heat, and an image is transferred onto the image-receiving sheet by the heat converted from the laser beam, wherein each surface of the thermal transfer sheet and the image-receiving sheet is cleaned by contacting with an adhesive roller that includes an adhesive material on its surface, in which the adhesive roller is disposed in any one of a feeding part and a conveying part of the thermal transfer sheet and the image-receiving sheet in the exposure recording device, and the image-receiving sheet has a thickness of 110 to 160 μm, and at least one of pieces of the thermal transfer sheet and pieces of the image-receiving sheet is stacked while be blown.

13 Claims, 11 Drawing Sheets

FOREIGN PATENT DOCUMENTS

| | | | | | |
|---|---|---|---|---|---|
| JP | 2000-37956 | A | 2/2000 | | |
| JP | 2000-127635 | A | 5/2000 | | |
| JP | 2000-141722 | A | 5/2000 | | |
| JP | 2000-168252 | A | 6/2000 | | |
| JP | 2000-225776 | A | 8/2000 | | |
| JP | 2000-238953 | A | 9/2000 | | |
| JP | 2000247473 | * | 9/2000 | ..... | B65H/5/00 |
| JP | 2000-263948 | A | 9/2000 | | |
| JP | 2000-302308 | A | 10/2000 | | |
| JP | 2000-338652 | A | 12/2000 | | |
| JP | 2000-351279 | A | 12/2000 | | |
| JP | 2000-355177 | A | 12/2000 | | |
| JP | 2001-10094 | A | 1/2001 | | |
| JP | 2001-26127 | A | 1/2001 | | |

* cited by examiner

ENLARGED VIEW OF DOTS IN PRINTED MATTER

LASER THERMAL TRANSFER RECORDING METHOD AND APPARATUS THEREFOR

FIELD OF THE INVENTION

The present invention relates to a method of forming multicolored images and apparatus therefor wherein are used multicolor image-forming materials that can form high-resolution, full-color images when exposed to laser light. In particular, the invention is concerned with a multicolored image formation method and apparatus therefor wherein are used multicolor image-forming materials useful for producing color proofs in the field of graphic arts (DDCP: Direct Digital Color Proofs) or masking images from digital image signals through the use of laser recording technique.

BACKGROUND OF THE INVENTION

In the field of graphic arts, printing of a printing plate is carried out using a set of color separation films produced from a color original with the aid of lithographic films. Prior to going into real printing (practical printing operation), color proofs are generally produced from color separation films in order to check up on errors in the step of color separation and necessity to correct colors And it is desired that the color proofs ensure high resolution enabling high-quality reproduction of medium-tone images and high process consistency. In order to obtain color proofs closely analogous to real prints, it is appropriate that materials used for real prints be used as materials for color proofs. Specifically, it is desirable to adopt printing paper used in real printing as a substrate and pigments as coloring materials. Further, a dry process using no developing solution is in great request as a method of producing color proofs.

As a dry process for producing color proofs, the recording system of producing color proofs directly from digital signals has been developed as electronified systems have come into wide use in recent pre-press processes. These electronified systems are utilized with the aim of producing high-quality color proofs in particular, and enable reproduction of halftone images in resolutions of 150 lines/inch. In order to record digital signals in proofs of high quality, laser light capable of being modulated by digital signals and sharply focusing recording light is used as a recording head. Therefore, it becomes necessary to develop image-forming materials with high resolution enabling reproduction of high-definition dots.

As an image-forming material used in a laser light-utilized transfer image formation method, there is known the heat-fusion transfer sheet (Japanese Patent Laid-Open No. 58045/1993) having on a substrate a light-to-heat conversion layer, which can absorb laser light and evolve heat, and an image-forming layer containing pigments dispersed in a medium, such as heat-fusible wax or binder, in order of mention. According to the image-forming method using such a recording material, the light-to-heat conversion layer evolves heat in the laser light-irradiated areas, and the image-forming layer is fused by the heat in the areas corresponding to the irradiated areas and transferred onto an image-receiving sheet superimposed on the transfer sheet, thereby forming transfer images on the image-receiving sheet.

Further, Japanese Patent Laid-Open No. 219052/1994 discloses the thermal transfer sheet comprising a substrate provided sequentially with a light-to-heat conversion layer containing a material enabling photothermal energy conversion, a very thin (0.03 to 0.3 $\mu$m) heat-releasable layer and an image-forming layer containing coloring materials. In this thermal transfer sheet, the binding force between the image-forming layer and the light-to-heat conversion layer, which are bound by the mediation of the heat-releasable layer, is reduced by irradiation with laser light to result in formation of high-definition images on an image-receiving sheet superimposed on the thermal transfer sheet. The image formation method using such a thermal transfer sheet takes advantage of the so-called ablation. More specifically, the phenomenon utilized therein is as follows. The heat-releasable layer partly decomposes and vaporizes in the areas irradiated with laser light, and so in the areas corresponding thereto the bonding force between the image-forming layer and the light-to-heat conversion layer becomes weak. As a result, the corresponding areas of the image-forming layer are transferred, onto an image-receiving layer superimposed thereon.

Those image-forming methods have advantages that an actual printing paper to which an image-receiving layer (adhesion layer) is attached can be used as a material for image-receiving sheet and multicolored images can be obtained with ease by transferring images of different colors in succession onto an image-receiving sheet. The image formation method utilizing ablation in particular has an advantage of easy formation of high-definition images, and is useful in producing color proofs (DDCP: Direct Digital color Proofs) or high-definition masking images.

In the progressive context of DTP (DeskTop Publishing) environments, a section of using a CTP (Computer To Plate) system was relieved of an intermediate film-unloading process, and there has been the growing need for proofs produced by the DDCP system as an alternative of galley proofs and analog-mode proofs. Further, large-sized DDCP with high definition, high stability and excellent print-matching performance have been desired in recent years.

The laser thermal transfer method enables printing in high resolution, and various systems thereof are known which include (1) a laser sublimation system, (2) a laser ablation system and (3) a laser fusion system. However, all of these systems have a problem that the shape of recorded dots lacks in sharpness. More specifically, the laser sublimation system (1) uses dyes as coloring materials, and so the degree of similarity to prints is insufficient, the dots formed have blurred outlines since sublimation of coloring materials is utilized therein, and satisfactorily high resolution cannot be achieved. On the other hand, the laser ablation system (2) is satisfactory in similarity to prints since pigments are used as coloring materials but, as in the case of the system (1), the dots formed have blurred outlines and sufficiently high resolution cannot ensure since scatter of coloring materials is caused therein. In addition, the laser fusion system (3) cannot ensure sharp outlines because of fluidity of fused matter.

In the process of DDCP, operations of continuously outputting a number of image sheets and automatically stacking them in a printer are frequently carried out. Although hitherto used materials permit automatic stacking of several sheets, they cause a considerable frequency of troubles, including sticking, waving, curling or/and jutting troubles, when it is required to automatically stack, e.g., 20 image sheets by all-night automatic operation. Therefore, the monitoring by an operator is required, and so the automatic operation is virtually impossible as matters stand.

SUMMARY OF THE INVENTION

A challenge to the present inventors is to solve the problems of hitherto used materials and to achieve the following object. Specifically, the objective of the invention is to provide large-sized DDCP with high definition, high stability and excellent print-matching performance. More specifically, the invention aims to provide (1) a thermal transfer sheet using pigments as coloring materials and capable of transferring thin films of coloring materials which are little influenced by an illumination light source even when compared with prints and ensuring high sharpness and stability in dots formed therefrom and (2) an image-receiving sheet capable of consistently and reliably receiving the image forming layer of a laser-energy thermal transfer sheet, and to enable (3) transfer to actual printing paper at least having its basis weight in the range of 64 to 157 g/m$^2$, such as art (coated) paper, matte paper or slightly coated paper and exact reproduction of delicate quality description and whiteness of paper (highlight area) and (4) highly consistent release capability upon transfer. In addition, the invention aims to provide a method of forming multicolored images of high quality and consistent transfer density on image-receiving sheet(s) even when laser recording is performed with high-energy multiple beams of laser light under different temperature-humidity conditions. Further, the invention aims to provide a multicolored image formation method by which continuous stacking of a great number of image-bearing sheets can be achieved with satisfactory reliability.

Solutions of the problems mentioned above are attained by the following embodiments of the invention:

(1) A laser thermal transfer recording method, which comprises:

dispensing a thermal transfer sheet and an image-receiving sheet from a roll of each sheet to an exposure recording device, in which the thermal transfer sheet includes an image-forming layer, and the image-receiving sheet includes an image-receiving layer, and the image-receiving layer surface of the image-receiving sheet in the roll is disposed outward;

cutting each of the sheets into pieces of a predetermined length;

superposing each of the cut pieces of the image-receiving sheet on each of the cut pieces of the thermal transfer sheet, so that the image-receiving layer of the image-receiving sheet is opposed to the image-forming layer of the thermal transfer sheet;

loading an exposure drum installed in the exposure recording device with the thus superposed pieces of sheets; and irradiating the sheets loaded on the exposure drum with a laser beam according to image information, in which the laser beam is absorbed in the thermal transfer sheet and converted into a heat, and an image is transferred onto the image-receiving sheet by the heat converted from the laser beam, wherein each surface of the thermal transfer sheet and the image-receiving sheet is cleaned by contacting with an adhesive roller that includes an adhesive material on its surface, in which the adhesive roller is disposed in any one of a feeding part and a conveying part of the thermal transfer sheet and the image-receiving sheet in the exposure recording device, and the image-receiving sheet has a thickness of 110 to 160 $\mu$m, and at least one of pieces of the thermal transfer sheet and pieces of the image-receiving sheet is stacked while be blown air.

(2) A laser thermal transfer recording method as described in the item (1), wherein the image-receiving sheet has a stiffness of 50 to 80 g (3) A laser thermal transfer recording method, which comprises:

dispensing a thermal transfer sheet and an image-receiving sheet from a roll of each sheet to an exposure recording device, in which the thermal transfer sheet includes an image-forming layer, and the image-receiving sheet includes an image-receiving layer, and the image-receiving layer surface of the image-receiving sheet in the roll is disposed outward;

cutting each of the sheets into pieces of a predetermined length;

superposing each of the cut pieces of the image-receiving sheet on each of the cut pieces of the thermal transfer sheet, so that the image-receiving layer of the image-receiving sheet is opposed to the image-forming layer of the thermal transfer sheet;

loading an exposure drum installed in the exposure recording device with the thus superposed pieces of sheets; and irradiating the sheets loaded on the exposure drum with a laser beam according to image information, in which the laser beam is absorbed in the thermal transfer sheet and converted into a heat, and an image is transferred onto the image-receiving sheet by the heat converted from the laser beam, wherein each surface of the thermal transfer sheet and the image-receiving sheet is cleaned by contacting with an adhesive roller that includes an adhesive material on its surface, in which the adhesive roller is disposed in any one of a feeding part and a conveying part of the thermal transfer sheet and the image-receiving sheet in the exposure recording device, and the image-forming layer surface in the thermal transfer sheet has a surface roughness: Rz of 0.5 to 3.0 $\mu$m, and the image-receiving layer surface in the image-receiving sheet has a surface roughness: Rz of 4.0 $\mu$m or less, and the superposed pieces of the thermal transfer sheet and the image-receiving sheet are loaded the exposure drum by suction under a reduced pressure of 50 to 500 mmHg.

(4) A laser thermal transfer recording method as described in the item (1) or (3), wherein the image-receiving sheet has an adhesion strength of 20 to 100 mN/cm between surface of the image-receiving layer and an underlayer provided underneath the image-receiving layer, and the adhesive roller is an adhesive rubber roller containing titanium dioxide and compound having at least one of C—O and Si—O functional groups as a roller material.

(5) A laser thermal transfer recording method as described in the item (4), wherein the image-forming layer surface in the thermal transfer sheet has a surface roughness: Rz of 0.5 to 3.0 $\mu$m and a friction coefficient of 0.8 or less, and the image-receiving layer surface in the image-receiving sheet has a surface roughness: Rz of 4 $\mu$m or less, and a friction coefficient of 0.7 or less.

(6) A laser thermal transfer recording method as described in the item (1) or (3), wherein the transferred image has a resolution of 2,400 dpi or more.

(7) A laser thermal transfer recording method as described in the item (1) or (3), wherein the image-forming layer in the thermal transfer sheet has a ratio of an optical density (OD) to a layer thickness: OD/layer thickness ($\mu$m unit) of 1.80 or more.

(8) A laser thermal transfer recording method as in the item (1) or (3), wherein the image-forming layer in the thermal transfer sheet and the image-receiving layer in the image-receiving sheet each has a contact angle with water of from 7.0 to 120.0°.

(9) A laser thermal transfer recording method as described in the item (1) or (3), wherein a recording area of the multicolor image is defined by a product of a length of 515 mm or more and width of 728 mm or more.

(10) A laser thermal transfer recording method as described in the item (1) or (3), wherein a recording area of the multicolor image is defined by a product of a length of 594 mm or more and width of 841 mm or more.

(11) A laser thermal transfer recording method as described in the item (1) or (3), wherein the ratio of an optical density (OD) of the image-forming layer in the thermal transfer sheet to a thickness of the image-forming layer: OD/layer thickness ($\mu$m unit) is 1.80 or more and the image-receiving layer in the image-receiving sheet has a contact angle with water of 86° or less.

(12) A laser thermal transfer recording method as described in the item (1) or (3), wherein the image-forming layer in the thermal transfer sheet has a ratio of an optical density (OD) to a layer thickness: OD/layer thickness ($\mu$m unit) of 2.50 or more.

(13) A laser thermal transfer recording apparatus, wherein a thermal transfer sheet and an image-receiving sheet are dispensed from a roll of each sheet to an exposure recording device, in which the thermal transfer sheet includes an image-forming layer, and the image-receiving sheet includes an image-receiving layer, and the image-receiving layer surface of the image-receiving sheet in the roll is disposed outward, each of the sheets is cut into pieces of a predetermined length, and each of the cut pieces of the image-receiving sheet is superposed on each of the cut pieces of the thermal transfer sheet, so that the image-receiving layer of the image-receiving sheet is opposed to the image-forming layer of the thermal transfer sheet, an exposure drum installed in the exposure recording device loads with the thus superposed pieces of sheets, the sheets loaded on the exposure drum are irradiated with a laser beam according to image information, in which the laser beam is absorbed in the thermal transfer sheet and converted into a heat, and an image is transferred onto the image-receiving sheet by the heat converted from the laser beam, wherein the exposure recording device is equipped with an adhesive roller in at least one of a feeding part and a conveying part of the thermal transfer sheet and the image-receiving sheet, and the adhesive roller has an adhesive material at its surface, and the laser thermal transfer recording apparatus has an air stacking apparatus in the neighborhood of a discharging part, in which the air stacking apparatus blows air to at least one of the pieces of the thermal transfer sheet and the pieces of the image-receiving sheet when the sheets each is stacked.

(14) A laser thermal transfer recording apparatus as described in the item (13), wherein the thermal transfer sheet and the image-receiving sheet are brought into contact with the adhesive roller to clean surfaces of the sheets, and the adhesive roller is an adhesive rubber roller containing titanium dioxide and compound having at least one of C—O and Si—O functional group as a roller material.

(15) A laser thermal transfer recording apparatus as described in the item (13), wherein the thermal transfer sheet and the image-receiving sheet are brought into contact with the adhesive roller to clean surfaces of the sheets, and the thermal transfer sheet and the image-receiving sheet are loaded on the exposure drum by suction under a reduced pressure of 50 to 500 mmHg.

Figure 1:
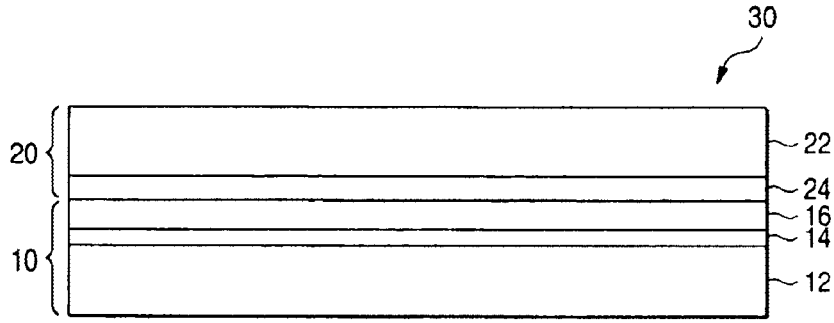
FIG. 1 illustrates schematically a mechanism of multicolored image formation by laser-utilized thin film thermal transfer.
Figure 1:
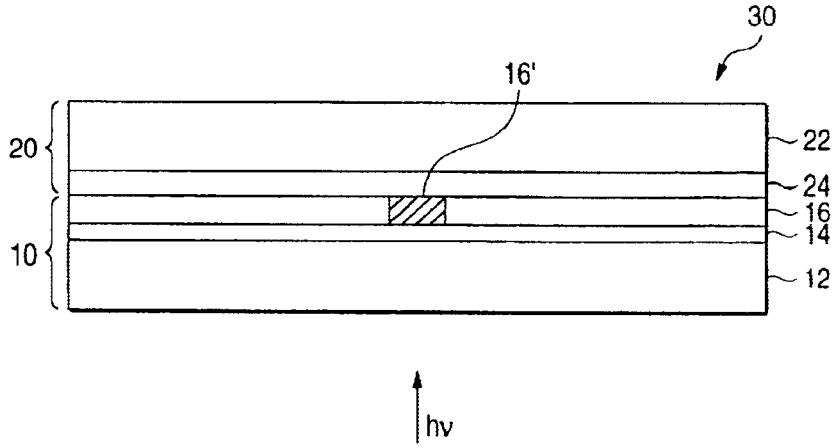
Figure 1:
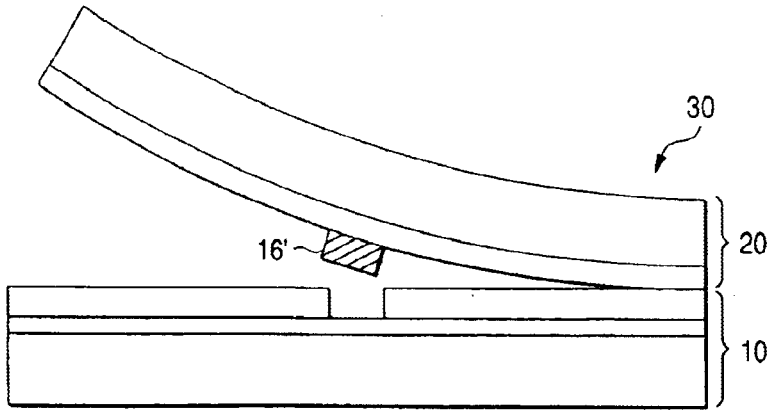

The reference numerals in the figures stand for the following respectively:

1 Recording apparatus

2 Recording head

3 Sub-scan rail

4 Recording drum
5 Thermal transfer sheets loading unit
6 Image-receiving sheet roll
7 Guide rollers
8 Squeeze roller
9 Cutter
10 Thermal transfer sheet
10K, 10C, 10M and 10Y Thermal transfer sheet rolls
12 Substrate
14 Light-to-heat conversion layer
16 Image-forming layer
20 Image-receiving sheet
22 Support for image-receiving sheet
24 Image-receiving layer
30 Superposed matter
31 Discharge board
32 Waste exit
33 Discharge mouth
34 Air
35 Waste box
42 Printing paper
43 Heat rollers
44 Insertion board
45 Mark indicating the surmount position
46 Insertion rollers
47 Guide made of heat-resistant sheet
48 Parting nail
49 Guide plate
50 Discharge port

DETAILED DESCRIPTION OF THE INVENTION

As a result of our intensive studies for providing large-size DDCP having B2/A2 size or larger, particularly B1/A1 size or large, high definition, high stability and good match for real prints, we have developed a laser thermal transfer recording system for preparing DDCP. This system comprises B2-size or larger, pigment-type image-forming materials, which permit transfer to printing paper used in real printing and real-dot output, an output unit and high-quality CMS (Color Management System) software.

The performance characteristics, system configuration and technical points of the laser thermal transfer recording system developed by the present applicant are outlined below.

As to the performance characteristics, (1) the present system can reproduce halftone dot images closely analogous to real prints because it can form dots sharp in shape, (2) the images reproduced by the present system are closely resemble in hue to printed images, and (3) the qualities of images recorded by this system are little influenced by surrounding temperature and humidity, and further this system ensures consistent proof production because of its good reproduction repeatability. The technical points about materials for achieving such performance characteristics are establishment of thin-film transfer technique and improvements in properties required for materials used in laser thermal transfer system, including vacuum contact retentiveness, capability of following high-resolution recording, and heat resistance. More specifically, those points are that (1) the light-to-heat conversion layer is reduced in thickness by introducing thereto infrared absorbing dyes, (2) heat resistance of the light-to-heat conversion layer is enhanced by introducing thereto polymers of high Tg, (3) stabilization of hue is attained by introduction of heat-resistant pigments, (4) the adhesion and coagulation are controlled by addition of wax and low-molecular-weight ingredients, and (5) vacuum contact retentiveness is imparted without deterioration in image quality by addition of a matting agent to the light-to-heat conversion layer. The technical points about the system include (1) air conveyance for continuous stacking of many sheets in a recording apparatus, (2) insertion of an image-receiving sheet into a thermal transfer unit in a state that printing paper is surmounted on the image-receiving sheet with the intention of reducing curl after transfer, and (3) connection with a general-purpose output driver to add connection extension to the system. As mentioned above, the laser thermal transfer recording system developed by the present applicant has a variety or performance characteristics, a particular system configuration and technical points. However, these are representatives and should not be construed as limiting the scope of the invention in any way.

The present applicant has pursued the development on the principle that individual materials, including various coating layers, such as a light-to-heat conversion layer, an image-forming layer and an image-receiving layer, various thermal transfer sheets and image-receiving sheets, are not present independently, but should be combined so as to function organically and comprehensively, and further the image-forming materials can achieve maximum performances in combination with appropriate recording apparatus and thermal transfer unit. Therefore, the present applicant has selected carefully coating layers of image-forming materials and ingredients constituting these layers and has formed coating layers capable of exploiting the full potentials of the ingredients to make them into image-forming materials, and further found suitable ranges of various physical characteristics wherein the image-forming layers made can achieve optimum performances, As a result thereof, sheet's physical characteristic relations with ingredients and coating layers constituting each sheet are optimized, and the image-forming materials, the recording apparatus and the thermal transfer unit are made to function organically and comprehensively, thereby unexpectedly discovering high-performance image-forming materials. The position the invention is placed in the system developed by the present applicant is that the invention relates to a laser thermal transfer recording method which specifies combination of characteristics of ingredients with particular processes for making characteristics of high-performance image-forming materials reach their full potentials, which shores up the system developed by the present applicant, and to a laser thermal transfer recording apparatus using such a method.

Then, contents, actions and effects of the processes included in the present laser thermal transfer recording method are illustrated.

In the present method, image-receiving sheets used are required to have their stiffness in the range of 50 to 80 g and their thickness in the range 110 to 160 $\mu$m and to undergo air stacking. These requirements play a big part in achieving satisfactorily continuous stacking of many image-receiving sheets after recording in the stacking section of the exposure recording device. More specifically, when any one of the requirements, stiffness, thickness or air stacking, is not met, the image-receiving sheets cause troubles, such as sticking, waving, curling, jutting and dropping, in the stacking section.

Further, adjustment of stiffness and thickness of image-receiving sheets to the foregoing ranges can contribute greatly to smooth operations insides the exposure recording device. These operations include conveyance, cleaning of the image-receiving sheet surface with an adhesive roller, discharge of image-receiving sheets after recording, and stacking. When the stiffness and thickness of the image-receiving sheets fall short of the foregoing ranges, there occur troubles such as jamming in conveyance and discharge processes and winding around the adhesive roller. On the other hand, when the stiffness and the thickness exceed the foregoing ranges, jamming trouble in the conveyance and discharge processes is also caused, and further poor contact with the exposure drum occurs.

Additionally, the stiffness is a value measured (on the image-receiving layer side) with a loop stiffness tester (made by Toyo Seiki Seisaku-sho Ltd.) wherein a sample measuring 2 cm (width) by 10 cm (length) is used.

As an embodiment of the present method, adhesive rubber rollers containing titanium dioxide and C—O or Si—O functional groups are used as the adhesive rollers for cleaning the thermal transfer sheet surface and the image-receiving sheet surface from the standpoints of ensuring appropriate adhesion and long-term adhesion stability. Further, it is preferable that the adhesive rubber rollers be free of barium. Furthermore, in order that the thermal transfer sheets and the image-receiving sheets can be conveyed appropriately with the aid of rubber rollers having adhesiveness, the surface of an image-forming layer of the thermal transfer sheet is controlled so as to have surface roughness of 0.5 to 3.0 $\mu$m in terms of the Rz value and a friction coefficient of 0.8 or below, and the surface of an image-receiving layer of the image-receiving sheet is controlled so as to have surface roughness of 4 $\mu$m or below in terms of the Rz value and a friction coefficient of 0.7 or below. For preventing the surface layer from falling off by the adhesive roller, it is required that adhesion between the image-receiving layer and a layer provided underneath the image-receiving layer be at least 20 mN/cm. However, when the adhesion between the image-receiving layer and a layer provided underneath the image-receiving layer is increased beyond 100 mN/cm, it becomes difficult to smoothly perform transfer to printing paper used in actual printing.

In another embodiment of the present method, the surface roughness of an image-forming layer of the thermal transfer sheet is adjusted to the range of 0.5 to 3.0 $\mu$m, preferably 0.5 to 1.5 $\mu$m, in terms of the Rz value. When the thermal transfer sheet has a Rz value below the foregoing range, it fails in coming into sufficient contact with the image-receiving sheet under vacuum. On the other hand, when the Rz value is greater than the foregoing range, good image quality cannot be attained. Further, the surface roughness of the image-receiving layer of the image-receiving sheet is adjusted to 4.0 $\mu$m or below, preferably 1.0 $\mu$m or below, in terms of the Rz value. When the Rz value is great, good image quality cannot ba attained.

The term "surface roughness Rz" as used herein refers to the ten-point mean surface roughness corresponding to Rz (maximum height) of JIS. More specifically, the average surface of a section having a standard area drawn from a rough surface is adopted as a datum surface. From the highest to the fifth highest peaks and from the deepest to the fifth deepest valleys present at the datum surface are picked out, and the mean height of those five peaks and the mean depth of those five valleys are determined. The thus determined mean distance between the peak top and the valley bottom is defined as surface roughness Rz. The determination of Rz value can be made by using a three-dimensional roughness tester adopting a stylus method, e.g., Surfcom 570 A-3DF, made by Tokyo Seimitu K.K. The measurement conditions adopted therein are, e.g., as follows: The measurement is carried out in the vertical direction, the cut-off value is 0.08 mm, the measurement area is 0.6 mm by 0.4 mm, the advance pitch is 0.005 mm, and the measurement speed is 0.12 mm/s.

The degree of suction at the time when the image-receiving and thermal transfer sheets having the physical properties as specified above are brought into close contact with a rotating drum by suction of the air through section holes is adjusted to the range 50–500 mmHg, preferably 100–200 mmHg, in a condition that the section holes are blocked. When the degree of suction is too low, the image-receiving sheet and tho thermal transfer sheet are neither firmly held to the drum nor kept in satisfactory vacuum contact. On the other hand, when the degree of suction is too high, the image-receiving sheet becomes deformed in the shape of section holes to cause defects in the corresponding portions of the transferred images.

Moreover, the present method has two additional features mentioned below. Namely, one of the features is multicolor image-forming materials used therein. To be more specific, as the ratio of an optical density (OD) to a layer thickness (OD/layer thickness ratio) of the image-forming layer of each thermal transfer sheet is adjusted to at least 1.50, and thereby the image density required of a printing proof can be achieved with ease and, at the same time, the thickness of each image-forming layer can be reduced. By doing so, transfer to an image-receiving layer can be performed with high efficiency, the image-forming layer can be made stable toward rupture, and the dot shape can be made sharp. As a result, high capability of following high-resolution recording responsive to image information and excellent dot reproduction can be achieved. In addition, since the image-forming layer can be made even thinner, influences by surrounding temperature and humidity can be reduced to a minimum, image reproduction repeatability can be improved, and consistent release capability upon transfer can be enhanced; as a result, proofs closer in resemblance to real prints can be prepared.

The image-forming layer of the thermal transfer sheet and the image-receiving layer of the image-receiving sheet are adjusted to have their individual contact angles in the range of 7.0 to 120.0 degrees with respect to water. This contact angle adjustment can bring about advantages that dependence of recording characteristics on temperature and humidity is small and the transfer sensitivity is high, sufficient adhesion at the time of image formation, sharpness in dot shape, and excellent dot reproduction responsive to image information. And no transfer defects are caused even when the transfer onto real printing paper is performed, so defect-free high-definition proofs can be made.

The contact angle of each layer surface with respect to water is a value measured with a contact angle meter, Model CA-A (made by Kyowa Interface Science Co., Ltd.).

The other feature of the present method is in that laser-irradiated portions of the image-forming layer are transferred in a thin-film state onto the image-receiving sheet.

In accordance with the thin-film transfer system developed by the present applicant, transferred images having substantially no bleeding and high resolution can be obtained. This thin-film transfer system is superior to hitherto known systems, including (1) a laser sublimation system, (2) a laser ablation system and (3) a laser fusion system. Of course, the system adopted in the present laser thermal transfer recording method should not be construed as being limited to the system developed by the present applicant. And at the same time many of techniques woven into the system developed by the present applicant can be applied to conventional various systems and add improvements thereon, and further can contribute to providing high-resolution multicolor image-forming materials and methods.

Then, the whole of the system developed by the present applicant, including the contents of the invention, is illustrated. A thin-film thermal transfer system is invented and adopted in the present system, thereby achieving high resolution and enhancement of image quality. The present system is a system capable of providing transfer images with resolutions of at least 2,400 dpi, preferably at least 2,500 dpi. The thin-film transfer system is a system of transferring a thin-film image-forming layer having a thickness of 0.01 to 0.9 $\mu$m in a partially or almost unfused state onto an image-receiving sheet. More specifically, in accordance with the transfer system developed, the recorded portions are transferred in the state of a thin film, and so thermal transfer is effected with very high resolution. In a suitable method of carrying out thin-film thermal transfer with efficiency, optical recording causes dome-shaped deformation inside the light-to-heat conversion layer, and thereby the image-forming layer is pushed up to the image-receiving layer to heighten adhesion between these layers and facilitate transfer. When this deformation is great, the force of pushing the image-forming layer up to the image-receiving layer becomes strong and the transfer becomes ease. On the other hand, when the deformation is small, the force of pushing the image-forming layer up to the image-receiving layer becomes weak and causes unsatisfactory transfer in spots. The deformation appropriate to thin-film transfer is evaluated by examination under a laser microscope in terms of the deformation rate defined by $\{[(a)+(b)]/(b)\}\times 100$ wherein (a) is a cross section of the recorded part of the light-to-heat conversion layer which undergoes an increase after optical recording and (b) is a cross section which the recorded part of the light-to-heat conversion layer has before optical recording. The appropriate deformation rate is at least 110%, preferably at least 125%, and particularly preferably at least 150%. When the light-to-heat conversion layer is designed so as to permit a great elongation before rupture, the deformation rate may be greater than 250%. In general, however, it is advantageous to control the deformation rate to the order of 250%.

Technical points of the image-forming material in thin-film transfer are as follows.

1. Compatibility Between High Thermal Responsivity and Keeping Quality:

In order to achieve high image quality, transfer of a thin film on the order of sub-microns is required. In order to produce the desired density, however, it is required to make a layer in which pigments are dispersed in a high concentration. This high pigment concentration runs counter to high thermal responsivity requirement Further, thermal responsivity and keeping quality (adhesion) requirements are mutually contradictory. These contradictory relations are resolved by developing novel polymers and additives.

2. Attainment of High Vacuum Contact Capability:

Although smoother transfer interface is more desirable in high resolution-oriented thin-film transfer, it cannot provide sufficient vacuum contact capability. By incorporation of a large amount of comparatively small-size matting agent in a layer provided underneath the image-forming layer in a break with common-sense ways to impart vacuum contact capability, an appropriate gap is uniformly made between the thermal transfer sheet and the image-receiving sheet. Thus, vacuum contact capability can be imparted without causing image dropouts as the feature of thin-film transfer is maintained.

3. Use of Heat-resistant Organic Materials:

At the time of laser recording, the light-to-heat conversion layer for converting laser light to heat comes to have a temperature of about 700° C., and the temperature of the image-forming layer containing pigments reaches about 500° C. Therefore, modified polyimides coatable with the aid of organic solvents are developed as a material for the light-to-heat conversion layer, and pigments higher in heat resistance than printing pigments, safe and match in hue are developed as pigment color materials.

4. Attainment of Surface Cleanliness:

In the thin-film transfer, dust between the thermal transfer sheet and the image-receiving sheet causes image defects, and becomes a grave problem. Dust intrudes into the apparatus from the outside and, inside the apparatus, cutting of materials causes- generation of dust. Therefore, mere control of materials is insufficient, and it is required to attach a dust removal mechanism to the apparatus. Such- being the case, a material capable of retaining adhesion appropriate to clean the transfer material surface is discovered, and the material of guide rollers is changed. Thus, removal of dust is achieved without attended by lowering of productivity.

Now, the present system in its entirety is described in detail.

In the invention, it is desirable that thermal transfer images be formed of sharp dots and the transfer to real printing paper and large-size (at least 515 mm×728) recording be performed. More desirably, the present system is a system which enables recording in sizes of B2 (543 mm×765 mm) or greater.

One feature on the performance of the system developed by the invention is achievement of a sharp dot shape. The thermal transfer images obtained by this system are formed into halftone dot images with a resolution of at least 2,400 dpi in response to the printed line numbers. Each individual dot is almost free of bleeding and chips, and very sharp in shape. Therefore, dots in a wide range from highlight to shadow can be formed sharply. As a result, high-quality dot output can be produced with resolutions equivalent to those of image setters and CTP setters, and dots and gradation closely analogous to real prints can be reproduced.

Another feature on the performance of the system developed by the invention is good reproduction repeatability. The thermal transfer images are sharp in dot shape and can faithfully reproduce dots responsive to laser beams. In addition, dependence of recording characteristics on temperature and humidity is very small, so the hue and the density can be reproduced consistently over and over again under wide variety of temperature and humidity conditions.

Still another feature on the performance of the system developed by the invention is good color reproduction. Since the transfer images are formed with coloring pigments used for printing ink and can be reproduced with satisfactory repeatability, they permit a color management system (CMS) of high accuracy to be achieved.

Further, the hues of the thermal transfer images can be adjusted so as to almost match the hues or Japan colors or SWOP colors, namely hues of prints. Therefore, although the colors of the transfer images vary their appearances when they are viewed under different light sources, such as a fluorescent lamp and an incandescent lamp, such variations in appearances can be made the same as those caused in colors of prints.

The other feature on the performance of the system developed by the invention is high quality of recorded characters. The thermal transfer images obtained by this system are sharp in dot shape, so they can reproduce crisply minute letters.

In greater detail, features of the materials art relating to the present system are described below. As thermal transfer systems applicable to DDCP, there are (1) a sublimation system, (2) an ablation system and (3) a fusion system. When the system (1) or (2) is adopted, however, the dots formed have blurred outlines since sublimation or scattering of coloring materials is utilized therein. And the system (3) also cannot ensure sharp outlines because of fluidity of fused matter. The present applicant has dissolved new problems caused in the laser thermal transfer system on the basis of thin-film transfer techniques, and further incorporated the following arts into those techniques for achieving higher image qualities. One feature of the materials art is an increase in sharpness of dot shape. Images are recorded through steps of converting laser light to heat in a light-to-heat conversion layer, transmitting the heat to an adjacent image-forming layer, and bonding the image-forming layer to the image-receiving layer. In order to sharpen the dot shape, it is therefore required that the heat generated by laser light is transmitted to the transfer interface without diffusing in the direction of the layer's horizontal plane, and the image-forming layer is ruptured sharply at the interface between the heated and unheated areas. In order to meet this requirement, the light-to-heat conversion layer provided in a thermal transfer sheet is reduced in thickness and mechanical characteristics of the image-forming layer are controlled.

The art (1) of sharpening the dot shape is in reduction in thickness of the light-to-heat conversion layer. According simulation testing, it is estimated that the temperature of the light-to-heat conversion layer would-be raised momentarily up to about 700° C. Consequently, a thin layer is subject to deformation and rupture. Once deformation and rupture thereof occur, the light-to-heat conversion layer causes real harms that it is transferred to an image-receiving sheet together with the image-forming layer or makes the transfer images non-uniform. In order to attain the desired temperature, on the other hand, incorporation of a high concentration of light-to-heat conversion material in the layer is required, and causes problems that dyes separate out and migrate into adjacent layers. Although the most frequently used light-to-heat conversion material is carbon, infrared absorbing dyes are used as the present light-to-heat conversion materials because the required amount thereof is smaller than that of carbon. As to the binder, polyimide compounds having sufficiently high mechanical strength at high temperatures and good infrared absorbing dye-retentive properties are introduced, By selecting infrared absorbing dyes having excellent light-to-heat conversion characteristics and highly heat-resistant binder of polyimide type, it is appropriate to reduce the thickness of the light-to-heat conversion layer to about 0.5 $\mu$m or below.

The art (2) of sharpening the dot shape is in improving characteristics of the image-forming layer. When the light-to-heat conversion layer becomes deformed or the image-forming layer itself is deformed by high heat, the image-forming layer transferred to an image-receiving layer generally suffers from unevenness in thickness responsive to a sub-scan pattern of laser light, and thereby the images obtained become non-uniform and the apparent transfer density is lowered. This tendency becomes more pronounced the thinner thickness the image-forming layer has. On the other hand, an increase in thickness of the image-forming layer causes a loss of dot sharpness and reduction in sensitivity.

For attaining these properties which are mutually contradictory, it is favorable to improve evenness in transfer by the addition of a low-melting-point substance, such as wax, to the image-forming layer. Further, proper increase in thickness of the image-forming layer by adding inorganic fine particles instead of a binder permits a sharp rupture of the image-forming layer at the interface between heated and unheated areas, and thereby the unevenness in transfer can be reduced as the sharpness of dots and the sensitivity are kept.

In general, low-melting-point substances, such as waxes, have a tendency to exude to the surface of the image-forming layer or crystallize. In some cases, therefore, they cause degradations in image quality and storage stability of the thermal transfer sheet.

For dealing with this problem, it is favorable to use a low-melting-point substance slightly different in Sp value from a polymer constituting the image-forming layer. Such a low melting-point-substance has high compatibility with the polymer and can avoid separation from the image-forming layer. And it is also favorable to prepare an eutectic mixture by the use of several kinds of low melting point substances having different configurations, thereby preventing them from crystallizing. As a result, images having a sharp dot shape and reduced unevenness can be obtained.

The second feature of the materials art is a discovery that the recording sensitivity has a temperature-and-humidity dependence. In general, coating layers of a thermal transfer sheet change their mechanical and thermal properties by absorption of moisture, which creates a dependence on the humidity of a recording environment.

For reduction of the aforesaid dependence on temperature and humidity, it is appropriate that dye and binder components in the light-to-heat conversion layer and a binder component in the image-forming layer be made into organic solvent-based compositions. Further, there is known a method of selecting polyvinyl butyral as the binder of the image-receiving layer and introducing an art of rendering polymers hydrophobic to reduce water absorbency. Examples of such an art include the art of reacting hydroxyl groups with hydrophobic groups and the art of cross-linking two or more hydroxyl groups with a curing agent, as disclosed in Japanese Patent Laid-Open No. 238858/1996.

The third feature of the materials art is improvement of hue resemblance to real prints. In addition to the arts of pigment color matching and stable dispersion in color proofs of thermal head system (e.g., First Proof made by Fuji Photo Film Co., Ltd.), the following problems newly caused in the laser thermal transfer system. More specifically, the art 1 of improving hue resemblance to real prints consists in that highly heat-resistant pigments are used. In printing by exposure to laser light, heat of no lower than about 500° C. is generally applied to the image-forming layer also, and this heat decomposes some of hitherto used pigments. However, such thermal decomposition of pigments can be prevented by adoption of highly heat-resistant pigments in the image-forming layer.

And the art 2 of improving hue resemblance to real prints consists in prevention of diffusion of infrared absorbing pigments. In order to prevent migration of the infrared absorbing dyes from the light-to-heat conversion layer to the image-forming layer by the high heat evolved upon printing and a change in hue brought about thereby, it is favorable to design the light-to-heat conversion layer so as to contain infrared absorbing dyes in concert with binders having strong holding power.

The fourth feature of the materials art is enhancement of sensitivity. In general, high-speed printing causes an energy shortage, and thereby gaps corresponding to intervals between sub-scans of laser in particular are formed. As mentioned above, the efficiencies of generation and transfer of heat can be elevated by increasing a dye concentration in the light-to-heat conversion layer and decreasing thicknesses of the light-to-heat conversion layer and the image-forming layer. For the purposes of enhancing the effect of filling in the gaps by slight fluidization of the image-forming layer under heating and enhancing adhesion to an image-receiving layer, it is appropriate that a low-melting-point substance be added to the image-forming layer. Further, the same binder as used in the image-forming layer, e.g., polyvinyl butyral, can be adopted as the binder of the image-receiving layer with the intentions of enhancing an adhesion force between the image-receiving layer and the image-forming layer and ensuring sufficient strength in the images transferred.

The fifth feature of the materials art is improvement in vacuum contact capability. It is appropriate that the image-receiving sheet and the thermal transfer sheet be held on a drum by vacuum contact. This vacuum contact is important, because images are formed through control of an adhesion force between both sheets and the image transfer behavior is very sensitive to clearance between the image-receiving layer surface of the image-receiving sheet and the image-forming layer surface of the transfer sheet. When an extraneous matter such as dust adheres to the layer surfaces, clearance between the sheets is widened to result in occurrence of imperfections in images and uneven transfer of images.

In order to prevent occurrence of image imperfections and uneven transfer of images, it is advantageous to provide uniform asperity on the surface of the thermal transfer sheet to improve air passage, thereby securing uniform clearance.

The art 1 of improving vacuum contact capability is to roughen the surface of the thermal transfer sheet. In order to fully achieve the vacuum contact effect even in the case of making prints by overlaying at least two colors, the surface of the thermal transfer sheet is provided with asperities. As methods for providing asperities on the surface of the thermal transfer sheet, there are generally known an after-treatment, such as embossing, and addition of a matting agent to a coating layer. From the viewpoints of simplicity of the manufacturing process and storage stability of the material, the addition of a matting agent is preferred. The matting agent is required to have a particle size greater than the coating layer thickness, but the matting agent added to the image-forming layer has a drawback of causing image dropouts in the spots where the matting agent particles are present. Therefore, it is preferable to add a matting agent having the most suitable particle size to the light-to-heat conversion layer. And by doing so, the image-forming layer itself can have an almost uniform thickness and defects-free images can be obtained on the image-receiving sheet.

Then, features of the systematization art of the present system are described below. The feature 1 of the systematization art is the configuration of the recording apparatus. In order to reproduce sharp dots with reliability, as described hereinbefore, a high-precision design is required on the part of a recording apparatus also. The basic configuration of a recording apparatus usable in the invention is the same as that of a traditional recording system for laser thermal transfer. Specifically, the recording apparatus used in the invention can be basically configured as the so-called outer drum recording system in heat mode, or the system of recording by irradiating thermal transfer and image-receiving sheets fixed on a drum with laser beams emitted from a recording head provided with a plurality of high-power laser devices. The following are suitable embodiments of such a configuration.

The scheme 1 of the recording apparatus is to avoid contamination with dust. Both image-receiving sheet and the thermal transfer sheet are fed fully automatically by means of rolls. A reason for adoption of roll feeding is that contamination with human body-originated dust is dominant in the case of feeding a small number of sheets.

One roll of a thermal transfer sheet is installed for each of four colors, and four rolls of different colors are selected alternately by rotation of a loading unit. Each sheet is cut to a specified length by means of a cutter in the course of loading, and then fixed on a drum.

The scheme 2 of the recording apparatus is to strengthen contact between the image-receiving sheet and the thermal transfer sheet loaded on the drum. Fixation of the image-receiving sheet and the thermal transfer sheet to the recording drum is performed by vacuum adsorption. Since mechanical fixation cannot heighten the adhesion force between the image-receiving sheet and the thermal transfer sheet, vacuum adsorption is adopted in the invention. The recording drum is designed so as to have many holes at the surface for vacuum adsorption and the interior of the drum is decompressed with a blower or a pressure-reducing pump. As a result, the sheets are stuck on the recording drum. The image-receiving sheet is adsorbed to the recording drum first, and then the thermal transfer sheet is adsorbed to the image-receiving sheet on the recording drum. Therefore, the size of the thermal transfer sheet is made greater than that of the image-receiving sheet. The air present in a clearance between the thermal transfer sheet and the image-receiving sheet, which has great influences on the recording performance, is sucked from the area of the thermal transfer sheet that extends off the image-receiving sheet.

The scheme 3 of the recording apparatus is to consistently stack a plurality of sheets on a discharge board. The present recording apparatus is designed so that a great many sheets of large dimensions like B2-size or larger are stacked continuously on a discharge board. When a sheet B is discharged onto the image-receiving layer of a sheet A already stacked and stacked on the sheet A, sticking occurs between the sheets A and B as far as these sheets have thermally adhesive properties. Once the sticking occurs, the sheets stuck together cannot be ejected orderly and cause undesirable jamming. In order to prevent such sticking, it is best to keep the sheets A and B from contact with each other. As to contact-inhibition measures, there are known (a) a way of making a gap between sheets by making the discharge board in a stepped form and avoiding sheets from being in a flat state, (b) a way of structuring to allow each sheet to fall from an discharge mouth arranged at a high position onto the discharge board, and (c) a way of floating a second sheet discharged later over a first sheet discharged in advance by sending (blowing) an air between two sheets (the first sheet and the second sheet). In the present system, the sheet -size is a very large B2-size, and so the ways (a) and (b) entail a very large configuration. Therefore, the way (c) namely the way of sending (blowing) an air between two sheets to float the sheet discharged later, is adopted in the invention.

Figure 2:
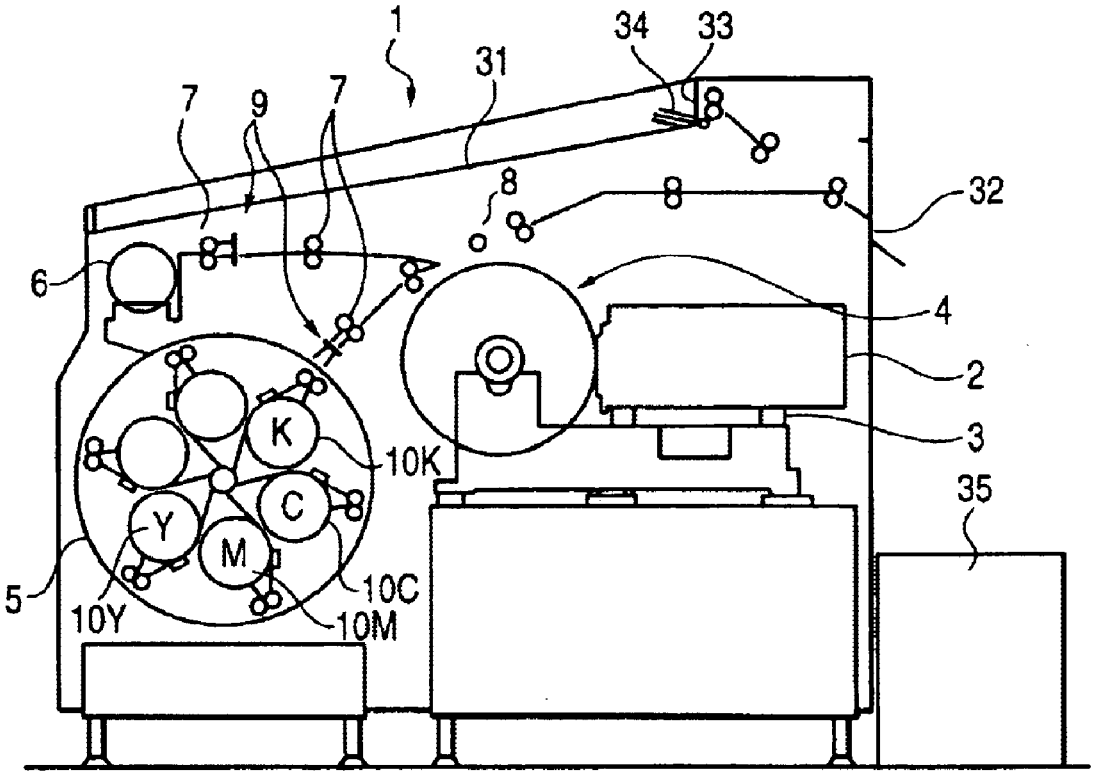
FIG. 2 is a diagrammatic drawing of an example of a configuration of a laser thermal transfer recording apparatus.

An example of a configuration adopted by the present recording apparatus is shown in FIG. 2.

The sequence performed for forming full-color images by applying image-forming materials to the present recording apparatus as mentioned above (which is referred to as "the image-forming sequence of the present system") is explained below.

1) In the recording system 1, the sub-scan axis of the recording head 2 is returned to its original position by means of the sub-scan rail 3, and the main-scan rotation axis of the recording drum 4 and the thermal transfer sheet loading unit 5 are also returned to their respective original positions.
2) The image-receiving sheet roll 6 is unrolled by means of the guide rollers 7, and the leading end of the image-receiving sheet is fixed on the recording drum 4 by vacuum suction via suction holes made in the recording drum 4.
3) The squeeze roll 8 is brought down to the recording drum 4 and presses the image-receiving sheet against the recording drum, and while being pressed against the drum the image-receiving sheet is further conveyed in a specified quantity by rotation of the drum. At this point, the conveyance of the image-receiving sheet is brought to a halt and the image-receiving sheet is cut to a specified length.
4) The loading of a piece thus cut from the image-receiving sheet roll (hereinafter referred to as "an image-receiving sheet") is completed by further rotating the recording drum one turn.
5) Next, the thermal transfer sheet K of the first color, namely black, is unreeled from the thermal transfer sheet roll 10K, cut and loaded according to the same sequence as the image-receiving sheet has followed.
6) Then, the recording drum 4 commences rotating at a high speed, and at the same time the recording head 2 on the sub-scan rail 3 commences moving. When the recording head 2 reaches the recording start position, the laser radiation based on recording image signals is applied to the recording drum 4 from the recording head 2. The irradiation with laser is terminated at the recording end point, and the movement on the sub-scan rail and the rotation of the drum are brought to a stop. Further, the recording head on the sub-scan rail is returned to its original position.
7) Only the thermal transfer sheet K is peeled away as the image-receiving sheet is left on the recording drum. Therein, the front end of the thermal transfer sheet K is hooked on a nail and pulled out in the direction of discharge, followed by throwing it away from the waste exit 32 in the waste box 35.
8) The operations in the processes 5) to 7) are repeated for each of the remaining three colors of thermal transfer sheets. The recording order, from the first to the last, is black, cyan, magenta and yellow. Specifically, it is carried out sequentially to unreel the thermal transfer sheet C of the second color, namely cyan, from the thermal transfer sheet roll 10C, the thermal transfer sheet M of the third color, namely magenta, from the thermal transfer sheet roll 10M and the thermal transfer sheet Y of the fourth color, namely yellow, from the thermal transfer sheet roll 10Y. This order is opposite to the general printing order. This is because the order of colors is reversed on printing paper in the later processes of transferring color images to the printing paper.
9) After the recording in four colors is completed, the image-recorded image-receiving sheet is discharged until it reaches the discharge board 31. The image-receiving sheet is peeled away from the drum in the same manner as the thermal transfer sheets are peeled away in the process 7). However, the image-receiving sheet is not scraped in contrast to the thermal transfer sheets. Therefore, the image-receiving sheet having traveled to the waste exit 32 is turned back toward the discharge board by switchback. The image-receiving sheet is discharged to the discharge board while blowing the air 34 from the underside of the discharge mouth 33, and this air blow permits stacking of a plurality of image-receiving sheets.

It is advantageous that adhesive rollers on the surface of which an adhesive material is provided are adopted as guide rollers 7 arranged in either feed or transfer sections of the thermal transfer sheet rolls and the image-receiving sheet roll.

By installing adhesive rollers, it becomes possible to clean the surfaces of thermal transfer and image-receiving sheets.

Examples of an adhesive material provided on the surfaces of adhesive rollers include ethylene-vinyl acetate copolymer, ethylene-ethyl acrylate copolymer, polyolefin resin, polybutadiene resin, styrene-butadiene copolymer (SBR), styrene-ethylene-butene-styrene copolymer (SEBS), acrylonitrile-butadiene copolymer (NBR), polyisoprene resin (IR), styrene-isoprene copolymer (SIS), acrylate copolymers, polyester resin, polyurethane resin, acrylic resin, butyl rubber and polynorbornene.

As the adhesive material of the adhesive rollers, materials containing titanium dioxide and having C—O or Si—O functional groups are suitable in particular from the viewpoints of ensuring appropriate adhesion and long-term adhesion stability. Of these materials, materials having barium concentrations reduced to the minimum are further preferred.

The surfaces of thermal transfer and image-receiving sheets can be cleaned merely by contact with adhesive rollers. In this case, there are no particular limits to the contact pressure so long as the roll surface is in contact with the sheet surface.

For the adhesive material used for adhesive rollers, it is appropriate to have a Vickers hardness Hv of 50 kg/mm$^2$ (roughly corresponding to 490 MPa) or below from the viewpoints of a total elimination of extraneous substances, such as dust, and prevention of image imperfections.

The Vickers hardness Hv is a hardness measured with a static load-imposed diamond stylus in the shape of a right pyramid having a facing angle of 136°, and defined by the following equation:

$$Hv=1.854\ P/d^2\ (kg/mm^2)=\text{approximately } 18.1692\ P/d^2\ (MPa)$$

wherein P is a value of the load imposed (kg) and d is a diagonal length of the indentation in square shape (mm).

In addition, it is appropriate for the adhesive material used for adhesive rollers to have an elasticity modulus of 200 kg/cm$^2$ (approximately 19.6 MPa) or below at 20° C. from the viewpoints of complete removal of dust as an extraneous matter and reduction of image imperfections.

The feature 2 of the systematization art is the configuration of the thermal transfer unit.

The thermal transfer unit is used for performing the process of transferring images printed on -the image-receiving sheet by the use of the recording apparatus onto -real printing paper (hereinafter referred merely to as "sprinting paper"). This process is identical with First Proof TM. When heat and pressure are applied to the image-receiving sheet on which printing paper is superposed, the image-receiving sheet is bonded to the printing paper. Then, the image-receiving sheet is peeled away from the printing paper. As a result, only the images and the adhesive layer are left on the printing paper, but the substrate and the cushion layer of the image-receiving sheet come off. In other words, the images are transferred from the image-receiving sheet to the printing paper.

Figure 3:
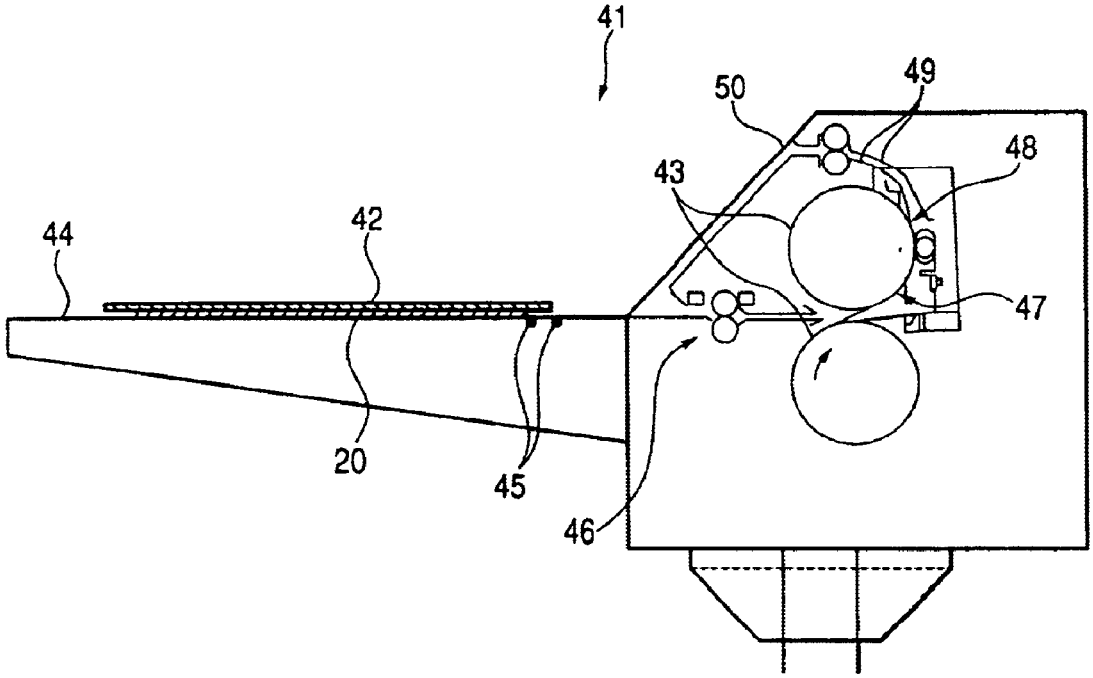
FIG. 3 is a diagrammatic drawing of an example of a configuration of a thermal transfer unit.

In First Proof TM, printing paper is superposed on a image-receiving sheet placed on an aluminum-made guide plate, and passed between heat rollers, thereby performing transfer. A reason for using an aluminum-made guide plate is that deformation of printing paper is prevented. However, the adoption or this process in the present system using B2-size sheets requires an aluminum plate having a size larger than B2 size, and causes a problem that a large space is required for installation of the thermal transfer unit. Therefore, the present system utilizes no aluminum-made guide plate, but such a configuration as to eject on the insertion side by a 180° turn of the conveyance path, thereby succeeding in making the installation space very small (FIG. 3). Owing to avoidance of an aluminum-made guide plate, however, a deformation problem is caused in printing paper. Specifically, a pair of ejected printing paper and image-receiving sheet curls up with the image-receiving sheet on the inside, and rolls about on the discharge board. It is a very difficult operation to peel the image-receiving sheet away from this curled printing paper.

In thinking about a method for avoiding the curl, an attention is focused on both a bimetal effect caused by a shrinkage difference between printing paper and an image-receiving sheet and an iron effect arising from a configuration that a heat roller is entwined with printing paper and an image-receiving sheet. When the insertion is carried out in a condition that the image-receiving sheet is superposed on printing paper as in the usual case, the thermal shrinkage of the image-receiving sheet is greater than that of printing paper in the proceeding direction of insertion. As a result, the upper sheet is curled inwardly by bimetal effect, in the same direction as in the case of iron effect. Therefore, the curling problem becomes more serious by a synergistic effect. On the other hand, as far as the insertion is carried out in a condition that printing paper is superposed on an image-receiving sheet, the curl by the bimetal effect is downward and that by the iron effect is upward. Thus, these curls are counterbalanced with each other, and the problem is resolved.

The sequence of transfer to printing paper (hereinafter referred to as "method of transferring to printing paper by use of the present system") is as follows. Additionally, the thermal transfer unit 41 shown in FIG. 3 is a manual-work device, in contrast to the recording apparatus.

1) First, the temperature of heat rollers 43 (in the range 100–110° C.) and the conveyance speed at the time of transfer are set on the dials (not shown in the figure) depending on the type of printing paper used.

2) Next, the image-receiving sheet 20 is placed on the insertion board 44 with the image side up, and the dust on the image is removed with a static elimination brush (not shown in the figure). Thereon, printing paper 42 cleaned of dust is superposed. At this time, the location of the image-receiving sheet 20 becomes invisible because the size of the printing paper 42 placed on the upper side is greater than that of the image-receiving sheet placed on the lower side, so registration is difficult. In order to better the workability or registration, marks 45 for indicating the mounting positions of an image-receiving sheet and printing paper, respectively, are made in advance on the insertion board 44. A reason why the printing paper has a larger size is that the larger size of printing paper can prevent the heat roller 43 from becoming dirty with the image-receiving layer of the image-receiving sheet even when the image-recording sheet somewhat go out of alignment with the printing paper.

3) Upon pushing the image-receiving sheet and the printing paper into the insertion slit as they are kept in a superposed state, the insertion rollers 46 rotate and send out the sheet and the paper toward the heat rollers 43.

4) When the front-end of the printing paper reaches the position of the heat rollers 43, the heat rollers nip the printing paper and transfer operation starts. These heat rollers are made of heat-resistant silicone rubber. Herein, both pressure and heat are applied simultaneously to the printing paper and the image-receiving sheet, and thereby the printing paper and the image-receiving sheet are bonded together. The guide 47 made of heat-resistant sheet is arranged downstream from the heat rollers, and a pair of image-receiving sheet and printing paper are conveyed in upward direction so as to pass between the upper heat roller and the guide 47 as heat is applied thereto. At the position of the parting nail, the pair is pulled off the heat roller and guided along the guide plate 49 to the discharge port 50.

5) The pair of image-receiving sheet and printing paper is ejected from the discharge port 50 onto the insertion board as they are bonded together. Then, the image-receiving sheet 20 is peeled apart from the printing paper by manual work.

When the recording apparatus and the thermal transfer unit as mentioned above are connected to a plate-making system, the function as color proof can be performed. For the system, it is required that prints with image qualities as close as possible to those of prints output from a certain plate-making data be output from proofs. Therefore, software for bringing colors and dots close to those of prints becomes necessary.

An example of connection is introduced below.

In the case of getting proofs of prints from a plate-making system Celebra TM (made by Fuji Photo Film Co., Ltd.), the connections in the system are as follows: CTP (Computer To Plate) system is connected to the Celebra. The printing plate output by this Celebra-connected system is mounted in a printing machine and produces final prints. To the Celebra, the recording apparatus LUXEL FINALPROOF 5600 (hereinafter abbreviated as "FINALPROOF", too) made by Fuji Photo Film Co. Ltd. is connected as color proof. Between the Celebra and the recording apparatus, proof drive software PD System TM made by Fuji Photo Film Co., Ltd. is connected in order to bring colors and dots close to the prints.

Figure 4:
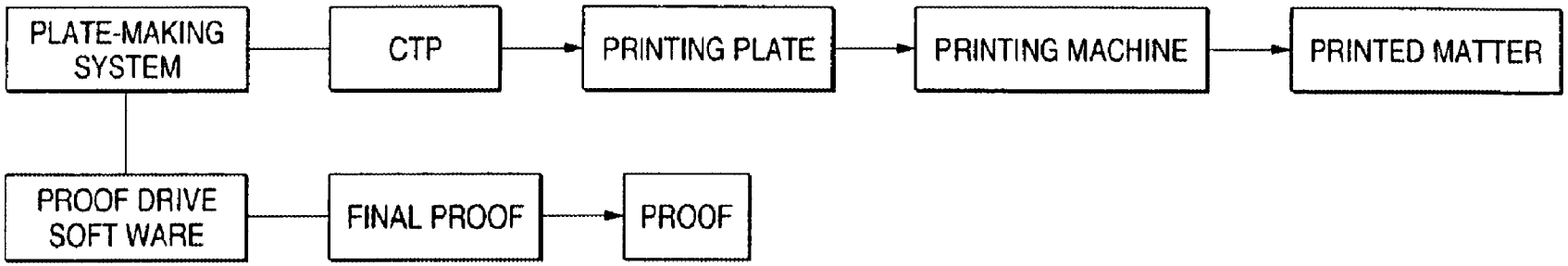
FIG. 4 is a block diagram showing an example of system configuration using FINALPROOF in a laser thermal transfer recording apparatus.
Figure 5:
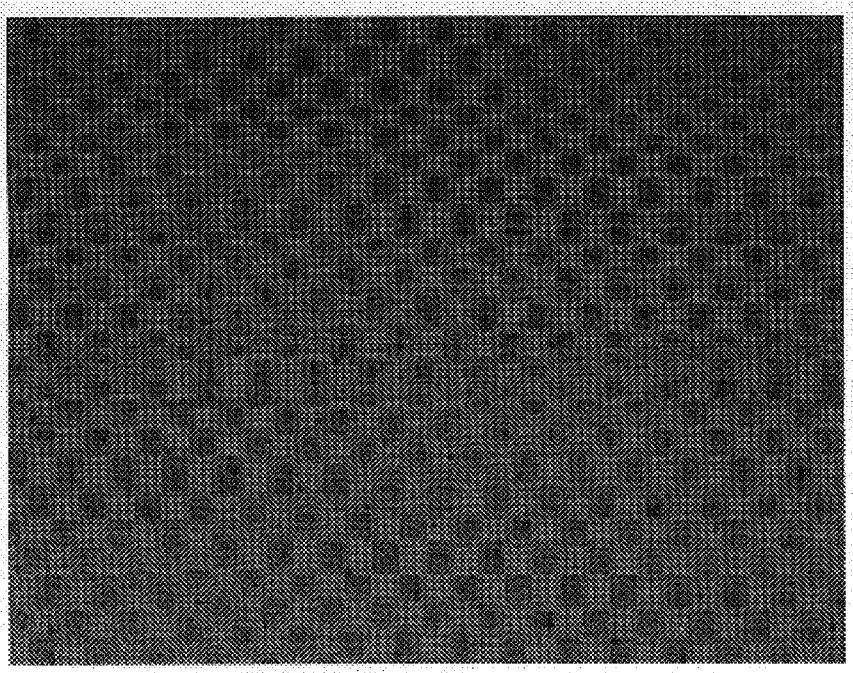
FIG. 5 shows dot shapes of the images obtained in Example 2-1. The distance between adjacent dots' centers is 125 $\mu$m.
Figure 6:
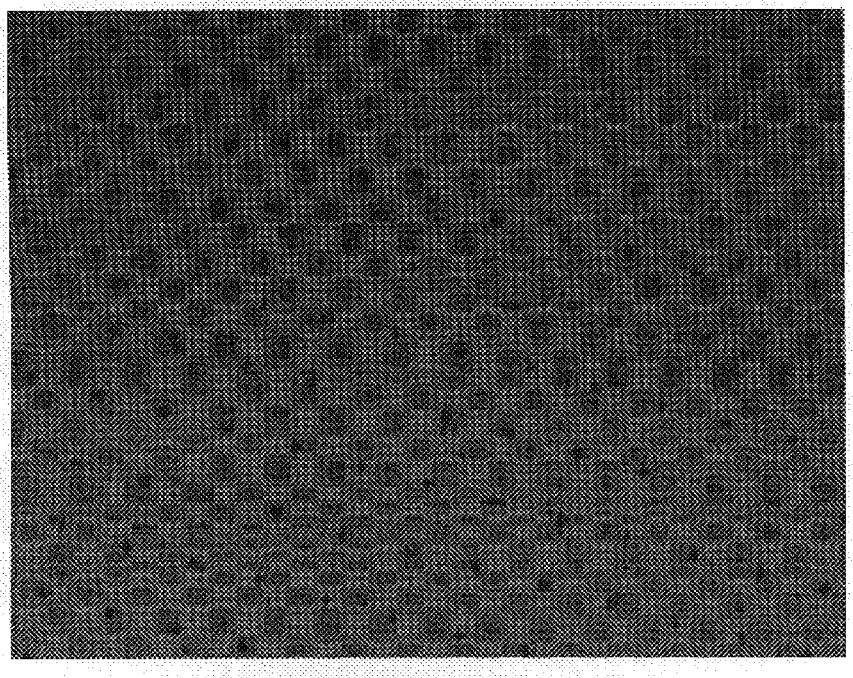
FIG. 6 shows dot shapes of the images obtained in Example 2-1. The distance between adjacent dots' centers is 125 $\mu$m.
Figure 7:
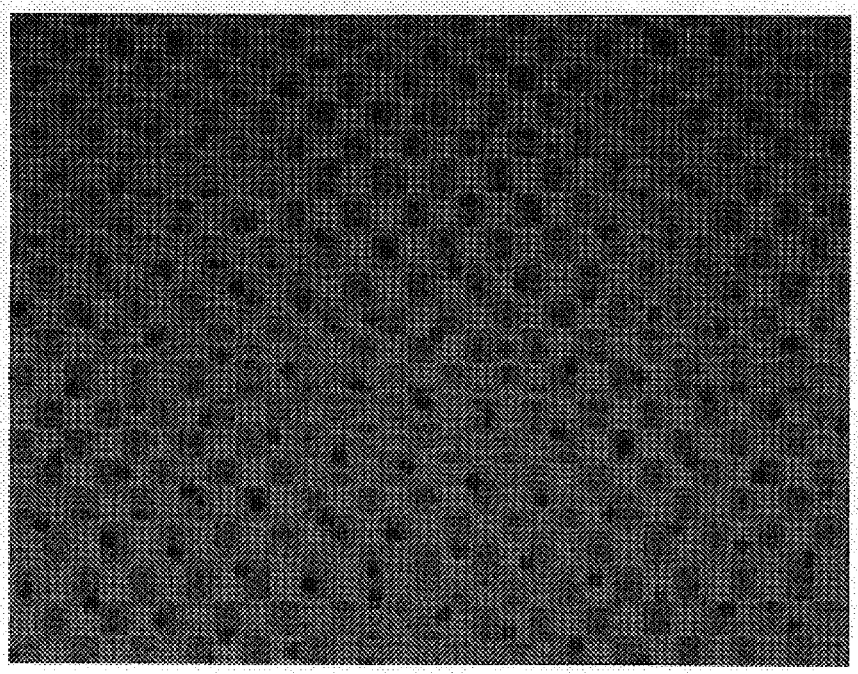
FIG. 7 shows dot shapes of the images obtained in Example 2-1. The distance between adjacent dots' centers is 125 $\mu$m.
Figure 8:
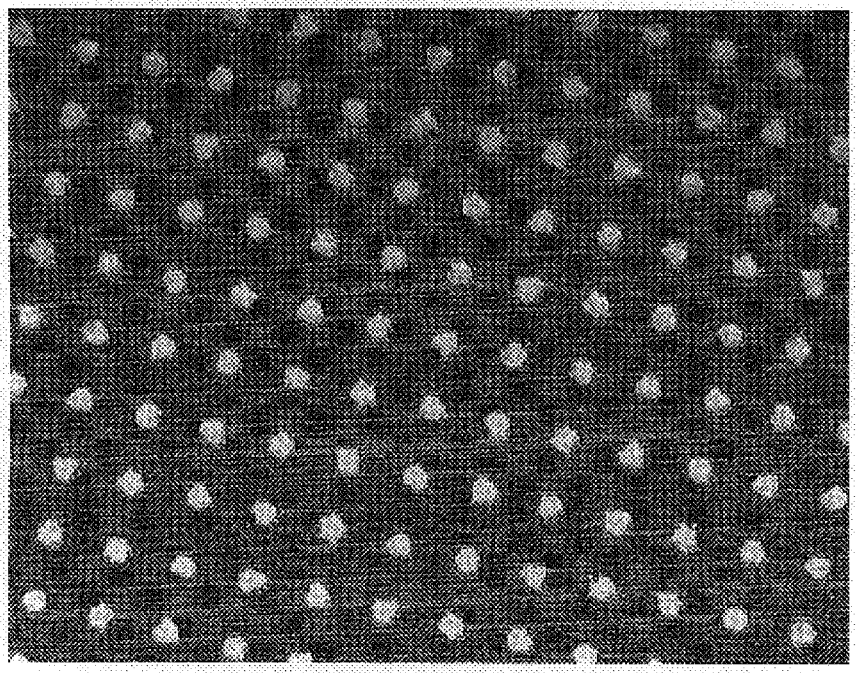
FIG. 8 shows dot shapes of the images obtained in Example 2-1. The distance between adjacent dots' centers is 125 $\mu$m.
Figure 9:
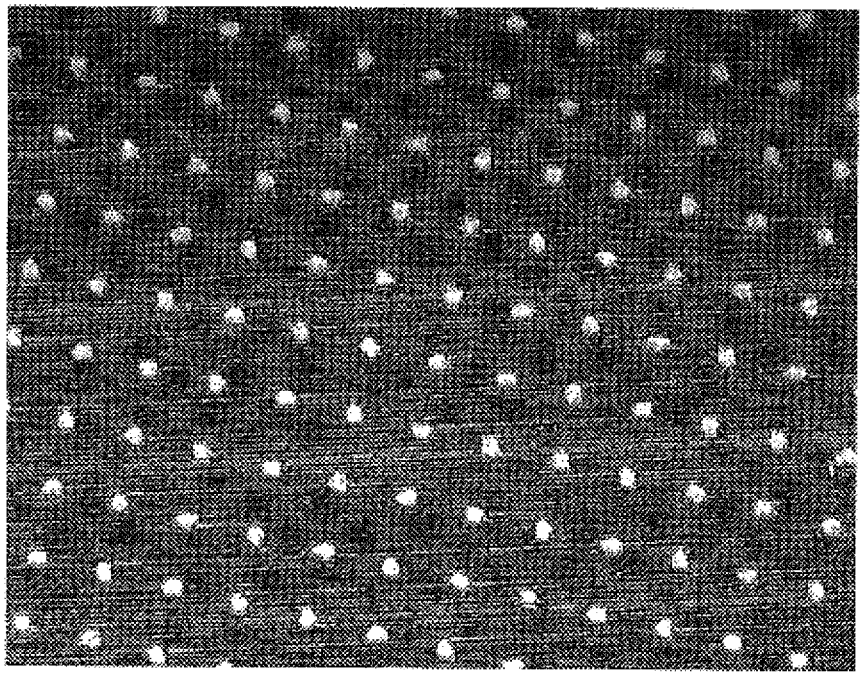
FIG. 9 shows dot shapes of the images obtained in Example 2-1. The distance between adjacent dots' centers is 125 $\mu$m.
Figure 10:
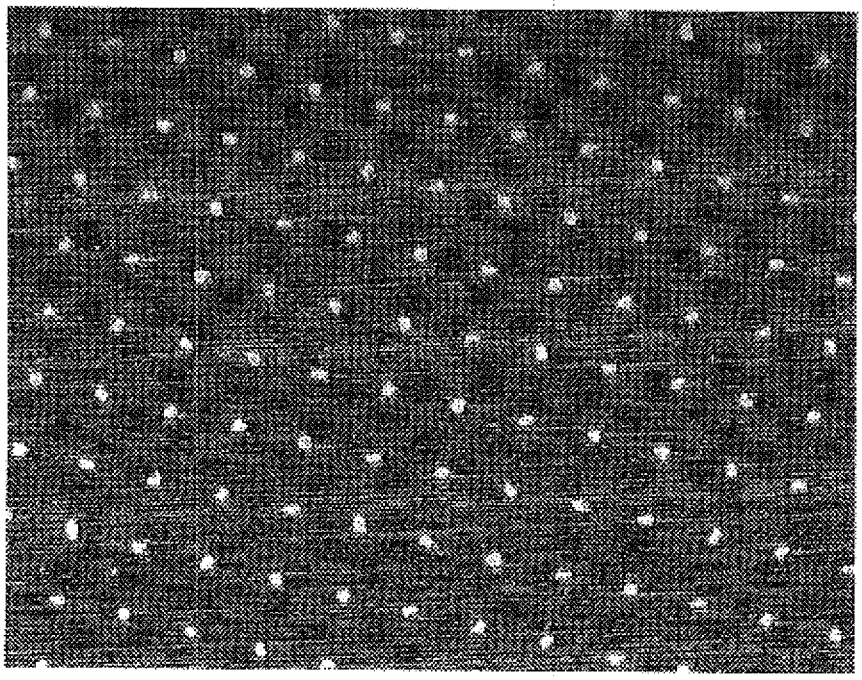
FIG. 10 shows dot shapes of the images obtained in Example 2-1. The distance between adjacent dots' centers is 125 $\mu$m.
Figure 11:
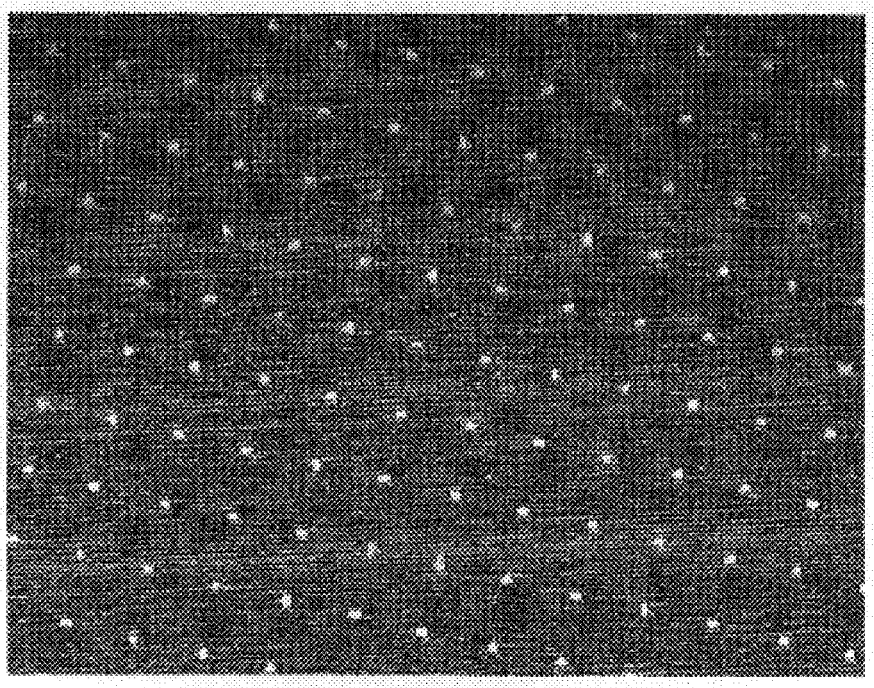
FIG. 11 shows dot shapes of the images obtained in Example 2-1. The distance between adjacent dots' centers is 125 $\mu$m.
Figure 12:
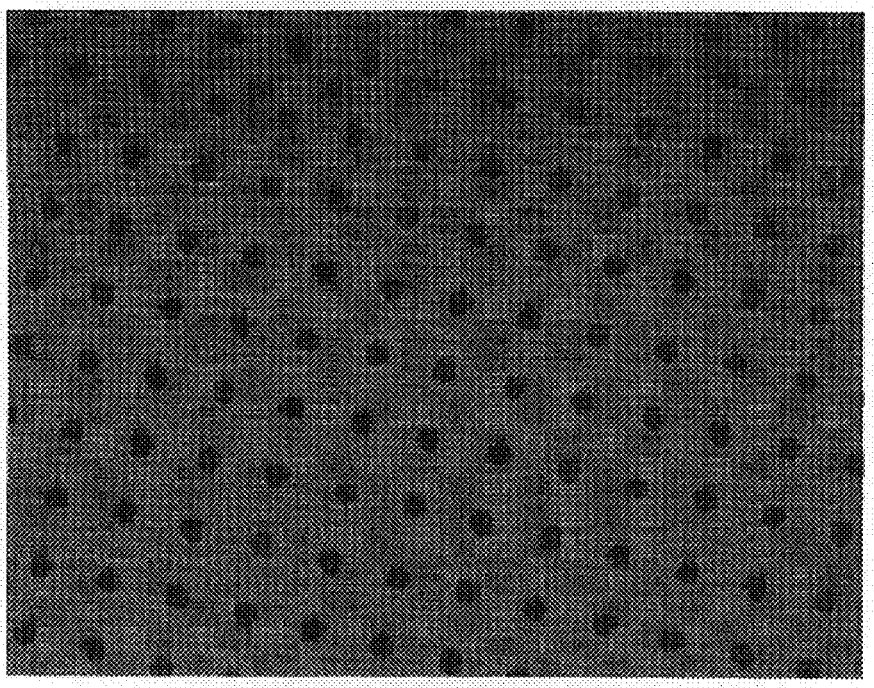
FIG. 12 shows dot shapes of the images obtained in Example 2-1. The distance between adjacent dots' centers is 125 $\mu$m.

Continuous-tone data converted to raster data by the Celebra is converted to binary data for dots, output to the CTP system, and finally printed. On the other hand, the same continuous-tone date is output to the PD system also. The PD system converts the received data so as to match colors with the prints according to a four-dimensional (black, cyan, magenta, yellow) table. Finally, it is converted to binary data for dots so as to match with dots of the prints, and output to FINALPROOF (FIG. 4).

The four-dimensional table is made empirically in advance, and stored in the system. Experiments for table formation are as follows. Images printed from important color data via a CTP system and image output produced by the recording system via the PD system are prepared, and examined for their colors with a colorimeter. A comparison between the colorimetric values of those images with respect to each color is performed, and the table is made so as to minimize differences between those colorimetric values.

As mentioned above, the invention is a practical realization of a system configuration for making full use of capabilities of high-resolution materials.

Now, thermal transfer sheets included in the materials used in the present system are illustrated below.

The suitable difference in surface roughness Rz between the image-forming layer surface and the backing layer surface of each thermal transfer sheet is 3.0 or below, expressed in terms of absolute value. In addition, it is appropriate that a difference in surface roughness Rz between the image-receiving layer surface and the backing layer surface of an image-receiving sheet be also 3.0 or below, expressed in terms of absolute value. By combination of the adjustment of the surface roughness difference to such a range with the cleaning means mentioned hereinbefore, image imperfections can be prevented from occurring, conveyance jamming is eliminated, and dot-gain consistency is enhanced.

The definition of the surface roughness Rz and the determination method thereof are described hereinbefore.

From the viewpoint of further enhancing those effects, it is preferable that the difference in surface roughness Rz between the image-forming layer surface and the backing layer surface of each thermal transfer sheet be adjusted to 1.0 or below, expressed in terms of absolute value, and the difference in surface roughness Rz between the image-receiving layer surface and the backing layer surface of an image-receiving sheet be also adjusted to 1.0 or below, expressed in terms of absolute value.

Furthermore, it is advantageous that the image-forming layer of each thermal transfer sheet has a glossiness of 80 to 99.

The glossiness depends to a large degree on the smoothness of the image-forming layer surface, and thereby the uniformity of the image-forming layer thickness can be influenced. The higher glossiness the image-forming layer has, it has the higher uniformity and becomes the more suitable for high-definition image formation. However, the higher glossiness of the image-receiving layer causes the stronger resistance in the process of conveyance. In other words, there is a trade-off relation between higher glossiness and lower conveyance resistance. As far as the glossiness is in the range of 80 to 99, those two factors can go hand in hand, and the balance between them is achieved.

Next the mechanism of multicolored image formation by laser-utilized thin-film thermal transfer is schematically illustrated with the aid of FIG. 1.

A laminate 30 for image formation is prepared by laminating an image-receiving sheet 20 on the surface of a black (K), cyan (C), magenta (M) or yellow (Y) pigment-containing image-forming layer 16 of a thermal transfer sheet 10. The thermal transfer sheet 10 has a substrate 12, a light-to-heat conversion layer 14 provided on the substrate, and further an image-forming layer 16 on the conversion layer 14. The image-receiving sheet 20 has a support 22 and an image-receiving layer 24 on the support, and is laminated on the thermal transfer sheet 10 so that the image-receiving layer 24 is brought into contact with the surface of the image-forming layer 16 (FIG. 1(*a*)). The laminate 30 undergoes imagewise irradiation with laser light in time sequence from the side of the substrate 12 of the thermal transfer sheet 10. Thereby, the light-to-heat conversion layer 14 of the thermal transfer sheet 10 produces heat in the laser light-irradiated area, As a result, the adhesion of the light-to-heat conversion layer 14 to the image-forming layer 16 is lowered in the area having produced heat (FIG. 1(*b*)). Thereafter, the image-receiving sheet 20 is peeled away from the thermal transfer sheet 10 to result in transfer of the laser light-irradiated area 16' of the image-forming layer 16 to the image-receiving layer 24 of the image-receiving sheet 20 (FIG. 1(*c*)).

In the multicolored image formation, laser light suitable for irradiation is multiple-beam light, especially two-dimensional array of multiple beams. The term "two-dimensional array of multiple beams" as used herein means that a plurality of laser beams are used in recording by irradiation with laser light and a spot array of these laser beams takes the form of a two-dimensional flat matrix composed of a plurality of columns along the direction of the main-scan direction and a plurality of rows along the direction of the sub-scan direction.

By using laser light composed of a two-dimensional array of multiple beams, the time required for laser recording can be cut off.

The laser light usable in the invention has no particular restrictions. Specifically, it includes direct laser light such as gas laser light (e.g., argon-neon laser light, helium-neon laser light or helium-cadmium laser light), solid laser light (e.g., YAG laser light), semiconductor laser light, dye laser light and excimer laser light. In addition, the light obtained by passing laser light as recited above through a second harmonic device to reduce its wavelength to the half can also be used. In forming multicolored images, it is advantageous to use semiconductor laser light from the viewpoints of power of output and easiness of modulation. For multicolored image formation, it is appropriate to perform irradiation under a condition that the beam diameter of laser light on the light-to-heat conversion layer be in the range of 5 to 50 $\mu$m (particularly 6 to 30 $\mu$m) and the scanning speed be adjusted to at least 1 m/sec (particularly at least 3 m/sec).

Furthermore, it is appropriate for multicolored image formation that the thickness of the image-forming layer in a black thermal transfer sheet be greater than those in thermal transfer sheets of other colors, and that in the range of 0.5 to 0.7 $\mu$m. By such thickness adjustment, it is possible to control the lowering of image density due to uneven transfer when the black thermal transfer sheet is irradiated with laser.

By adjusting the thickness of the image-forming layer in the black transfer sheet to 0.5 $\mu$m or greater, non-uniform transfer and a substantial reduction of the image density are prevented from occurring in the case of high-energy recording, and so the image densities required for proofs in graphic arts can be attained. This tendency is remarkable under high humidity conditions, so that a change in density caused by surroundings can be reduced. On the other hand, as far as the image-forming layer thickness is adjusted to 0.7 $\mu$m or smaller, transfer sensitivity at the time of laser recording can be ensured, and adhesion of small dots and fine-line quality can be improved. This tendency is more noticeable under lower humidity conditions. Further, resolution can be enhanced. The more suitable thickness of the image-forming layer in the black thermal transfer sheet is from 0.55 to 0.65 $\mu$m, especially 0.60 $\mu$m.

Furthermore, it is appropriate that the thickness of the image-forming layer in the black thermal transfer sheet be from 0.5 to 0.7 $\mu$m and those in yellow, magenta and cyan thermal transfer sheets be each from 0.2 to thinner than 0.5 $\mu$m.

When the image-forming layer in each of the yellow, magenta and cyan thermal transfer sheets has a thickness of 0.2 $\mu$m or greater, non-uniform transfer can be prevented and the intended density can be attained at the time of laser recording; while, when the thickness is smaller than 0.5 $\mu$m, transfer sensitivity and resolution can be improved. The more suitable thickness of those image-forming layers each is in the range of 0.3 to 0.45 μm.

It is advantageous that the black thermal transfer sheet contains carbon black in its image-forming layer. And the carbon black is preferably a carbon black mixture of at least two kinds differing in coloring power. This is because the use of such a mixture enables the control of reflection density while maintaining the P/B (pigment/binder) ratio within a specified range.

The coloring power of carbon black can be represented in various ways. For instance, it can be expressed in terms of PVC blackness as described in Japanese Patent Laid-Open No. 140033/1998. The term "PVC blackness" signifies the value evaluated as follows: A sample is prepared by adding a specimen of carbon black to PVC resin, dispersing the specimen into the resin and then forming the carbon black-dispersed resin into a sheet. The carbon black products marketed under the trade names of Carbon Black #40 and #45 by Mitsubishi Chemical Corporation are adopted as standard specimens, and the blackness values of the sheets prepared using those products in the manner mentioned above are graded as point 1 and point 10 respectively. By the use of these values as the standards of reference, the blackness of the sample is evaluated visually. And it is feasible to properly select two or more carbon black products differing in PVC blackness depending on the required purpose and use them.

The preparation method of samples is described below:

<Method for Sample Preparation>

By use of a 250 ml Banbury mixer, a specimen of carbon black and LDPE (low-density polythylene) resin are compounded in a proportion of 4:6 by weight, and kneaded for 4 minutes at 115° C. More specifically, the compounding condition is as follows:

| | |
|---|---|
| LDPE resin | 101.89 g |
| Calcium stearate | 1.39 g |
| Irganox 1010 | 0.87 g |
| Carbon black | 69.43 g |

Then, the kneaded matter is diluted at 120° C. so as to have a carbon black concentration of 1 weight % by means of a two-rod mill. The conditions for preparing a diluted compound are as follows:

| | |
|---|---|
| LDPE resin | 58.3 g |
| Calcium stearate | 0.2 g |
| Resin compounded with 40 wt % of carbon black | 1.5 g |

The diluted compound thus prepared is made into a sheet under the condition that the slit width is 0.3 mm, and further cut into chips, followed by formation of a film with a thickness of 65±3 μm on a 240° C. hot plate.

Multicolored image formation may be carried out by, as mentioned above, using a plurality of thermal transfer sheets differing in color and superimposing on the same image-receiving sheet the image-forming layer (wherein images have been formed) of each of those thermal transfer sheets in sequence, or by once forming images of each color on the image-receiving layer of each of many image-receiving sheets and then retransferring those images of different colors to a printing paper.

In the latter case, for instance, thermal transfer sheets whose image-forming layers contain colorants differing in hue respectively are prepared, and formed independently into image-forming laminates of 4 types (4 colors, namely cyan, magenta, yellow and black) by being combined with image-receiving sheets. Each of the laminates is irradiated with laser light according to digital signals based on images via a color separation filter, and subsequently the thermal transfer sheet is peeled away from the image-receiving sheet. Thus, color separation images of each color are formed independently on each image-receiving sheet. Then, the color separation images formed are laminated in sequence on an actual support prepared separately, such as a printing paper, or a support similar thereto. In the manner as mentioned above, multicolored images can be formed.

In the case of thermal transfer sheets of the type which utilize irradiation with laser light, it is advantageous that images are formed on an image-receiving sheet or image-receiving sheets by the use of a thin-film transfer system wherein heat energy converted from laser beams is utilized in transferring image-forming layers containing pigments in a state of thin film to the-image-receiving sheet or sheets. However, the techniques used for development of the image-forming material comprised of those thermal transfer sheets and image-receiving sheet(s) can be appropriately applied to developments of thermal transfer sheets and/or image-receiving sheets for transfer systems of fusion, ablation and sublimation types. Therefore, the present system can also include image-forming materials usable for those transfer systems.

Thermal transfer sheets and image-receiving sheets according to the invention are illustrated below in more detail.

[Thermal Transfer Sheet]

Each of the thermal transfer sheets has on a substrate at least a light-to-heat conversion layer and an image-forming layer, and further may have other layers, if desired.

(Substrate)

The substrate for the present thermal transfer sheets is not particularly restricted as to its material, but various substrate materials can be used depending on the intended purposes. Suitable substrates are those having stiffness, good dimensional stability and heat resistance high enough to withstand the heat produced by image formation. Suitable examples of a substrate material include synthetic resin materials, such as polyethylene terephthalate, polyethylene-2,6-naphthalate, polycarbonate, polymethyl methacrylate, polyethylene, polypropylene polyvinyl chloride, polyvinylidene chloride, polystyrene, styrene-acrylonitrile copolymer, polyamide (aromatic or aliphatic), polyimide, polyamideimide, polysulfone and polyether sulfone. Of these synthetic resins, biaxially stretched polyethylene terephthalate is preferred over the others from the viewpoints of mechanical strength and thermal dimensional stability. When the thermal transfer sheets are applied to formation of a color proof by the use of laser recording, it is appropriate that the substrate therefor be made from a transparent synthetic resin material capable of transmitting laser light. The suitable thickness of a substrate is from 25 to 130 μm, particularly preferably from 50 to 120 μm. The suitable center-line average surface roughness Ra (determined with a roughness tester, e.g., Surfcom made by Tokyo Seiki Co., Ltd., according to JIS B60601) the substrate has on the image-forming layer side is below 0.1 μm. The suitable Young's modulus of the substrate in the length direction is from 200 to 1,200 kg/mm$^2$ (approximately 2 to 12 GPa), and the suitable Young's modulus of the substrate in the width direction is from 250 to 1,600 kg/mm$^2$ (approximately 2.5 to 16 GPa). The suitable F-5 value of the substrate in the length direction is from 5 to 50 kg/mm$^2$ (approximately 49 to 490 MPa), and the suitable F-5 value of the substrate in the width direction is from 3 to 30 kg/mm$^2$ (approximately 29.4 to 294 MPa). The F-5 value of the substrate in the length direction is generally greater than that in the width direction, but it goes without saying that such a restriction can be removed when high strength is required in the width direction in particular. The suitable thermal shrinkage ratios of the substrate in the length and width directions under heating at 100° C. for 30 minutes are each at most 3%, preferably at most 1.5%, and those under heating at 80° C. for 30 minutes are each at most 1%, preferably at most 0.5%. The suitable tensile strength of the substrate at break in both directions is from 5 to 100 Kg/mm$^2$ (approximately 49 to 980 MPa), and the suitable elasticity modulus of the substrate is from 100 to 2,000 Kg/mm$^2$ (approximately 0.98 to 19.6 GPa).

The substrate for the thermal transfer sheets may be subjected to a surface activation treatment and/or provided with one or more than one subbing layer for the purpose of improving adhesion to a light-to-heat conversion layer to be provided thereon. As examples of such a surface activation treatment, mention may be made of glow discharge treatment and corona discharge treatment. Materials suitable for the subbing layer are those having high adhesion to both the substrate and the light-to-heat conversion layer, low thermal conductivity and high heat resistance. Examples of such materials include styrene, styrene-butadiene copolymer and gelatin. The total thickness of subbing layers is generally from 0.01 to 2 $\mu$m. On the side opposite to the side where a light-to-heat conversion layer is provided, the thermal transfer sheet can be provided with various functional layers, such as an antireflective layer and an antistatic layer, or subjected to surface treatment, if desired.

(Backing Layer)

The present thermal transfer sheets each can be provided with a backing layer on the side opposite to the side where a light-to-heat conversion layer is provided. It is appropriate that the backing layer be constituted of a first backing layer adjacent to the substrate and a second backing layer provided on the opposite-to-substrate side of the first backing layer. In addition, it is preferable that the ratio of the weight of an antistatic agent contained in the second backing layer (B) to that in the first backing layer (A), namely the B/A ratio, be lower than 0.3. When the ratio is 0.3 or higher, the backing layer surface comes to have tendencies to deteriorate in slipping cability and to come off in powder.

It is appropriate that the thickness of the first backing layer (C) be from 0.01 to 1 $\mu$m, preferably from 0.01 to 0.2 $\mu$m. And the suitable thickness of the second backing layer (D) is also from 0.01 to 1 $\mu$m, preferably from 0.01 to 0.2 $\mu$m. The ratio between these thickness values C:D is from 1:2 to 5:1.

Examples of an antistatic agent which can be used in the first and second backing layers include nonionic surfactants such as polyoxyethylenealkylamines and glycerol fatty acid esters, cationic surfactants such as quaternary ammonium salts, anionic surfactants such as alkyl phosphates, amphoionic surfactants and conductive compounds such as conductive resins.

In addition, conductive fine grains can also be used as antistatic agent. Examples of fine grains usable as antistatic agent include oxides such as ZnO, $TiO_2$, $SnO_2$, $Al_2O_3$, $In_2O_3$, MgO, BaO, CoO, CuO, $Cu_2O$, CaO, SrO, $BaO_2$, PbO, $PbO_2$, $MnO_3$, $MoO_3$, $SiO_2$, $ZrO_2$, $Ag_2O$, $Y_2O_3$, $Bi_2O_3$, $Ti_2O_3$, $Sb_2O_3$, $Sb_2O_5$, $K_2Ti_6O_{13}$, $NaCaP_2O_{18}$ and $MgB_2O_5$, sulfides such as CuS and ZnS, carbides such as SiC, TiC, ZrC, VC, NbC, MoC and WC, nitrides such as $Si_3N_4$, TiN, ZrN, VN, NbN and $Cr_2N$, borides such as $TiB_2$, $ZrB_2$, $NbB_2$, $TaB_2$, CrB, MoB, WB and $LaB_5$, suicides such as $TiSi_2$, $ZrSi_2$, $NbSi_2$, $TaSi_2$, $CrSi_2$, $MoSi_2$ and $WSi_2$, metal salts such as $BaCO_3$, $CaCO_3$, $SrCO_3$, $BaSO_4$ and $CaSO_4$, and complexes such as $SiN_4$-SiC and $9Al_2O_3$-$2B_2O_3$. These compounds may be used alone or as varying combinations of them. Of those compounds, $SnO_2$, ZnO, $Al_2O_3$, $TiO_2$, $In_2O_3$, MgO, BaO and $MoO_3$ are advantageous over the others, and more advantageous antistatic agents are $SnO_2$, ZnO, $In_2O_3$ and $TiO_2$, especially $SnO_2$.

Additionally, in the case of applying the laser thermal transfer recording method to the present thermal transfer material, it is appropriate that the antistatic agent used in the backing layers be transparent in a substantial sense to enable transmission of laser light.

When the conductive metal oxides are used as antistatic agent, it is preferable from the viewpoint of minimizing light scattering that they have smaller grain sizes. And it is required that the grain size of conductive metal oxide be determined using as a parameter the ratio between the refractive index of grain and the refractive index of binder, and can be evaluated by the use of Mie's theory. In general, the suitable average grain size is from 0.001 to 0.5 $\mu$m, preferably from 0.003 to 0.2 $\mu$m. The term "average grain size" as used herein refers to the mean value of sizes of not only primary grains but also grains having higher-order structures.

In addition to an antistatic agent, various additives, such as a surfactant, a slip additive and a matting agent, and binder can be added to the first and second backing layers. The suitable amount of an antistatic agent contained in the first backing layer is from 10 to 1,000 parts by weight, preferably from 200 to 800 parts by weight, per 100 parts by weight of binder. On the other hand, the suitable amount of an antistatic agent contained in the second backing layer is from 0 to 300 parts by weight, preferably from 0 to 100 parts by weight, per 100 parts by weight of binder.

Examples of a binder usable for formation of the first and second backing layer include homo- and copolymers of acrylic acid monomers such as acrylic acid, methacrylic acid, acrylate and methacrylate, cellulose polymers such as nitrocellulose, methyl cellulose, ethyl cellulose and cellulose acetate, vinyl polymers and copolymers of vinyl compounds such as polyethylene, polypropylene, polystyrene, vinyl chloride copolymers including vinyl chloride-vinyl acetate copolymer, polyvinyl pyrrolidone, polyvinyl butyral and polyvinyl alcohol, condensation polymers such as polyester, polyurethane and polyamide, thermoplastic rubber polymers such as butadiene-styrene copolymer, polymers obtained by polymerizing and cross-linking photopolymerizable or thermopolymerizable compounds such as epoxy compounds, and melamine compounds.

(Light-to-Heat Conversion Layer)

The light-to-heat conversion layer contains a light-to-heat conversion substance and a binder. Further, it can contain a matting agent, if needed. Furthermore, it may contain other ingredients, if desired.

The light-to-heat conversion substance is a material having the function of converting the energy of irradiated light to thermal energy. In general, the materials having such a function are dyes (including pigments, and hereinafter the term "dyes" is intended to include pigments also) capable of absorbing laser light. When images are recorded with infrared laser, it is appropriate to use infrared absorbing dyes as the light-to-heat conversion substance. Examples of dyes usable as such a substance include black pigments such as carbon black, pigments of macrocyclic compounds having their absorption in the visible to near infrared regions, such as phthalocyanine and naphthalocyanine, organic dyes used as laser absorbing materials for high-density laser recording such as an optical disk (e.g., cyanine dyes such as indolenine dyes, anthraguinone dyes, azulene dyes, phthalocyanine dyes), and organometallic compound dyes such as dithiol-nickel complex. Of these dyes, cyanine dyes are preferred over the others. This is because they have high absorption constants in the infrared region, thereby enabling a reduction in the thickness of the light-to-heat conversion layer when they are used as a light-to-heat conversion substance; as a result, the recording sensitivity of the thermal transfer sheet can be enhanced.

Besides the dyes as recited above, inorganic materials including particulate metallic substances such as blackened silver can be used as light-to-heat conversion substances.

As a binder contained in the light-to-heat conversion layer, resins having strength enabling at least the formation of a layer on the substrate and high thermal conductivity are suitable. Further, it is desired for those resins to have heat resistance and not to decompose by heat produced from the light-to-heat conversion substance at the time when images are recorded. This is because such resins make it possible to retain the surface smoothness of the light-to-heat conversion layer after irradiation with high-energy light. Specifically, the resins suitable as the binder are resins having thermal decomposition temperature of at least 400° C., preferably 500° C. or above. The term "thermal decomposition temperature" used herein is defined as the temperature at which a 5% reduction in the weight of a resin is caused when the resin undergoes thermogravimetric analysis (TGA method) in a stream of air at a temperature-rise speed of 10° C./min. Further, it is appropriate that the binder have a glass transition temperature of 200 to 400° C., preferably 250 to 350° C. When the glass transition temperature of the binder is lower than 200° C., the images formed tend to suffer fogging; while, when the binder has a glass transition temperature higher than 400° C., the solubility thereof is low, and so the production efficiency is apt to be decreased.

Additionally, it is appropriate that the heat resistance (e.g., thermal deformation temperature, thermal decomposition temperature) of the binder in the light-to-heat converting layer be higher than those of materials used in other layers provided on the light-to-heat conversopm layer.

Examples of a binder usable in the light-to-heat conversion layer include acrylic acid resins such as polymethyl methacrylate, polycarbonate, vinyl resins such as polystyrene, vinyl chloride-vinyl acetate copolymer and polyvinyl alcohol, polyvinyl butyral, polyester, polyvinyl chloride, polyamide, polyimide, polyetherimide, polysulfone, polyether sulfone, aramide, polyurethane, epoxy resin, and urea-melamine resin. Of these resins, polyimide resin is preferred over the others.

In particular, the polyimide resins represented by formulae (I) to (VII) are favorable, because they are soluble in organic solvents and enable improvement in thermal transfer sheet productivity. Further, these polyimide resins are advantageous in that they can ensure improvements in viscosity stability, long-term keeping quality and moisture resistance of the coating composition for the light-to-heat conversion layers.

(I)

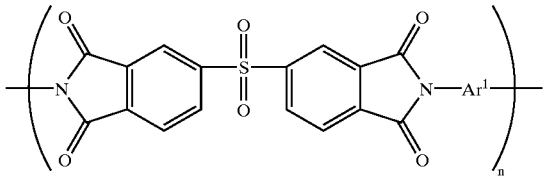

(II)

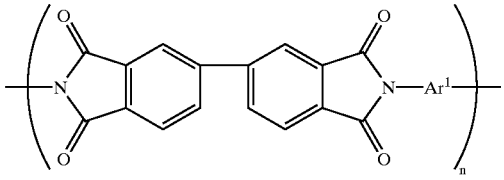

In the above formulae (I) and (II), $Ar^1$ represents an aromatic group of formula (1), (2) or (3) illustrated below, and n represents an integer of 10 to 100.

(1)

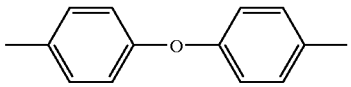

(2)

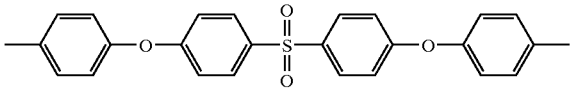

(3)

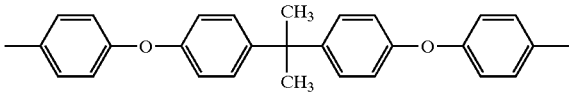

(III)

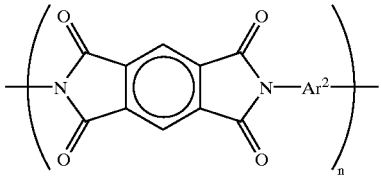

(IV)

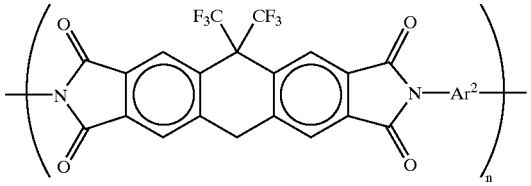

In the above formulae (III) and (IV), $Ar^2$ represents an aromatic group of formula (4), (5), (6) or (7) illustrated below, and n represents an integer of 10 to 100.

(4)

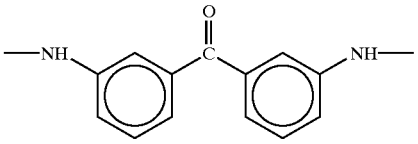

(5)

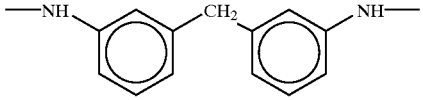

(6)

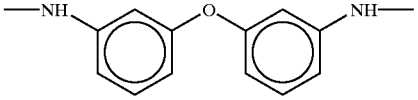

(7)

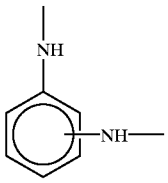

(V)

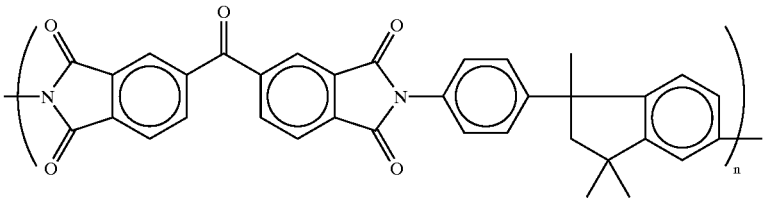

(VI)

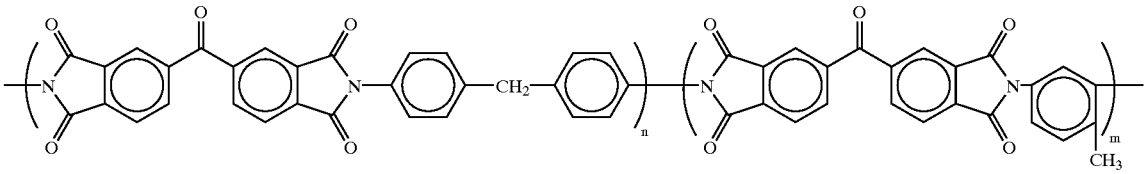

(VII)

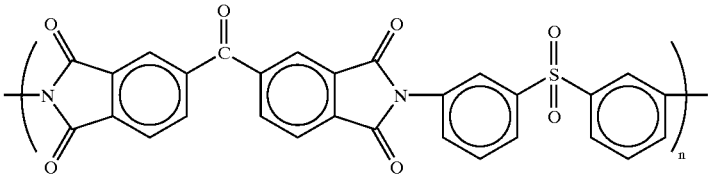

In the above formulae (V) to (VII), n and m each represent an integer of 10 to 100. In the formula (VI), the ratio between n and m is from 6:4 to 9:1.

Additionally, one measure of judgement as to the solubility of a resin in an organic solvent is whether or not at least 10 parts by weight of the resin dissolves in 100 parts by weight of N-methylpyrrolidone at 25° C. If the proportion of a resin dissolved is at least 10 parts by weight, the resin is suitable as binder for the light-to-heat conversion layer. The resins more suitable as the binder are those dissolving in proportions of no lower than 100 parts by weight in 100 parts by weight of N-methylpyrrolidone.

As a matting agent contained in the light-to-heat conversion layer, inorganic fine particles and organic fine particles can be used. Examples of inorganic fine particles usable as the matting agent include metal salts such as silica, titanium dioxide, aluminum oxide, zinc oxide, magnesium oxide, barium sulfate, magnesium sulfate, aluminum hydroxide, magnesium hydroxide and boron nitride, kaolin, clay, talc, zinc white, white lead, sieglite, quartz, diatomaceous earth, barite, bentonite, mica and synthetic mica. Examples of organic fine particles usable as the matting agent include resin particles, such as fluorine-contained resin particles, guanamine resin particles, acrylic resin particles, styrene-acrylic copolymer resin particles, silicone resin particles, melamine resin particles and epoxy resin particles.

The particle size of a matting agent is generally from 0.3 to 30 $\mu$m, preferably from 0.5 to 20 $\mu$m, and the suitable amount of matting agent added is from 0.1 to 100 mg/m$^2$.

To the light-to-heat conversion layer, a surfactant, a thickening agent and an antistatic agent may further be added, if desired.

The light-to-heat conversion layer can be provided by coating on a substrate a coating composition prepared by dissolving a light-to-heat conversion substance and a binder in an appropriate solvent, and further adding thereto a matting agent and other additives, if needed, and then drying the coating composition. Examples of an organic solvent usable for dissolution of polyimide resin include n-hexane, cyclohexane, diglime, xylene, toluene, ethyl acetate, tetrahydrofuran, methyl ethyl ketone, acetone, cyclohexanone, 1,4-dioxane, 1,3-dioxane, dimethyl acetate, N-methyl-2-pyrollidone, dimethyl sulfoxide, dimethylformamide, dimethylacetamide, γ-butyrolactone, ethanol and methanol. The coating and drying of the coating composition can be carried out in usual manners. Specifically, the drying is carried out at a temperature of 300° C. or below, preferably 200° C. or below. When polyethylene terephthalate is used as the substrate, the drying temperature is preferably front 80 to 150° C.

When the proportion of the binder in the light-to-heat conversion layer is too low, the light-to-heat conversion layer has low cohesive strength; as a result, when the images formed thereon are transferred to an image-receiving layer, the light-to-heat conversion layer tends to be transferred together with the images to cause color mixing in the transferred images. When the proportion of polyimide resin is too high, an increase in thickness is required for the light-to-heat conversion layer to attain the desired level of absorptivity. As a result, reduction in sensitivity is apt to be caused. The suitable ratio between the weights of the light-to-heat conversopm substance and the binder on a solid basis is from 1:20 to 2:1, particularly preferably from 1:10 to 2:1.

It is advantageous to reduce a thickness of the light-to-heat conversion layer because, as mentioned above, the sensitivity of the thermal transfer sheet can be enhanced. The suitable thickness of the light-to-heat converting layer is from 0.03 to 1.0 $\mu$m, preferably from 0.05 to 0.5 $\mu$m. In addition, it is preferable that the light-to-heat conversion layer have an optical density of 0.8 to 1.26 when the light of a wavelength of 808 nm is incident thereon, because the transfer sensitivity of the image-forming layer can be enhanced as far as the light-to-heat conversion layer has such an optical density. Further, it is advantageous for the light-to-heat conversion layer to have an optical density of 0.92 to 1.15 at the wavelength of 808 nm. When the optical density at the peak wavelength of laser is lower than 0.8, conversion of the irradiated light to heat becomes insufficient, so the transfer sensitivity tends to be lowered. On the other hand, the optical densities higher than 1.26 have an influence on functions of the light-to-heat conversion layer at the time when recording is performed. So fogging is apt to occur in such a case.

(Image-forming Layer)

The image-forming layer contains at least pigments to be transferred to an image-receiving sheet to form images, and further a binder for layer formation, and other ingredients as required.

The pigments are broadly divided into organic pigments and inorganic pigments. The former can ensure high transparency in the coating, while the latter can produce excellent masking effect. So the pigments may be selected properly depending on the intended purpose. When the thermal transfer sheets are used for color proof in graphic arts, organic pigments having yellow, magenta, cyan and black hues or hues close thereto, which are generally used for printing ink, are used to advantage. In some cases, metal powders and fluorescent pigments can be used, too. Suitable examples of organic pigments include azo pigments, phthalocyanine pigments, anthraquinone pigments, dioxazine pigments, quinacridone pigments, isoindolinone pigments and nitro pigments. More specifically, examples of pigments usable in the image-forming layer are recited below on a hue-by-hue basis. However, these examples should not be construed as limiting the pigments usable in the invention.

1) Yellow Pigments

Pigment Yellow 12 (C.I. No. 21090), with examples including Permanent Yellow DHG (produced by Clariant Japan Co. Ltd.), Lionol Yellow 1212B (produced by Toyo Ink Mfg. Co., Ltd.), Irgalite Yellow LCT (produced by Ciba Specialty Chemical Co., Ltd.) and Symuler Fast Yellow GTF 219 (produced by Dai-Nippon Ink & Chemicals, Inc.).

Pigment Yellow 13 (C.I. No. 21100), with examples including Permanent Yellow GR (produced by Clariant Japan Co. Ltd.) and Lionol Yellow 1313 (produced by Toyo Ink Mfg. Co., Ltd.).

Pigment Yellow 14 (C.I. No. 21095), with examples including Permanent Yellow G (produced by Clariant Japan Co. Ltd.), Lionol Yellow 1401-G (produced by Toyo Ink Mfg. Co., Ltd.), Seika Fast Yellow 2270 (produced by Dainichiseika C. & C. Mfg. Co., Ltd.) and Symuler Fast Yellow 4400 (produced by Dai-Nippon Ink & Chemicals, Inc.).

Pigment Yellow 17 (C.I. No. 21105), with examples including Permanent Yellow GG02 (produced by Clariant Japan Co. Ltd.) and Symuler Fast Yellow 8GF (produced by Dai-Nippon Ink & Chemicals, Inc.).

Pigment Yellow 155, such as Graphtol Yellow 3GP (produced by Clariant Japan Co. Ltd.)

Pigment Yellow 180 (C.T. No. 21290), with examples including Novoperm Yellow P-HG (produced by Clariant Japan Co. Ltd.) and PV Fast Yellow HG (produced by Clariant Japan Co. Ltd.).

Pigment Yellow 139 (C.I. No. 56298), such as Novoperm Yellow M2R 70 (produced by Clariant Japan Co. Ltd.).

2) Magenta Pigments

Pigment Red 57:1 (C.I. No. 15850:1), with examples including Graphtol Rubine L6B (produced by Clariant Japan Co. Ltd.), Lionol Red 6B-4290G (produced by Toyo Ink Mfg. Co., Ltd.), Irgalite Rubine 4BL (produced by Ciba Specialty Chemical Co., Ltd.) and Symuler Brilliant Carmine 6B-229 (produced by Dai-Nippon Ink & Chemicals, Inc.).

Pigment Red 122 (C.I. No. 73915), with examples including Hosterperm Pink E (produced by clariant Japan Co. Ltd.), Lionogen Magenta 5790 (produced by Toyo Ink Mfg. Co., Ltd.) and Fastogen Super Magenta RH (produced by Dai-Nippon Ink & Chemicals, Inc.).

Pigment Red 53:1 (C.I. No. 15585:1), with examples including Permanent Lake Red LCY (produced by Clariant Japan Co. Ltd.) and Symuler Lake Red C conc (produced by Dai-Nippon Ink & Chemicals, Inc.).

Pigment Red 48:1 (C.I. No. 15865:1), with examples including Lionol Red 2B 3300 (produced by Toyo Ink Mfg. Co., Ltd.) and Symuler Red NRY (produced by Dai-Nippon Ink & Chemicals, (Inc.).

Pigment Red 48:2 (C.I. No. 15865:2), with examples including Permanent Red W2T (produced by Clariant Japan Co. Ltd.), Lionol Red LX235 (produced by Toyo Ink Mfg. Co., Ltd.) and Symuler Red 3012 (produced by Dai-Nippon Ink & Chemicals, Inc.).

Pigment Red 48:3 (C.I. No. 15865:3), with examples including Permanent Red 3RL (produced by Clariant Japan Co. Ltd.) and Symuler Red 2BS (produced by Dai-Nippon Ink & Chemicals, Inc.).

Pigment Red 177 (C.I. No. 65300), such as Cromophthal Red A2B (produced by Ciba Specialty Chemicals Co., Ltd.),

[0080]

3) Cyan Pigments

Pigment Blue 15 (C.I. No. 74160), with examples including Lionol Blue 7027 (produced by Toyo Ink Mfg. Co., Ltd.) and Fastogen Blue BB (produced by Dai-Nippon Ink &Chemicals, Inc.).

Pigment Blue 15:1 (C.I. No. 74160), with examples including Hosterperm Blue A2R (produced by Clariant Japan Co. Ltd.) and Fastogen Blue 5050 (produced by Dai-Nippon Ink & Chemicals, Inc.).

Pigment Blue 15:2 (C.I. No. 74160), with examples including Hosterperm Blue AFL (produced by Clariant Japan Co. Ltd.), Irgalite Blue BSP (produced by Ciba Specialty Chemicals Co., Ltd.) and Fastogen Blue GP (produced by Dai-Nippon Ink & Chemicals, Inc.).

Pigment Blue 15:3 (C.I. No. 74160), with examples including Hosterperm Blue B2G (produced by Clariant Japan Co. Ltd.), Lionol Blue FG7330 (produced by Toyo Ink Mfg. Co., Ltd.), Cromophthal Blue 4GNP (produced by Ciba Specialty Chemicals Co., Ltd.) and Fastogen Blue FGF (produced by Dai-Nippon Ink & Chemicals, Inc.).

Pigment Blue 15:4 (C.I. No. 74160), with examples including Hosterperm Blue BFL (produced by Clariant Japan Co. Ltd.), Cyanine Blue 700-10FG (produced by Toyo Ink Mfg. Co., Ltd.), Irgalite Blue GLNF (produced by Ciba Specialty Chemicals Co., Ltd.) and Fastogen Blue FGS (produced by Dai-Nippon Ink & Chemicals, Inc.).

Pigment Blue 15:6 (C.I. No. 74160), such as Lionol Blue ES (produced by Toyo Ink Mfg. Co., Ltd.).

Pigment Blue 60 (C.I. No. 69800), with examples including Hosterperm Blue RL01 (produced by Clariant Japan Co. Ltd.) and Lionogen Blue 6501 (produced by Toyo Ink Mfg. Co., Ltd.).

4) Black Pigments

Pigment Black 7 (carbon black C.I. No. 77266), with examples including Mitsubishi Carbon Black MA100 (produced by Mitsubishi Chemical Corporation), Mitsubishi Carbon Black #5 (produced by Mitsubishi Chemical Corporation) and Black Pearls 430 (produced by Cabot Co.).

Further, the pigments used in the invention can be selected appropriately from commercially available pigments by reference to books, e.g., *Ganryo Binran* (which means "Handbook of Pigments", translated into English), compiled by Nippon Ganryo Gijutu Kyokai, published by Seibundo Shinkosha in 1989, and *Colour Index*, The Society of Dyes & Colourist, 3rd Ed., 1987.

It is appropriate that the pigments as recited above have an average particle size of 0.03 to 1 $\mu$m, preferably 0.05 to 0.5 $\mu$m.

When the average particle size is 0.03 $\mu$m or greater, neither increase in dispersing cost nor gelling of dispersion occurs. When the average particle size is controlled to 1 $\mu$m or below, on the other hand, coarse particles are not present in the pigments, and so a good contact is assured between the image-forming layer and the image-receiving layer, and transparency of the image-forming layer can be improved.

Binders suitable for the image-forming layer are amorphous organic high polymers having softening points in the range of 40 to 150° C. Examples of such amorphous organic high polymers include butyral resin, polyamide resin, polyethyleneimine resin, sulfonamide resin, polyesterpolyol resin, petroleum resin, homo- or copolymers of monomers selected from styrene, styrene derivatives or substituted styrenes (such as styrene (vinyltoluene, $\alpha$-methylstyrene; 2-methylstyrene, chloro-styrene, vinylbenzoic acid, sodium vinyl benzene sulfonate and amino styrene), homopolymers of vinyl monomers (with examples including methacrylates such as methyl methacrylate, ethyl methacrylate, butyl methacrylate and hydroxyethyl methacrylate, acrylates such as methyl acrylate, ethyl acrylate, butyl acrylate and $\alpha$-ethylhexyl acrylate, dienes such as butadiene and isoprene, acrylonitrile, vinyl ethers, maleic acid and maleates, maleic anhydride, succinic acid, vinyl chloride and vinyl acetate) and copolymers of vinyl monomers as recited above and other monomers. These resins may be used alone or as mixtures of two or more thereof.

The suitable proportion of pigments in the image-forming layer is from 30 to 70% by weight, preferably 30 to 50% by weight. And the suitable proportion of resins in the image-forming layer is from 70 to 30% by weight, preferably from 70 to 40% by weight.

The image-forming layer can contain substances classified under the following three groups (1) to (3) as the other ingredients.

(1) Various kinds of Wax

Wax includes mineral wax, natural wax and synthetic wax. As examples of mineral wax, mention may be made of petroleum wax, such as paraffin wax, microcrystalline wax, ester wax and oxidized wax, montan wax, ozokerite, and ceresin. Among them, paraffin wax is preferred in particular. The paraffin wax is isolated from petroleum, and products having various melting points are on the market.

Examples of natural wax include vegetable wax, such as carnauba wax, Japan tallow, auricurie wax and espal wax, and animal wax such as beeswax, insect wax, shellac wax and whale wax.

Synthetic wax is generally used as slip additive, and includes higher fatty acid compounds. As examples of such higher fatty acid compounds, mention may be made the following compounds.

(i) Fatty Acid Wax

Linear saturated fatty acids represented by the following formula:

$$CH_3(CH_2)_nCOOH$$

wherein n is an integer of 6 to 28. Examples thereof include stearic acid, behenic acid, palmitic acid, 12-hydroxystearic acid and azelaic acid.

Further, such fatty acids may take the form of metal salts (e.g., K, Ca, Zn and Mg salts).

(ii) Fatty Acid Ester Wax

Examples of fatty acid esters include ethyl stearate, lauryl stearate, ethyl behenate, hexyl behenate and behenyl myristate.

(iii) Fatty Acid Amide Wax

Examples of fatty acid amides include stearic acid amide and lauric acid amide.

(iv) Aliphatic Alcohol Wax

Linear saturated aliphatic alcohol compounds represented by the following formula:

$$CH_3(CH_2)_nOH$$

wherein n is an integer of 6 to 28. As a n example of such alcohol, mention may be made of stearyl alcohol.

Of the foregoing kinds of synthetic wax (i) to (iv), higher fatty acid amides, such as stearic acid amide and lauric acid amide, are preferred over the others. The wax compounds as recited above can be used alone or as appropriate combinations.

(2) Plasticizers

Plasticizers suitable for the image-forming layer are ester compounds known as plasticizers, with examples including aliphatic dibasic acid esters, such as phthalates (e.g., dibatyl phthalate, di-n-octyl phthalate, di(2-ethylhexyl) phthalate, dinonyl phthalate, dilauryl phthalate, butyl lauryl phthalate, butyl benzyl phthalate), di(2-ethylhexyl) adipate and di(2-ethylhexyl) cebacate, phosphoric acid triesters such as tricresyl phosphate and tri(2-ethylhexyl) phosphate, polyolpolyesters such as polyethylene glycol esters, and epoxy compounds such as epoxy fatty acid esters. Of these ester compounds, esters of vinyl monomers, especially esters of acrylic and methacrylic acids, are preferred over the others from the viewpoints of improvement in transfer sensitivity, reduction in non-uniform transfer and extent to which they can influence the control of elongation at break.

As examples of ester compounds of acrylic or methacrylic acid, mention may be made of polyethylene glycol dimethacrylate, 1,2,4-butanetriol trimethacrylate, trimethylolethane triacrylate, pentaerythritol acrylate, pentaerythritol tetraacrylate and dipentaerythritol polyacrylate.

The plasticizers used herein may be polymers, too. In particular, polyesters are preferred because of their great addition effect and resistance to diffusion under storage conditions. As examples of polyesters usable herein, mention may be made of polyesters of sebacate type and polyesters of adipate type.

Additionally, additives which may be added to the image-forming layer should not be construed as being limited to the additives as recited above. Further, the plasticizers recited above may be used alone or as mixtures thereof.

When the amount of the foregoing additives contained in the image-forming layer is too large, it tends to occur that the resolution of transferred images is lowered, the film strength of the image-forming layer itself is decreased and the unexposed areas of the image-forming layer is transferred to the image-receiving sheet because of reduction in adhesion of the image-forming layer to the light-to-heat conversion layer. From these viewpoints, it is appropriate that the amount of wax contained be from 0.1 to 30%, preferably from 1 to 20%, of the weight of the total solids in the image-forming layer and the amount of plasticizers contained be from 0.1 to 20%, preferably from 0.1 to 10%, of the weight of the total solids in the image-forming layer.

(3) Others

In addition to the ingredients as recited above, the image-forming layer may further contain a surfactant, inorganic or organic fine particles (e.g., metal powders, silica gel), oils (e.g., linseed oil, mineral oil), a thickener and an anti-static agent. By containing substances capable of absorbing light of the same wavelengths as the light source used for image recording has, energy required for transfer can be reduced, except the case of forming black images. As substances capable of absorbing light of the wavelengths corresponding to those of the light source used, both pigments and dyes may be used. In the case of forming color images, the use of an infrared light source, such as semiconductor laser, for image recording and dyes showing no absorption in the visible region but strong absorption at the wavelengths of the light source used is advantageous from the viewpoint of color reproduction. As examples of near infrared dyes, mention may be made of the compounds described in Japanese Patent Laid-Open No. 103476/1991.

The image-forming layer can be provided by coating a coating composition, which is prepared by dissolving or dispersing pigments, binder and other additives as recited above, on the light-to-heat conversion layer (or a heat-sensitive delaminating layer as described below, if provided on the light-to-heat conversion layer), and then drying the composition coated. Examples of a solvent usable for preparing the coating composition include n-propyl alcohol, methyl ethyl ketone, propylene glycol monomethyl ether (MFG), methanol and water. The coating and drying of the coating composition can be effected in usual ways.

On the light-to-heat conversion layer of the thermal transfer sheet, it is possible to provide a heat-sensitive delamination layer containing a heat-sensitive material capable of liberating a gas or releasing attached water by the action of heat produced in the light-to-heat conversion layer and thereby weakening the bonding strength between the light-to-heat conversion layer and the image-forming layer. Examples of such a heat-sensitive material include compounds capable of decomposing or changing their properties upon heating to liberate gasses (which may be either polymeric or low molecular weight compounds), and compounds absorbing or adsorbing a considerable amount of easily vaporized liquid such as water (which may be either polymeric or low molecular weight compounds). These compounds may be used as mixtures thereof.

As examples of polymers capable of liberating gasses through decomposition or change in their properties when they are heated, mention may be made of self-oxidative polymers such as nitrocellulose, halogen-containing polymers such as chlorinated polyolefin, chlorinated rubber, rubber polychloride, polyvinyl chloride and polyvinylidene chloride, acrylic polymers such as polyisobutyl methacrylate to which a volatile compound like water is adsorbed, cellulose esters such as ethyl cellulose to which a volatile compound like water is adsorbed, and natural high molecular compounds such as gelatin to which a volatile compound like water is adsorbed. As examples of low molecular weight compounds capable of liberating gasses through decomposition or change in their properties when they are heated, mention may be made of compounds capable of producing gasses by exothermic decomposition, such as diazo compounds and azide compounds.

Of the heat-sensitive materials as recited above, the compounds causing thermal decomposition or thermal change in properties at a temperature of 280° C. or below, particularly 230° C. or below, are used to advantage.

When low molecular weight compounds are used as heat-sensitive materials in the heat-sensitive delamination layer, it is appropriate to use them in combination with binders. As these binders, the polymers which themselves undergo thermal decomposition or cause thermal change in their properties to evolve gasses can be used. However, ordinary binders free of the foregoing features may also be used. In the combined use of a heat-sensitive low molecular weight compound and a binder, it is appropriate that the ratio of the former to the latter be from 0.02:1 to 3:1, preferably from 0.05:1 to 2:1, by weight. It is desirable that the heat-sensitive delamination layer be spread on almost all the surface of the light-to-heat convertion layer and the thickness thereof be generally from 0.03 to 1 $\mu$m, preferably from 0.05 to 0.5 $\mu$m.

In the case of a thermal transfer sheet having a structure that the substrate is provided sequentially with a light-to-heat conversion layer, a heat-sensitive delamination layer and an image-forming layer, the heat-sensitive delamination layer decomposes or changes its property to evolve gas by the heat transferred from the light-to-heat conversion layer. By the decomposition or the evolution of gas, the heat-sensitive delamination layer disappears in part, or aggregative destruction occurs in the heat-sensitive delamination layer to lower the binding force between the light-to-heat conversion layer and the image-forming layer. Depending on the behavior of the heat-sensitive delamination layer, therefore, partial adhesion of the heat-sensitive delamination layer to the image-forming layer may occur and manifest itself on the surface of finally formed images to make color stain on the images. For this reason, it is desirable for the heat-sensitive delamination layer to be almost colorless, or high in visible light transmittance, so that no visible color stain is made on the finally formed images even when partial transfer of the heat-sensitive delamination layer occurs. Specifically, it is appropriate that the heat-sensitive delamination layer have absorptivity of at most 50%, preferably at most 10%, with respect to visible light.

Additionally, it is possible to design the light-to-heat conversion layer so as to function as a heat-sensitive delamination layer also instead of forming an independent heat-sensitive delamination layer in the thermal transfer sheet. In this case, the heat-sensitive material as recited above is added to a coating composition for the light-to-heat conversion layer.

It is advantageous that the static friction coefficient of the outermost layer of the thermal transfer sheet on the image-forming layer provided side is adjusted to 0.8 or less more preferably 0.35 or less, still more preferably 0.20 or less. By controlling the static friction coefficient of the outermost layer to 0.35 or below, roll stains ascribable to conveyance of the thermal transfer sheet can be reduced, and thereby the images formed can have high quality. The static friction coefficient can be determined using the method described in Japanese Patent Application No. 2000-85759, paragraph [0011].

Further, it is appropriate that the image-forming layer surface have a Smooster value [means a value measured by apparatus called Smooster: Digital Smooster DSM-2 Type manufactured by TOKYO ELECTRONIC INDUSTRY CO., LTD.] of 0.5 to 50 mmHg, (approximately 0.0665 to 6.65 kPa), more preferably 2.2 to 50 mmHg, under a condition of 23° C.–55% RH and the Ra thereof be from 0.05 to 0.4 μm. Such surface smoothness enables reduction in number of micro-gaps present at the contact face between the image-receiving layer and the image-forming layer, so it is beneficial to not only transfer capability but also image quality. The Ra value can be measured with a surface roughness tester (Surf con, made by Tokyo Seiki K.K.) based on JIS B0601. It is also appropriate that the surface hardness of the image-forming layer be at least 10 g as measured with a sapphire stylus. Further, it is appropriate that the image-forming layer have an electric potential of −100 to 100 V at the time when 1 second has elapsed since the thermal transfer sheet was grounded after electrification according to The U.S. Federal Government Testing Standards 4046. The suitable surface resistance of the image-forming layer is at most $10^9$ Ω under a condition of 23° C.–55% RH.

Next an image-receiving sheet used in combination with the thermal transfer sheet is illustrated.

[Image-receiving Sheet]

(Layer structure)

The image-receiving sheet has a layer structure that at least one image-receiving layer is provided on a support, and further at least one layer selected from a cushion layer, a release layer or an interlayer may be provided between the support and the image-receiving layer, if desired. In addition, it is advantageous in point of conveyance that the support of the image-receiving sheet has a backing layer on the side opposite to the image-receiving layer.

(Support)

A support usable herein is a conventional substrate of sheet form, including a plastic sheet, a metal sheet, a glass sheet, a resin-coated paper, paper and various complexes. As examples of a plastic sheet, mention may be made of a polyethylene terephthalate sheet, a polycarbonate sheet, a polyethylene sheet, a polyvinyl chloride sheet, a polyvinylidene chloride sheet, a polystyrene sheet, a styrene-acrylonitrile copolymer sheet, and a polyester sheet. As examples of paper, mention may be made of printing paper and coated paper.

It is advantageous to have fine pores (voids) in a support, because image quality can be improved thereby. Such a support can be formed by preparing a mixed melt made up of a thermoplastic resin and a filler, such as an inorganic pigment or a polymer particles incompatible with the thermoplastic resin, forming the mixed melt into a single-layer or multiple-layer film by means of a melt extruder, and further subjecting the film to monoaxial or biaxial stretching. In this case, the porosity of the support is determined depending on what resin and filler are selected, proportions in which they are mixed, and conditions under which the film is stretched.

As the thermoplastic resin, polyolefin resins such as polypropylene, and polyethylene terephthalate resin are preferred because of their good crystallinity, high stretching capability and easy formation of voids. Further, it is advantageous to combine a polyolefin resin or polyethylene terephthalate resin as a major component with a small amount of other thermoplastic resins chosen as appropriate. As an inorganic pigment used as the filler, pigments having an average particle size of 1 to 20 μm are preferred. Specifically, calcium carbonate, clay, diatomaceous earth, titanium dioxide, aluminum hydroxide and silica can be used. As to the incompatible resin used for filler, it is preferable to use polyethylene terephthalate as the filler in the case of using polypropylene as the thermoplastic resin. For details of the supports having fine voids the description in Japanese Patent Application No. 290570/1999 can be referred to.

Additionally, the proportion of the filler added, such as inorganic pigments, is generally from 2 to 30% by volume.

The thickness of a support constituting the image-receiving sheet is generally from 10 to 400 μm, preferably from 25 to 200 μm. For the purpose of bringing the support surface into a close contact with the image-receiving layer (or a cushion layer) or the image-forming layer of the thermal transfer sheet, the support may undergo surface treatment such as corona discharge treatment or glow discharge treatment.

(Image-receiving Layer)

It is desirable for the image-receiving sheet to have at least one image-receiving layer on the support in order to fix the image-forming layer transferred to the surface thereof. The image-receiving layer is preferably a layer constituted mainly of an organic polymer binder. Polymers suitable as such a binder are thermoplastic resins. Examples of such thermoplastic resins include homo- and copolymers of acrylic monomers such as acrylic acid, methacrylic acid, acrylate and methacrylate; cellulose polymers, such as methyl cellulose, ethyl cellulose and cellulose acetate; homo- and copolymers of vinyl monomers, such as polystyrene, polyvinyl pyrrolidone, polyvinyl butyral, polyvinyl alcohol and polyvinyl chloride; condensation polymers, such as polyester and polyamide; and rubber polymers, such as butadiene-styrene copolymer. The binder of the image-receiving layer is preferably a polymer having a glass transition temperature (Tg) lower than 90° C. in order to ensure proper adhesion to the image-forming layer. For this purposes it is possible to add a plasticizer to the image-receiving layer. In order to prevent blocking between sheets, on the other hand, it is appropriate for the binder polymer to have a glass transition temperature of no lower than 30° C. For the purpose of enhancing the contact of the image-receiving layer with the image-forming layer at the time of laser recording and achieving improved sensitivity and image strength, it is advantageous in particular to use the same binder polymer as used in the image-forming layer or a similar polymer thereto as the polymer of the image-receiving layer.

It is advantageous that the image-receiving layer surface has a Smooster value of 0.5 to 50 mmHg (approximately 0.0665 to 6.65 kPa) under a condition of 23° C.–55% RH and the Ra thereof is preferably 0.5 μm more or less, preferably from 0.05 to 0.4 μm. Such surface smoothness enables reduction in number of micro-gaps present at the contact face between the image-receiving layer and the image-forming layer, so it is beneficial to not only transfer capability but also image quality. The Ra value can be measured with a surface roughness tester (Surfcom, made by Tokyo Seiki K.K.) based on JISB0601. Further, it is appropriate that the image-receiving layer have an electric potential of −100 to 100 V at the time when 1 second has elapsed since the image-receiving sheet was grounded after electrification according to The U.S. Federal Government Testing Standards 4046. The suitable surface resistance of the image-receiving layer is at most $10^9$ Ω under a condition of 23° C.–55% RH. It is advantageous that the static friction coefficient of the image-receiving layer surface is 0.7 or less and the surface energy thereof is from 23 to 35 mg/m$^2$.

In the case where images once formed on the image-receiving layers are re-transferred to printing paper, it is also advantageous that at least one of the image-receiving layers is formed from a light-curable material. As an example of such a light-curable material, mention may be made of a composition comprising (a) at least one photopolymerizing monomer selected from polyfunctional vinyl or vinylidene compounds capable of forming photopolymers by addition polymerization, (b) an organic polymer, (c) a photopolymerization initiator and, if desired, additives including a thermopolymerization inhibitor. Examples of a polyfunctional vinyl monomer usable therein include unsaturated esters of polyols, especially esters of acrylic or methacrylic acid (e.g., ethylene glycol diacrylate, pentaerythritol tetraacrylate).

As examples of an organic polymer (b), mention may be made of the polymers recited above as a binder for forming the image-receiving layer. As to the photopolymerization initiator (c), a general radical photopolymerization initiator, such as benzophenone or Michler's ketone, is used in a proportion of 0.1 to 20 weight % to the layer.

The thickness of the image-receiving layer is from 0.3 to 7 μm, preferably from 0.7 to 4 μm. When the thickness is not thinner than 0.3 μm, the, image-receiving layer can attain film strength required for re-transfer to printing paper. By adjusting the thickness to 4 μm or below, the images after re-transfer to printing paper can have reduced gloss, and thereby the resemblance to prints is improved.

(Other Layers)

Between the support and the image-receiving layer, a cushion layer may be provided. When the cushion layer is provided, the degree of contact of the image-forming layer with the image-receiving layer at the time of laser thermal transfer can be heightened to result in improvement of image quality. In addition, even when an extraneous matter is trapped between the thermal transfer sheet and the image-receiving sheet, the gap between these sheets can be lessened by a deforming action of the cushion layer, as a result, the sizes of image defects, such as clear, can be reduced. Further, when the images formed by transfer are re-transferred to printing paper prepared separately, the cushion layer enables the image-receiving surface to be deformed depending on asperities on the printing paper surface and improves the transferability to the image-receiving layer. Furthermore, the cushion layer can lower the gloss of the re-transferred images and improve the resemblance to prints.

The cushion layer is constituted so as to permit easy deformation when a stress is applied to the image-receiving layer. In order to achieve the foregoing effect, it is appropriate that the cushion layer be made up of a material having a low elasticity modulus, a material having rubber-like elasticity or a thermoplastic resin capable of softening with ease by heating. The suitable elasticity modulus of the cushion layer at room temperature is from 0.5 MPa to 1.0 GPa, preferably from 1 MPa to 0.5 GPa, particularly preferably from 10 MPa to 100 MPa. For sinking an extraneous matter, such as dust, into the cushion layer, it is appropriate that the consistency of the cushion layer be at least 10 when determined under the condition of 25° C., 100 g and 5 seconds in accordance with JIS K2530. The suitable glass transition temperature of the cushion layer is 80° C. or below, preferably 25° C. or below, and the suitable softening point of the cushion layer is from 50 to 200° C. Adjustment of these physical properties, e.g., Tg can be effectively attained by adding a plasticizer to a binder.

Examples of a material usable as binder of the cushion layer include rubbers such as urethane rubber, butadiene rubber, nitrile rubber, acrylic rubber and natural rubber, polyethylene, polypropylene, polyester, styrene-butadiene copolymer, ethylene-vinyl acetate copolymer, ethylene-acrylic copolymer, vinyl chloride-vinyl acetate copolymer, vinylidene chloride resin, plasticizer-impregnated vinyl chloride resin, polyamide resin and phenol resin.

Additionally, the suitable thickness of the cushion layer, though it varies depending on the resin used and other conditions, is generally from 3 to 100 μm, preferably from 10 to 52 μm.

Although it is required for the image-receiving layer and the cushion layer to be bonded to each other up to the stage of laser recording, these layers are preferably provided so as to allow delamination at the time when images are transferred to printing paper. In order to make the delamination easy, it is appropriate that a release layer having a thickness of the order of 0.1–2 μm be provided between the cushion layer and the image-receiving layer. When the release layer is too thick, the cushion layer becomes difficult to exert its effect. So it is required to control the thickness of the release layer by properly selecting a material used therein.

Examples of binder usable for the release layer include thermosetting resins having Tg of 65° C. or higher, such as polyolefin, polyester, polyvinyl acetal, polyvinyl formal, polyparabanic acid, polymethacrylic acid, polycarbonate, ethyl cellulose, nitrocellulose, methyl cellulose, carboxymethyl cellulose, hydroxypropyl cellulose, polyvinyl alcohol, polyvinyl chloride, urethane resin, fluorine-contained resin, styrene polymers such as polystyrene and acrylonitrile-styrene copolymer and cross-linking products of these resins, polyamide, polyimide, polyetherimide, polysulfone, polyether sulfone and aramide, and cured matters of the resins as recited above. As examples of a curing agent usable therein, mention may be made of general curing agents, such as isocyanate and melamine.

When the binder for the release layer is selected so as to suit for the foregoing physical properties, polycarbonate, acetals and ethyl cellulose are preferred from the viewpoint of keeping quality. In addition to selection of such resins, the use of acrylic resin for the image-receiving layer is advantageous in particular. This is because the use of those resins in combination can ensure satisfactory delamination upon re-transfer of images after laser thermal transfer.

In another way, it is possible to use as the release layer a layer capable of extremely lowering its adhesion to the image-receiving layer when it undergoes cooling. Specifically, such a layer contains as a main component a heat-fusible compound, such as wax or binder, or a thermoplastic resin.

As examples of a heat-fusible compound, mention may be made of the materials as disclosed in Japanese Patent Laid-Open No. 103886/1988. In particular, microcrystalline wax, paraffin wax and carnauba wax are used to advantage. As to the thermoplastic resin, ethylene copolymers such as ethylene-vinyl acetate copolymer, and cellulose resins are preferably used.

To such a release layer, a higher fatty acid, a higher alcohol, a higher fatty acid ester, an amide and a higher amine can be added as additives, if needed.

In still another-way, the release layer can be designed so that the layer itself causes aggregative destruction through fusion or softening upon heating and thereby gets releasability. In such a release layer, it is appropriate to incorporate a supercooling substance.

Examples of such a supercooling substance include poly-ε-caprolactone, polyoxyethylene, benzotriazole, tribenzylamine and vanillin.

Further, the release layer can be designed differently from the above. Specifically, the release layer can contain a compound capable of lowering its adhesion to the image-receiving layer. Examples of such a compound include silicone polymers such as silicone oil; fluorine-contained resins such as Teflon and fluorine-contained acrylic resins; polysiloxane resins; acetal resins such as polyvinyl butyral, polyvinyl acetal and polyvinyl formal; solid wax such as polyethylene wax or amide wax; and surfactants of fluorine-containing type and phosphate type.

Such a release layer can be formed on a cushion layer by applying a solution or latex of substances as recited above in accordance with a coating method using a blade coater, a roll coater, a bar coater, a curtain coater or a gravure coater, or a lamination method using hot melt extrusion. Also, it can be formed in the other way. Specifically, a solution or latex of substances as recited above is coated on a temporary base in accordance with the method as recited above, the coating formed is applied to the cushion layer, and then the temporary base is peeled away.

The image-receiving sheet to be combined with the thermal transfer sheet may have a structure that the image-receiving layer can function as a cushion layer also. In this case, the image-receiving sheet may have a combination of a support and an image-receiving cushion layer or a combination of a support, a subbing layer and an image-receiving cushion layer. Herein also, it is preferable to provide the image-receiving cushion layer so as to permit delamination from the viewpoint of re-transfer to printing paper. And the images re-transferred to printing paper come to have high glossiness.

Additionally, the suitable thickness of image-receiving cushion layer is from 5 to 100 μm, preferably from 10 to 40 μm.

From the viewpoint of improvement in travelling properties of the image-receiving sheet, it is advantageous that the image-receiving sheet has a backing layer on the back of its support, which is opposite to the side of the image-receiving layer. The addition of an antistatic agent, such as a surfactant or particulate tin oxide, and a matting agent, such as silicon oxide or PMMA particles, to the backing layer can ensure smooth travelling of the image-receiving sheet inside the recording apparatus.

In addition to the backing layer, those additives can also be added to the image-receiving layer and other layers, if needed. The kinds of additives needed cannot be generalized, but depend on the intended purposes. As a guide, however, a matting agent having an average particle size of 0.5 to 10 μm can be added in a proportion of the order of 0.5–80% to the layer. As to the antistatic agent, compounds selected appropriately from various surfactants or conductive agents can be added in such an amount that a surface resistance of $10^{12}$ Ω or below, preferably $10^{9}$ Ω or below, as measured under a condition of 23° C.–50% RH is imparted to the layer.

Examples of a binder usable in the backing layer include polymers for general purpose use, such as gelatin, polyvinyl alcohol, methyl cellulose, nitrocellulose, acetyl cellulose, aromatic polyamide resin, silicone resin, epoxy resin, alkyd resin, phenol resin, melamine resin, fluorine-contained resin, polyimide resin, urethane resin, acrylic resin, urethane-modified silicone resin, polyethylene resin, polypropylene resin, polyester resin, Teflon resin, polyvinyl butyral resin, vinyl chloride resin, polyvinyl acetate, polycarbonate, organoboron compounds, aromatic esters, fluorinated polyurethane and polyether sulfone.

In preventing the matting agent added to the backing layer from coming off into powder and enhancing scratch resistance of the backing layer, it is effective to use a cross-linkable water-soluble binder as the binder of the backing layer and subject the binder to cross-linking reaction. Such a cross-linked binder can have a great effect upon inhibition of blocking upon storage, too.

As to cross-linking means, there is no particular restriction, but heat, actinic rays and pressure can be adopted alone or in combination depending on the characteristics of a cross-linking agent used. In some cases, an adhesive layer may be provided on the backing layer side of the support in order to secure adhesion to the support.

The matting agent added suitably to the backing layer is organic or inorganic fine particles. Examples of an organic matting agent include fine particles of a polymer of radical polymerization type, such as polymethyl methacrylate (PMMA), polystyrene, polyethylene or polypropylene, and fine particles of a condensation polymer, such as polyester or polycarbonate.

The suitable coverage of the backing layer is of the order of 0.5–5 g/m$^2$. When the coverage is below 0.5 g/m$^2$, the coating formed is unstable and the matting agent added thereto tends to cause a coming-off trouble. When the coverage is increased far beyond the value of 5 g/m$^2$, the particle size suitable for a matting agent added to such a thick layer becomes very large; as a result, the pattern of matting agent particles in the backing layer is embossed on the image-receiving layer surface during the storage, and thereby the recorded images tend to suffer from clear spots and unevenness, particularly in the thermal transfer where a thin image-forming layer is transferred.

It is appropriate that the number average particle size of the matting agent be 2.5 to 20 μm greater than the thickness of the binder-alone part of the backing layer. The matting agent is required to comprise particles having sizes of no smaller than 8 μm in a proportion capable of providing a coverage of at least 5 mg/m$^2$, preferably from 6 to 500 mg/m$^2$. By adding such a matting agent, the extraneous matter trouble can be reduced in particular. Moreover, the use of a matting agent having a narrow particle size distribution that the value σ/rn (variation coefficient of particle size distribution) obtained by dividing the standard deviation of particle size distribution by a number average particle size is not greater than 0.3 can reduce the defects caused by particles having exceptionally large sizes, and further can achieve the intended properties in a smaller amount. And greater effects can be obtained by controlling such a variation coefficient to 0.15 or below.

Addition of an antistatic agent to the backing layer is beneficial in preventing an extraneous matter from adhering to the backing layer through electrification by friction against conveyance rolls. As the antistatic agent can be used various kinds of compounds including cationic surfactants, anionic surfactants, nonionic surfactants, high molecular antistatic agents, conductive fine particles, and the compounds described in 11290 *Kagaku Shohin* (which may be translated "11290 Chemical Products"), pp. 875–876, Kagaku Kogyo Nipposha.

Of the substances recited above as antistatic agents usable for the backing layer, carbon black, metal oxides, such as zinc oxide, titanium dioxide and tin oxide, and conductive fine particles, such as organic semiconductors, are preferred over the others. In particular, conductive fine particles are used to advantage because they hardly cause separation from the backing layer and can produce consistent antistatic effect without influenced by surrounding conditions.

To the backing layer, various activators and release agents, such as silicone oils and fluorine-contained resins, can be further added for the purpose of imparting thereto coatability and releasing properties.

When the softening points of the cushion layer and the image-receiving layer are 70° C. or below as measured by thermomechanical analysis (TMA), it is particularly effective to form the backing layer.

The TMA softening point can be determined by raising the temperature of a subject at a constant rate while applying a constant load to the subject, and observing the phase of the subject. In the invention, the TMA softening point is defined as the temperature at which the phase of a subject starts to change. The measurement of softening points by TMA can be performed with a commercial apparatus, such as Termoflex made by Rigaku Denki Co., Ltd.

The thermal transfer sheet and the image-receiving sheet can be utilized for image formation in the form of a laminate wherein the image-forming layer of the thermal transfer sheet and the image-receiving layer of the image-receiving sheet are in face-to-face contact.

The laminate of the thermal transfer and image-receiving sheets can be formed using various methods. For instance, the laminate can be formed with ease by bringing the image-receiving layer of the image-receiving sheet into face-to-face contact with the image-forming layer of the thermal transfer sheet, and passing them between pressing and heating rollers. In this case, the suitable heating temperature is 160° C. or below, preferably 130° C. or below.

For forming the foregoing laminate, the vacuum contact method as described hereinbefore can also be adopted. Specifically, the vacuum contact method comprises winding an image-receiving sheet around a drum having holes for vacuum suction, and subsequently in vacuo bringing a thermal transfer sheet having a size a little greater than the size of the image-receiving sheet into close contact with the image-receiving sheet while uniformly pressing out air by means of squeeze rollers. In still another method, the image-receiving sheet is stuck up on a metallic drum mechanically while imposing tension thereon, and further thereon the thermal transfer sheet is stuck up mechanically while imposing tension thereon in a similar manner, thereby forming a laminate. Of these methods, the vacuum contact method is preferred over the others since it requires no temperature control of heating rollers and can ensure rapid and uniform lamination.

The invention will now be illustrated in more detail by reference to the following examples. However, these examples are not to be construed as limiting the scope of the invention in any way. Additionally, all parts in the following examples are by weight unless otherwise indicated.

EXAMPLE 1-1

Preparation of Thermal Transfer Sheet K (Black)

[Formation of Backing Layer]

(Preparation of Coating Composition for First Backing Layer)

| | |
|---|---|
| Aqueous dispersion of acrylic resin (Jurimer ET410, 20 wt %, produced by Nippon Junyaku Co., Ltd.) | 2 parts |
| Antistatic agent (aqueous dispersion of tin oxide-antimony oxide mixture, average grain size: 0.1 μm, 17 wt %) | 7.0 parts |
| Polyoxyethylene phenyl ether | 0.1 parts |
| Melamine compound (Sumitex Resin M-3, produced by Sumitomo Chemical Co., Ltd.) | 0.3 parts |
| Distilled water to make | 100 parts |

(Formation of First Backing Layer)

One surface (back surface) of a 75 μm-thick biaxially stretched polyethylene terephthalate film (Ra of both surfaces: 0.01 μm) as a substrate was subjected to corona treatment, coated with the coating composition for a fist backing layer so as to have a dry thickness of 0.03 μm, and then dried for 30 seconds at 180° C. Thus, the first backing layer was formed. The substrate used herein had Young's modulus of 450 kg/mm$^2$ (approximately 4.4 GPa) in the length direction and 500 Kg/mm$^2$ (approximately 4.9 GPa) in the width direction. The F-5 value of the substrate in the length direction was 10 kg/mm$^2$ (approximately 98 MPa), while that in the width direction was 13 kg/mm$^2$ (approximately 127.4 MPa). The thermal shrinkage ratios of the substrate in the length and width directions under heating at 100° C. for 30 minutes were 0.3% and 0.1%, respectively. The tensile strength of the substrate at break was 20 kg/m$^2$ (approximately 196 MPa) in the length direction, while that in the wide direction was 25 kg/mm$^2$ (approximately 245 MPa). The elasticity modulus of the substrate was 400 kg/mm$^2$ (approximately 3.9 GPa).

(Preparation of Coating Composition for Second Backing Layer)

| | |
|---|---|
| Polyolefin (Chemipearl S-120, 27 wt %, produced by Mitsui Petrochemical Industries, Ltd.) | 3.0 parts |
| Antistatic agent (aqueous dispersion of tin oxide-antimony oxide mixture, average grain size: 0.1 μm, 17 wt %) | 2.0 parts |
| Colloidal silica (Snowtex C, 20 wt %, produced by Nissan Chemical Industries, Ltd.) | 2.0 parts |
| Epoxy compound (Dinakole Ex614B, Nagase Kasei Co., Ltd.) | 0.3 parts |
| Sodium polystyrenesulfonate | 0.1 parts |
| Distilled water to make | 100 parts |

(Formation of Second Backing Layer)

On the first backing layer, the coating composition for a second backing layer was coated so as to have a dry thickness of 0.03 μm, and then dried for 30 seconds at 170° C. Thus, the second backing layer was formed.

[Formation of Light-to-Heat Conversion Layer]

(Preparation of Coating Composition for Light-to-Heat Conversion Layer)

The following ingredients were stirred with a stirrer into a mixture, thereby preparing a costing composition for a light-to-heat conversion layer.

Coating Composition for Light-to-Heat Conversion Layer:

Infrared absorbing dye 7.6 parts (NK-2014, cyanine dye of the following structural formula, a product of Nippon Kanko Shikiso Co., Ltd.)

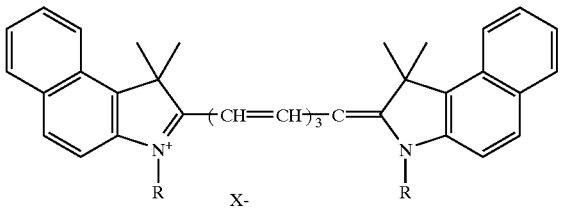

(wherein R is $CH_3$, and $X^-$ is $CLO_4^-$)

Polyimide resin of the following formula 29.3 parts (Rika Coat SN-20F; a product of New Japan Chemical Co., Ltd.; thermal decomposition temperature: 510° C.)

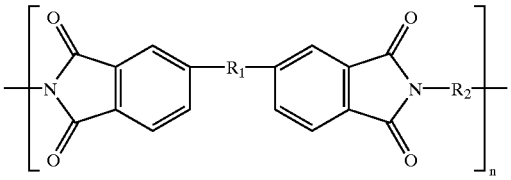

(wherein $R_1$ is $SO_2$, and $R_2$ represents

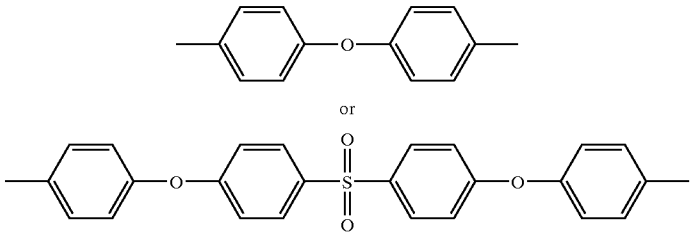

| | |
|---|---|
| Exxon Naphtha | 5.8 parts |
| N-Methyl-2-Pyrrolidone (NMP) | 1500 parts |
| Methyl ethyl ketone | 360 parts |
| Surfactant of fluorinated type (Megafac F-176PF, produced by Dai-Nippon Ink & Chemicals Inc.) | 0.5 parts |
| Matting agent dispersion of the following composition | 14.1 parts |

Preparation of Matting Agent Dispersion:

A mixture of 10 parts of genuinely spherical particulate silica having an average particle size of 1.5 μm (Seehoster KE-P150, produced by Nippon Shokubai Co., Ltd.), 2 parts of a dispersant polymer (acrylate-styrene copolymer, Juncryl 611, produced by Johnson Polymer Inc.), 16 parts of methyl ethyl ketone and 64 parts of N-methyl pyrrolidone was placed in a 200 ml of polyethylene vessel together with 30 parts of glass beads measuring 2 mm in diameter, and dispersed for 2 hours by means of a paint shaker (made by Toyo Seiki). Thus, a dispersion of particulate silica was prepared.

(Formation of Light-to-Heat Conversion Layer on Substrate Surface)

On the other surface of the 75 μm-thick polyethylene terephthalate film (substrate), the coating composition described above was coated with a wire bar, and then dried for 2 minutes in a 120° C. oven to form a light-to-heat converting layer on the substrate. The optical density at a wavelength of 808 nm (abbreviated as "$OD_{LM}$") was 1.03 as measured with a UV-spectrophotometer UV-240 made by Shimadzu Corp. The cross-section of the light-to-heat conversion layer was observed under a scanning electron microscope, and thereby the thickness of the layer was found to be 0.3 μm on the average.

Additionally, the optical density ($OD_{LH}$) of the light-to-heat conversion layer constituting the present thermal transfer sheet refers to the absorbance of the light-to-heat conversion layer at the peak wavelength of laser light used for recording on the present image-forming material, and can be measured with a known spectrophotometer. In the invention, as described above, a UV-Spectrophotometer UV-240 made by Shimadzu Corp. was used. And the optical density ($OD_{LH}$) defined above was a value obtained by subtracting the substrate-alone optical density from the substrate-inclusive optical density.

[Formation of Image-Forming Layer]

(Preparation of Coating Composition for Forming Black Image-forming Layer)

The following ingredients were placed in the mill of a kneader, and subjected to pretreatment for dispersion while adding a small amount of solvent and imposing shearing stress thereon. To the dispersion obtained, the solvent was further added so that the following composition was prepared finally, and subjected to 2-hour dispersion with a sand mill. Thus, a mother dispersion of pigments was obtained.

(Composition of Mother Dispersion of Black Pigments)

| Composition (1): | |
|---|---|
| Polyvinyl butyral (Esleck B BL-SH, produced by Sekisui Chemical Co., Ltd.) | 12.6 parts |
| Pigment Black 7 (Carbon black C.I. No. 77266) (Mitsubishi Carbon Black #5 produced by Mitsubishi Chemical Corporation, PVC blackness: 1) | 4.5 parts |
| Dispersing aid (Solsperse S-20000, produced by ICI Co., Ltd.) | 0.8 parts |
| n-Propyl alcohol | 79.4 parts |

| Composition (2): | |
|---|---|
| Polyvinyl butyral (Esleck B BL-SH, produced by Sekisui Chemical Co., Ltd.) | 12.6 parts |
| Pigment Black 7 (Carbon black C.I. No. 77266) | 10.5 parts |

-continued

| Composition (2): | |
|---|---|
| (Mitsubishi Carbon Black MA100, produced by Mitsubishi Chemical Corporation, PVC blackness: 10) | |
| Dispersing aid (Solsperse S-20000, produced by ICI Co., Ltd.) | 0.8 parts |
| n-Propyl alcohol | 79.4 parts |

Then, the following ingredients were mixed with stirring by means of a stirrer to prepare a coating composition for a black image-forming layer.

(Coating Composition for Black Image-forming Layer)

| | |
|---|---|
| The foregoing mother dispersion of black pigments (Composition (1)/Composition (2) ratio = 70:30 by parts) | 185.7 parts |
| Polyvinyl butyral (Esleck B BL-SH, produced by Sekisui Chemical Co., Ltd.) | 11.9 parts |
| Wax compounds | |
| Stearic acid amide (Neutron 2, produced by Nippon Fine Chemical Co., Ltd.) | 1.7 parts |
| Behenic acid amide (Diamid BM, produced by Nippon Kasei Chemical Co., Ltd.) | 3.4 parts |
| Palmitic acid amide (Diamid KP, produced by Nippon Kasei Chemical Co., Ltd.) | 1.7 parts |
| Erucic acid amide (Diamid L-200, produced by Nippon Kasei Chemical Co., Ltd.) | 1.7 parts |
| Oleic acid amide (Diamid O-200, produced by Nippon Kasei Chemical Co., Ltd.) | 1.7 parts |
| Rosin (KE-311, produced by Arakawa Chemical Industries, Ltd., containing 80–97% of resin acids constituted of 30–40% of abietic acid, 10–20% of neoabietic acid, 14% of dihydroabietic acid and 14% of tetrahydro-abietic acid) | 11.4 parts |
| Surfactant (Megafac F-176PF, solid content: 20%, produced by Dai-Nippon Ink & Chemicals Inc.) | 2.1 parts |
| Inorganic pigment (MEK-ST, 30% methyl ethyl ketone solution, produced by Nissan Chemical Industries, Ltd.) | 7.1 parts |
| n-Propyl alcohol | 1050 parts |
| Methyl ethyl ketone | 295 parts |

Particles in the thus obtained coating composition for a black image forming layer were examined with a laser-scatter particle size analyzer, and thereby it was found that the average particle size was 0.25 $\mu$m and the proportion of particles having sizes of 1 $\mu$m or greater was 0.5%.

(Formation of Black Image-Forming Layer on Light-to-Heat Conversion Layer)

On the light-to-heat conversion layer surface, the foregoing coating composition for black image-forming layer was coated over 1 minute by means of a wire bar, and then dried for 2 minutes in a 100° C. oven, thereby forming a black image forming layer on the light-to-heat conversion layer. In accordance with the process mentioned above, the light-to-heat conversion layer and the black image-forming layer were provided on the substrate in order of mention, thereby preparing a thermal transfer sheet (Hereinafter, this sheet was referred to as "thermal transfer sheet K". Similarly thereto, the transfer sheet provided with a yellow image-forming layer was referred to as "thermal transfer sheet Y", the transfer sheet provided with a magenta image-forming layer was referred to as "thermal transfer sheet M", and the transfer sheet provided with a cyan image-forming layer was referred to as "thermal transfer sheet C").

The optical density (OD) of the black image-forming layer constituting the thermal transfer sheet K was measured with a Macbeth densitometer TD-904 (W filter), and thereby OD was found to be 0.91. And the thickness of the black image-forming layer was found to be 0.60 $\mu$m on the average.

The physical properties of the thus formed image-forming layer were as follows.

The surface hardness of the image-forming layer, though it is appropriately 10 g or higher, was at least 200 g in the concrete, as measured with a sapphire stylus.

The Smooster value of the image-forming layer surface was 9.3 mmHg (approximately 1.24 kPa), though preferably 0.5 to 50 mmHg (approximately 0.0665 to 6.65 kPa), under a condition of 23° C.–55% RH.

Although it is preferably 0.2 or below, the static friction coefficient of the surface was 0.08 in the concrete.

The surface energy was 29 mJ/m$^2$, and the contact angle with respect to water was 94.8°.

The deformation rate of the light-to-heat conversion layer was 168% when the recording with laser light having light intensity of 1000 W/mm$^2$ at the exposed surface was carried out at a linear speed of 1 m/sec or higher.

[Preparation of Thermal Transfer Sheet Y]

A thermal transfer sheet Y was prepared in the same manner as the thermal transfer sheet K, except that the following coating composition for a yellow image-forming layer was used in place of the coating composition for the black image-forming layer. The image-forming layer of the thermal transfer sheet Y thus prepared had a thickness of 0.42 $\mu$m.

(Composition of Mother Dispersion of Yellow Pigments)

| Yellow Pigment Composition (1): | |
|---|---|
| Polyvinyl butyral (Esleck B BL-SH, produced by Sekisui Chemical Co., Ltd.) | 7.1 parts |
| Pigment Yellow 180 (C.I. No. 21290) (Novoperm Yellow P-HG, produced by Clariant Japan Co., Ltd.) | 12.9 parts |
| Dispersing aid (Solsperse S-20000, produced by ICI Co., Ltd.) | 0.6 parts |
| n-Propyl alcohol | 79.4 parts |

| Yellow Pigment Composition (2): | |
|---|---|
| Polyvinyl butyral (Esleck B BL-SH, produced by Sekisui Chemical Co., Ltd.) | 7.1 parts |
| Pigment Yellow 139 (C.I. No. 56298) (Novoperm Yellow M2R 70, produced by Clariant Japan Co., Ltd.) | 12.9 parts |
| Dispersing aid (Solsperse S-20000, produced by ICI Co., Ltd.) | 0.6 parts |
| n-Propyl alcohol | 79.4 parts |
| (Coating Composition for Yellow Image-forming Layer) | |
| The foregoing mother dispersion of yellow pigments (Composition (1)/Composition (2) ratio = 95:5 by parts) | 126 parts |
| Polyvinyl butyral (Esleck B BL-SH, produced by Sekisui Chemical Co., Ltd.) | 4.6 parts |

-continued

| Yellow Pigment Composition (2): | |
|---|---|
| Wax compounds | |
| Stearic acid amide (Neutron 2, produced by Nippon Fine Chemical Co., Ltd.) | 0.7 parts |
| Behenic acid amide (Diamid BM, produced by Nippon Kasei Chemical Co., Ltd.) | 0.7 parts |
| Lauric acid amide (Diamid Y, produced by by Nippon Kasei Chemical Co., Ltd.) | 0.7 parts |
| Palmitic acid amide (Diamid KP, produced by Nippon Kasei Chemical Co., Ltd.) | 0.7 parts |
| Oleic acid amide (Diamid O-200, produced by Nippon Kasei Chemical Co., Ltd.) | 1.4 parts |
| Nonionic surfactant (Chemistat 1100, produced by Sanyo Chemical Industries, Ltd.) | 0.4 parts |
| Rosin (KE-311, produced by Arakawa Chemical Industries, Ltd.) | 2.4 parts |
| Surfactant (Megafac F-176PF, solid content: 20%, produced by Dai-Nippon Ink & Chemicals Inc.) | 0.8 parts |
| n-Propyl alcohol | 793 parts |
| Methyl ethyl ketone | 198 parts |

The physical properties of the thus formed image-forming layer were as follows.

The surface hardness of the image-forming layer, though it is appropriately 10 g or higher, was at least 200 g in the concrete, as measured with a sapphire stylus.

The Smooster value of the image-forming layer surface was 2.3 mmHg (approximately 0.31 kPa), though preferably 0.5 to 50 mmHg (approximately 0.0665 to 6.65 kPa), under a condition of 23° C.–55% RH.

Although it is preferably 0.2 or below, the static friction coefficient of the surface was 0.1 in the concrete.

The surface energy was 24 mJ/m$^2$, and the contact angle with respect to water was 108.1°.

The deformation rate of the light-to-heat conversion layer was 150% when the recording with laser light having light intensity of 1000 W/mm$^2$ at the exposed surface was carried out at a linear speed of 1 m/sec or higher.

[Preparation of Thermal Transfer Sheet M]

A thermal transfer sheet M was prepared in the same manner as the thermal transfer sheet K, except that the following coating composition for a magenta image-forming layer was used in place of the coating composition for the black image-forming layer. The image-forming layer of the thermal transfer sheet M thus prepared had a thickness of 0.38 $\mu$m.

(Composition of Mother Dispersion of Magenta Pigments)

| Magenta Pigment Composition (1): | |
|---|---|
| Polyvinyl butyral (Denka Butyral #2000-L, produced by Electro Chemical Industry Co., Ltd., Vicat softening point: 57° C.) | 12.6 parts |
| Pigment Red 57:1 (C.I. No. 15850:1) (Symuler Brilliant Carmine 6B-229, produced by Dainippon Ink and Chemicals, Inc.) | 15.0 parts |
| Dispersing aid (Solsperse S-20000, produced by ICI Co., Ltd.) | 0.6 parts |
| n-Propyl alcohol | 80.4 parts |

| Magenta Pigment Composition (2): | |
|---|---|
| Polyvinyl butyral (Denka Butyral #2000-L, produced by Electro Chemical Industry Co., Ltd., Vicat softening point: 57° C.) | 12.6 parts |
| Pigment Red 57:1 (C.I. No. 15850:1) (Lionol Red 6B-4290G, produced by Toyo InkMfg. Co., Ltd.) | 15.0 parts |
| Dispersing aid Solsperse S-20000, produced by ICI Co., Ltd.) | 0.6 parts |
| n-Propyl alcohol | 79.4 parts |

(Coating Composition for Magenta Image-forming Layer)

| | |
|---|---|
| The foregoing mother dispersion of Magenta pigments (Composition (1)/Composition (2) ratio = 95:5 by parts) | 163 parts |
| Polyvinyl butyral (Denka Butyral #2000-L, produced by Electro Chemical Industry Co., Ltd., Vicat softening point: 57° C.) | 4.0 parts |
| Wax compounds | |
| Stearic acid amide (Neutron 2, produced by Nippon Fine Chemical Co., Ltd.) | 1.0 parts |
| Behenic acid amide (Diamid BM, produced by Nippon Kasei Chemical Co., Ltd.) | 1.0 parts |
| Lauric acid amide (Diamid Y, produced by by Nippon Kasei Chemical Co., Ltd.) | 1.0 parts |
| Palmitic acid amide (Diamid KP, produced by Nippon Kasei Chemical Co., Ltd.) | 1.0 parts |
| Erucic acid amide (Diamid L-200, produced by Nippon Kasei Chemical Co., Ltd.) | 1.0 parts |
| Nonionic surfactant (Chemistat 1100, produced by Sanyo Chemical Industries, Ltd.) | 0.7 parts |
| Rosin (KE-311, produced by Arakawa Chemical Industries, Ltd.) | 4.6 parts |
| Pentaerythritol tetraacrylate (NK Ester A-TMMT, made by Shin-Nakamura Chemical Co., Ltd.) | 2.5 parts |
| Surfactant (Megafac F-176PF, solid content: 20%, produced by Dai-Nippon Ink & Chemicals Inc.) | 1.3 parts |
| n-Propyl alcohol | 848 parts |
| Methyl ethyl ketone | 246 parts |

The physical properties of the thus formed image-forming layer were as follows.

The surface hardness of the image-forming layer, though it is appropriately 10 g or higher was at least 200 g in the concrete, as measured with a sapphire stylus.

The Smooster value of the image-forming layer surface was 3.5 mmHg (approximately 0.47 kPa), though preferably 0.5 to 50 mmHg (approximately 0.0665 to 6.65 kPa), under a condition of 23° C.–55% RH.

Although it is preferably 0.2 or below, the static friction coefficient of the surface was 0.08 in the concrete.

The surface energy was 25 mJ/m$^2$, and the contact angle with respect to water was 98.8°.

The deformation rate of the light-to-heat conversion layer was 160% when the recording with laser light having light intensity of 1000 W/mm$^2$ at the exposed surface was carried out at a linear speed of 1 m/sec or higher.

[Preparation of Thermal Transfer Sheet C]

A thermal transfer sheet C was prepared in the same manner as the thermal transfer sheet K, except that the following coating composition for a cyan image-forming layer was used in place of the coating composition for the black image-forming layer. The image-forming layer of the thermal transfer sheet C thus prepared had a thickness of 0.45 $\mu$m.

(Composition of Mother Dispersion of Cyan Pigments)

| Cyan Pigment Composition (1) | |
|---|---|
| Polyvinyl butyral (Esleck B BL-SH, produced by Sekisui Chemical Co., Ltd.) | 12.6 parts |
| Pigment Blue 15:4 (C.I. No. 74160) (Cyanine Blue 700-10FG, produced by Toyo Ink Mfg. Co., Ltd.) | 15.0 parts |
| Dispersing aid (PW-36, produced by Kusumoto Chemical Co., Ltd.) | 0.8 parts |
| n-Propyl alcohol | 110 parts |

| Cyan Pigment Composition (2): | |
|---|---|
| Polyvinyl butyral (Esleck B BL-SH, produced by Sekisui Chemical Co., Ltd.) | 12.6 parts |
| Pigment Blue 15 (C.I. No. 74160) (Lionol Blue 7027, produced by Toyo Ink Mfg. Co., Ltd.) | 15.0 parts |
| Dispersing aid (PW-36, produced by Kusumoto Chemical Co., Ltd.) | 0.8 parts |
| n-Propyl alcohol | 110 parts |
| (Coating Composition for Cyan Image-forming Layer) | |
| The foregoing mother dispersion of Cyan pigments (Composition (1)/Composition (2) ratio = 90:10 by parts) | 118 parts |
| Polyvinyl butyral Esleck B BL-SH, produced by Sekisui Chemical Co., Ltd.) | 5.2 parts |
| Inorganic pigment (MEK-ST) | 1.3 parts |
| Wax compounds | |
| Stearic acid amide (Neutron 2, produced by Nippon Fine Chemical Co., Ltd.) | 1.0 parts |
| Behenic acid amide (Diamid BM, produced by Nippon Kasei Chemical Co., Ltd.) | 1.0 parts |
| Lauric acid amide (Diamid Y, produced by by Nippon Kasei Chemical Co., Ltd.) | 1.0 parts |
| Palmitic acid amide (Diamid KP, produced by Nippon Kasei Chemical Co., Ltd.) | 1.0 parts |
| Erucic acid amide (Diamid L-200, produced by Nippon Kasei Chemical Co., Ltd.) | 1.0 parts |
| Oleic acid amide (Diamid O-200, produced by Nippon Kasei Chemical Co., Ltd.) | 1.0 parts |
| Rosin (KE-311, produced by Arakawa Chemical Industries, Ltd.) | 2.8 parts |
| Pentaerythritol tetraacrylate (NK Ester A-TMMT, made by Shin-Nakamura Chemical Co., Ltd.) | 1.7 parts |
| Surfactant (Megafac F-176PF, solid content: 20%, produced by Dai-Nippon Ink & Chemicals Inc.) | 1.7 parts |
| n-Propyl alcohol | 890 parts |
| Methyl ethyl ketone | 247 parts |

The physical properties of the thus formed image-forming layer were as follows.

The surface hardness of the image-forming layer, though it is appropriately 10 g or higher, was at least 200 g in the concrete, as measured with a sapphire stylus.

The Smooster value of the image-forming layer surface was 7.0 mmHg (approximately 0.93 kPa), though preferably 0.5 to 50 mmHg (approximately 0.0665 to 6.65 kPa), under a condition of 23° C.–55% RH.

Although it is preferably 0.2 or below, the static friction coefficient of the surface was 0.08 in the concrete.

The surface energy was 25 mJ/m$^2$, and the contact angle with respect to water was 98.8°.

The deformation rate of the light-to-heat conversion layer was 165% when the recording with laser light having light intensity of 1000 W/mm$^2$ at the exposed surface was carried out at a linear speed of 1 m/sec or higher.

[Preparation of Image-receiving Sheet]

Coating compositions for cushion and image-receiving layers were prepared using the following ingredients.

| (1) Coating Composition for Cushion Layer: | |
|---|---|
| Vinyl chloride-vinyl acetate copolymer (main binder, MPR-TSL, produced by Nisshin Chemical Industry Co., Ltd.) | 20 parts |
| Plasticizer (Paraplex G-40, produced by C P. Hall Company) | 10 parts |
| Surfactant (fluorinated type, coating aid) (Megafac F-177, produced by Dainippon Ink & Chemicals Inc.) | 0.5 parts |
| Antistatic agent (quaternary ammonium salt) (SAT-5 Supper (IC), produced by Nippon Junyaku Co., Ltd.) | 0.3 parts |
| Methyl ethyl ketone | 60 parts |
| Toluene | 10 parts |
| N,N-Dimethylformamide | 3 parts |
| (2) Coating Composition for Image-Receiving Layer: | |
| Polyvinyl butyral (Esleck B BL-SH, produced by Sekisui Chemical Co., Ltd.) | 8 parts |
| Antistatic agent (Sanstat 2012A, produced by Sanyo Chemical Industries, Ltd.) | 0.7 parts |
| Surfactant (Megafac F-177, produced by Dainippon Ink & Chemicals Inc.) | 0.1 parts |
| n-Propyl alcohol | 20 parts |
| Methanol | 20 parts |
| 1-Methoxy-2-propanol | 50 parts |

On a 130 $\mu$m-thick white PET support (Lumiler #130E58, produced by Toray Industries, Inc.), the coating composition for a cushion layer was coated by means of a wire bar, and then dried. On the cushion layer thus formed, the coating composition for an image-receiving layer was further coated with a wire bar, and then dried, Therein the amounts of the former and latter compositions coated were adjusted so as to have dry thicknesses of about 20 $\mu$m and about 2 $\mu$m, respectively. The white PET support was a voids-containing plastic support (total thickness: 130 $\mu$m, specific gravity: 0.8) made by laminating titanium dioxide-containing polyethylene terephthalate layers (thickness: 7 $\mu$m, titanium dioxide content: 2%) on both sides of voids-containing polyethylene terephthalate layer (thickness; 116 $\mu$m, porosity: 20%). The laminate thus made was wound into a roll, stored for 1 week at room temperature, and used for recording of images by laser light.

The thus formed image-receiving layer had physical properties described below.

The surface roughness Ra, though it was appropriately from 0.4 to 0.01 $\mu$m, was 0.02 $\mu$m in the concrete.

The undulation of the image-receiving layer surface, though it was appropriately 2 $\mu$m or below, was 1.2 $\mu$m in the concrete.

The Smooster value of the image-receiving layer surface, though it was appropriately 0.5 to 50 mmHg (approximately 0.0665 to 6.65 kPa) under a condition of 23° C.–55% RH, was 0.8 mmHg (approximately 0.11 kPa) in the concrete under the same condition.

The static friction coefficient of the image-receiving layer surface, though it was appropriately 0.8 or below, was 0.37 in the concrete.

The surface energy of the image-receiving layer surface was 29 mJ/m$^2$, and the contact angle with respect to water was 85.0°.

[Evaluation of Stackability]

The evaluation was made using a Luxel FINALPROOF 5600 Printer (made by Fuji Photo Film Co., Ltd.). The image-receiving sheet prepared into a roll (having a width of 558 mm and an arbitrary length) and the thermal transfer sheet C prepared into a roll (having a width of 609 mm and an arbitrary length) were set in the printer.

(a) The image-receiving sheet having a width corresponding to the length of B2 size (558×840 mm) was conveyed in a condition that no images were recorded thereon, set on a recording drum, and ejected. This operation was continuously repeated 20 times, and a stack of the sheets was formed.

(b) 100% transferred (solid) cyan image was recorded on the image-receiving sheet having a width corresponding to the length of B2 size (wherein the size of the image-receiving sheet was 558×840 mm and that of the thermal transfer sheet was 609×877 mm). This recording process was repeated continuously 20 times, and a stack of sheets was formed.

In stacking sheets, an air blaster was actuated. And in what condition the sheets were stacked was observed. Of the twenty image-receiving sheets stacked on the tray, the extent of misalignment between the front edges of the sheet displaced most upwardly and the sheet displaced most downwardly was measured.

good: All the sheets were stacked on the tray in a good condition, and the extent of maximum misalignment is smaller than 2 cm.

unsatisfactory: All the sheets were stacked on the tray, and the extent of maximum misalignment is smaller than 5 cm.

poor: The extent of maximum misalignment is not smaller than 5 cm. or sticking, waving, curling or/and protruding troubles are caused.

The reflection optical densities of images transferred to specialty art paper used as printing paper were measured with a densitometer, X-rite 938 (made by X-rite Co.) in Y, M, C and K modes for Y, M, C and K colors respectively.

The reflection optical density of each color and the ratio of reflection optical density to image-forming layer thickness are shown in Table 1.

TABLE 1

| | Reflection optical density | Reflection optical density/ image-forming layer thickness |
|---|---|---|
| Y color | 1.01 | 2.40 |
| M color | 1.51 | 3.97 |
| C color | 1.59 | 3.03 |
| K color | 1.82 | 3.03 |

EXAMPLE 1-2

Transfer images were formed in the same manner as in Example 1-1, except that an image-receiving sheet using a 100 μm-thick white PET support (Lumiler #100E20, produced by Toray Industries, Inc.) was used in place of the image-receiving sheet used in Example 1-1.

COMPARATIVE EXAMPLE 1-1

Transfer images were formed in the same manner as in Example 1-1, except that an image-receiving sheet using a 75 μm-thick white PET support (Lumiler #75E20, produced by Toray Industries, Inc.) was used in place of the image-receiving sheet used in Example 1-1.

COMPARATIVE EXAMPLE 1-2

Transfer images were formed in the same manner as in Example 1-1, except that the air blaster was not actuated at the time the stackability was evaluated though the image-receiving sheets used were the same ones as prepared in Example 1-1.

The results obtained in Examples 1-1 and 1-2, and Comparative Examples 1-1 and 1-2 are shown in Table 2.

TABLE 2

| | Image-Receiving Sheet | | | Result of Stackability Evaluation | |
|---|---|---|---|---|---|
| | Structure | | | 100% | No |
| | Stiffness | Thickness | Air stacking | (solid) C-image | recorded images |
| Example 1-1 | 73 g | 148 μm | done | Good | good |
| Example 1-2 | 60 g | 118 μm | done | Good | good |
| Comparative Example 1-1 | 42 g | 93 μm | done | Poor | poor |
| Comparative Example 1-2 | 73 g | 148 μm | not done | unsatis-factory | poor |

As can be seen from Table 2, the results of stackability evaluation made on image-receiving sheets prepared in Examples 1-1 and 1-2 were good. More specifically, the stackability of the image receiving sheets on which 100% (solid) cyan images were recorded and that of the image-receiving sheets on which no images were recorded by transfer were both good (namely these sheets were stacked on the tray to an extent that the maximum misalignment was smaller than 2 cm).

On the other hand, as the image-receiving sheets, though they were the same sheets as prepared in Example 1-1, were not stacked by air blast in Comparative Example 1-2, the results of stackability evaluation made thereon were significantly inferior to those on the image receiving sheets prepared in Example 1-1. More specifically, the stackability of the image receiving sheets on which 100% (solid) cyan images were recorded was unsatisfactory (namely the extent of maximum misalignment was not smaller than 2 cm, but smaller than 5 cm), and that of the image-receiving sheets on which no images were recorded by transfer was poor (namely the extent of maximum misalignment was not smaller than 5 cm or troubles occurred).

In Comparative Example 1-1, the image-receiving sheets were small in both stiffness and thickness, so that their stackability was significantly inferior even when the air stacking was performed. More specifically, the stackability of the image receiving sheets on which 100% (solid) cyan images were recorded and that of the image-receiving sheets on which no images were recorded by transfer were both poor (namely the extent of maximum misalignment was not smaller than 5 cm or troubles occurred).

EXAMPLE 2-1

Preparation of Thermal Transfer Sheet K (Black)

[Formation of Backing Layer]

(Preparation of Coating Composition for First Backing Layer)

| | |
|---|---|
| Aqueous dispersion of acrylic resin (Jurimer ET410, 20 wt % on solid basis, produced by Nippon Junyaku Co., Ltd.) | 2 parts |
| Antistatic agent (aqueous dispersion of tin oxide-antimony oxide mixture, average grain size: 0.1 μm, 17 wt %) | 7.0 parts |
| Polyoxyethylene phenyl ether | 0.1 parts |
| Melamine compound (Sumitics Resin M-3, produced by Sumitomo Chemical Co., Ltd.) | 0.3 parts |
| Distilled water to make | 100 parts |

(Formation of First Blacking Layer)

One surface (back surface) of a 75 μm-thick biaxially stretched polyethylene terephthalate film (Ra of both surfaces: 0.01 μm) as a substrate was subjected to corona treatment, coated with the coating composition for a fist backing layer so as to have a dry thickness of 0.03 μm, and then dried for 30 seconds at 180° C. Thus, the first backing layer was formed. The substrate used herein had Young's modulus of 450 kg/mm$^2$ (approximately 4.4 GPa) in the length direction and 500 kg/mm$^2$ (approximately 4.9 GPa) in the width direction. The F-5 value of the substrate in the length direction was 10 kg/mm$^2$ (approximately 98 MPa), while that in the width direction was 13 kg/mm$^2$ (approximately 127.4 MPa). The thermal shrinkage ratios of the substrate in the length and width directions under heating at 100° C. for 30 minutes were 0.3% and 0.1%, respectively. The tensile strength of the substrate at break was 20 kg/mm$^2$ (approximately 196 MPa) in the length direction, while that in the wide direction was 25 kg/mm$^2$ (approximately 245 MPa). The elasticity modulus of the substrate was 400 kg/mm$^2$ (approximately 3.9 GPa).

(Preparation of Coating Composition for Second Backing Layer)

| | |
|---|---|
| Polyolefin (Chemipearl S-120, 27 wt %, produced by Mitsui Petrochemical Industries, Ltd.) | 3.0 parts |
| Antistatic agent (aqueous dispersion of tin oxide-antimony oxide mixture, average grain size: 0.1 μm, 17 wt %) | 2.0 parts |
| Colloidal silica (Snowtex C, 20 wt %, produced by Nissan Chemical Industries, Ltd.) | 2.0 parts |
| Epoxy compound (Dinakole Ex-614B, Nagase Kasei Co., Ltd.) | 0.3 parts |
| Distilled water to make | 100 parts |

(Formation of Second Backing Layer)

On the first backing layer, the coating composition for a second backing layer was coated so as to have a dry thickness of 0.03 μm, and then dried for 30 seconds at 170° C. Thus, the second backing layer was formed.

[Formation of Light-to-Heat Conversion Layer]

(Preparation of Coating Composition for Light-to-Heat Conversion Layer)

The following ingredients were stirred with a stirrer into a mixture, thereby preparing a coating composition for a light-to-heat conversion layer.

Coating Composition for Light-to-Heat Conversion Layer:

Infrared absorbing dye 7.6 parts (NK-2014, cyanine dye of the following structural formula, a product of Nippon Kanko Shikiso Co., Ltd.)

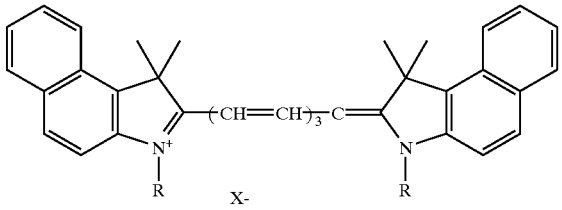

(wherein R is $CH_3$, and $X^-$ is $CLO_4^-$)

Polyimide resin of the following formula 29.3 parts (Rika Coat SN-20F; a product of New Japan Chemical Co., Ltd.; thermal decomposition temperature: 510° C.)

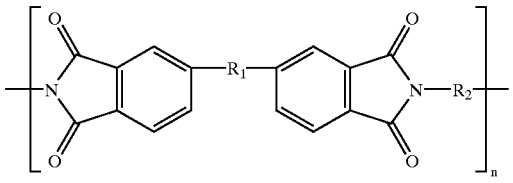

(wherein $R_1$ is $SO_2$, and $R_2$ represents

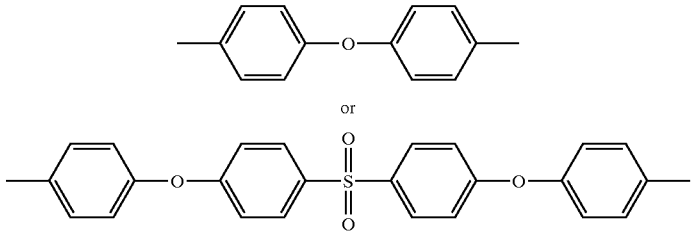

| | |
|---|---|
| Exxon Naphtha | 5.8 parts |
| N-Methyl-2-Pyrrolidone (NMP) | 1500 parts |
| Methyl ethyl ketone | 360 parts |
| Surfactant of fluorinated type (Megafac F-176PF, produced by Dai-Nippon Ink & Chemicals Inc.) | 0.5 parts |
| Matting agent dispersion of the composition described below | 14.1 parts |

Preparation of Matting Agent Dispersion:

A mixture of 10 parts of genuinely spherical particulate silica having an average particle size of 1.5 μm (Seehoster KE-P150, produced by Nippon Shokubai Co., Ltd.), 2 parts of a dispersant polymer (acrylate-styrene copolymer, Juncryl 611, produced by Johnson Polymer Inc.), 16 parts of methyl ethyl ketone and 64 parts of N-methyl pyrrolidone was placed in a 200 ml of polyethylene vessel together with 30 parts of glass beads measuring 2 mm in diameter, and dispersed for 2 hours by means of a paint shaker (made by Toyo Seiki). Thus, a dispersion of particulate silica was prepared.

(Formation of Light-to-Heat Conversion Layer on Substrate Surface)

On the other surface of the 75 μm-thick polyethylene terephthalate film (substrate), the coating composition described above was coated with a wire bar, and then dried for 2 minutes in a 120° C. oven to form a light-to-heat converting layer on the substrate. The optical density at a wavelength of 808 nm (abbreviated as "$OD_{LH}$") was 1.03 as measured with a UV-Spectrophotometer UV-240 made by Shimadzu Corp. The cross-section of the light-to-heat conversion layer was observed under a scanning electron microscope, and thereby the thickness of the layer was found to be 0.3 μm on the average.

Additionally, the optical density ($OD_{LH}$) of the light-to-heat conversion layer constituting the present thermal transfer sheet refers to the absorbance of the light-to-heat conversion layer at the peak wavelength of laser light used for recording on the present image-forming material, and can be measured with a known spectrophotometer. In the invention, as described above, a UV-Spectrophotometer UV-240 made by Shimadzu Corp. was used. And the optical density ($OD_{LH}$) defined above was a value obtained by subtracting the substrate-alone optical density from the substrate-inclusive optical density.

[Formation of Image-Forming Layer]

(Preparation of Coating Composition for Forming Black Image-forming Layer)

The following ingredients were placed in the mill of a kneader, and subjected to pretreatment for dispersion while adding a small amount of solvent and imposing shearing stress thereon. To the dispersion obtained, the solvent was further added so that the following composition was prepared finally, and subjected to 2-hour dispersion with a sand mill. Thus, a mother dispersion of pigments was obtained.

(Composition of Mother Dispersion of Black Pigments)

| Composition (1): | |
|---|---|
| Polyvinyl butyral (Esleck B BL-SH, produced by Sekisui Chemical Co., Ltd.) | 12.6 parts |
| Pigment Black 7 (Carbon black C.I. No. 77266) (Mitsubishi Carbon Black #5 produced by Mitsubishi Chemical Corporation, PVC blackness: 1) | 4.5 parts |
| Dispersing aid (Solsperse S-20000, produced by ICI Co., Ltd.) | 0.8 parts |
| n-Propyl alcohol | 79.4 parts |

| Composition (2): | |
|---|---|
| Polyvinyl butyral (Esleck B BL-SH, produced by Sekisui Chemical Co., Ltd.) | 12.6 parts |
| Pigment Black 7 (Carbon black C.I. No. 77266) (Mitsubishi Carbon Black MA100, produced by Mitsubishi Chemical Corporation, PVC blackness: 10) | 10.5 parts |
| Dispersing aid (Solsperse S-20000, produced by ICI Co., Ltd.) | 0.8 parts |
| n-Propyl alcohol | 79.4 parts |

Then, the following ingredients were mixed with stirring by means of a stirrer to prepare a coating composition for a black image-forming layer.

(Coating Composition for Black Image-forming Layer)

| | |
|---|---|
| The foregoing mother dispersion of black pigments (Composition (1)/Composition (2) ratio = 70:30 by parts) | 185.7 parts |
| Polyvinyl butyral (Esleck B BL-SH, produced by Sekisui Chemical Co., Ltd.) | 11.9 parts |
| Wax compounds | |
| Stearic acid amide (Neutron 2, produced by Nippon Fine Chemical Co., Ltd.) | 3.4 parts |
| Lauric acid amide (Diamid Y, produced by Nippon Kasei Chemical Co., Ltd.) | 1.7 parts |
| Palmitic acid amide (Diamid KP, produced by Nippon Kasei Chemical Co., Ltd.) | 1.7 parts |
| Oleic acid amide (Diamid O-200, produced by Nippon Kasei Chemical Co., Ltd.) | 3.4 parts |
| Rosin | 11.4 parts |

-continued

| | |
|---|---|
| (KE-311, produced by Arakawa Chemical Industries, Ltd., containing 80–97% of resin acids constituted of 30–40% of abietic acid, 10–20% of neoabietic acid, 14% of dihydroabietic acid and 14% of tetrahydro-abietic acid) | |
| Surfactant (Megafac F-176PF, solid content: 20%, produced by Dai-Nippon Ink & Chemicals Inc.) | 2.1 parts |
| Inorganic pigment (MEK-ST, 30% methyl ethyl ketone solution, produced by Nissan Chemical Industries, Ltd.) | 7.1 parts |
| n-Propyl alcohol | 1050 parts |
| Methyl ethyl ketone | 295 parts |

Particles in the thus obtained coating composition for a black image forming layer were examined with a laser-scatter particle size analyzer, and thereby it was found that the average particle size was 0.25 μm and the proportion of particles having sizes of 1 μm or greater was 0.5%.

(Formation of Black Image-Forming Layer on Light-to-Heat Conversion Layer)

On the light-to-heat conversion layer surface, the foregoing coating composition for black image-forming layer was coated over 1 minute by means of a wire bar, and then dried for 2 minutes in a 100° C. oven, thereby forming a black image forming layer on the light-to-heat conversion layer. In accordance with the process mentioned above, the light-to-heat conversion layer and the black image-forming layer were provided on the substrate in order of mention, thereby preparing a thermal transfer sheet (Hereinafter, this sheet was referred to as "thermal transfer sheet K". Similarly thereto, the transfer sheet provided with a yellow image-forming layer was referred to as "thermal transfer sheet Y", the transfer sheet provided with a magenta image-forming layer was referred to as "thermal transfer sheet M", and the transfer sheet provided with a cyan image-forming layer was referred to as "thermal transfer sheet C").

The optical density (OD) of the black image-forming layer constituting the thermal transfer sheet K was measured with a Macbeth densitometer TD-904 (W filter), and thereby OD was found to be 0.91. And the thickness of the black image-forming layer was found to be 0.60 μm on the average.

The physical properties of the thus formed image-forming layer were as follows.

The surface hardness of the image-forming layer, though it is appropriately 10 g or higher, was at least 200 g in the concrete, as measured with a sapphire stylus.

The Smooster value of the image-forming layer surface was 9.3 mmHg (approximately 1.24 kPa), though preferably 0.5 to 50 mmHg (approximately 0.0665 to 6.65 kPa), under a condition of 23° C.–55% RH.

Although it is preferably 0.8 or below, the static friction coefficient of the surface was 0.08 in the concrete.

The surface energy was 29 mJ/m$^2$, and the contact angle with respect to water was 94.8°.

The deformation rate of the light-to-heat conversion layer was 168% when the recording with laser light having light intensity of 1000 W/mm$^2$ at the exposed surface was carried out at a linear speed of 1 m/sec or higher.

[Preparation of Thermal Transfer Sheet Y]

A thermal transfer sheet Y was prepared in the same manner as the thermal transfer sheet K, except that the following coating composition for a yellow image-forming layer was used in place of the coating composition for the black image-forming layer. The image-forming layer of the thermal transfer sheet Y thus prepared had a thickness of 0.42 μm.

(Composition of Mother Dispersion of Yellow Pigments)

| Yellow Pigment Composition (1): | |
|---|---|
| Polyvinyl butyral (Esleck B BL-SH, produced by Sekisui Chemical Co., Ltd.) | 7.1 parts |
| Pigment Yellow 180 (C.I. No. 21290) (Novoperm Yellow P-HG, produced by Clariant Japan Co., Ltd.) | 12.9 parts |
| Dispersing aid (Solsperse S-20000, produced by ICI Co., Ltd.) | 0.6 parts |
| n-Propyl alcohol | 79.4 parts |

| Yellow Pigment Composition (2): | |
|---|---|
| Polyvinyl butyral (Esleck B BL-SH, produced by Sekisui Chemical Co., Ltd.) | 7.1 parts |
| Pigment Yellow 139 (C.I. No. 56298) (Novoperm Yellow M2R 70, produced by Clariant Japan Co., Ltd.) | 12.9 parts |
| Dispersing aid (Solsperse S-20000, produced by ICI Co., Ltd.) | 0.6 parts |
| n-Propyl alcohol | 79.4 parts |
| (Coating Composition for Yellow Image-forming Layer) | |
| The foregoing mother dispersion of yellow pigments (Composition (1)/Composition (2) ratio = 95:5 by parts) | 126 parts |
| Polyvinyl butyral (Esleck B BL-SH, produced by Sekisui Chemical Co., Ltd.) | 4.6 parts |
| Wax compounds | |
| Stearic acid amide (Neutron 2, produced by Nippon Fine Chemical Co., Ltd.) | 0.7 parts |
| Behenic acid amide (Diamid BM, produced by Nippon Kasei Chemical Co., Ltd.) | 1.4 parts |
| Palmitic acid amide (Diamid KP, produced by Nippon Kasei Chemical Co., Ltd.) | 1.4 parts |
| Oleic acid amide (Diamid O-200, produced by Nippon Kasei Chemical Co., Ltd.) | 0.7 parts |
| Nonionic surfactant (Chemistat 1100, produced by Sanyo Chemical Industries, Ltd.) | 0.4 parts |
| Rosin (KE-311, produced by Arakawa Chemical Industries, Ltd.) | 7.4 parts |
| Surfactant (Megafac F-176PF, solid content: 20%, produced by Dai-Nippon Ink & Chemicals Inc.) | 0.8 parts |
| n-Propyl alcohol | 793 parts |
| Methyl ethyl ketone | 198 parts |

The physical properties of the thus formed image-forming layer were as follows.

The layer thickness was 0.42 μm.

The surface hardness of the image-forming layer, though it is appropriately 10 g or higher, was at least 200 g in the concrete, as measured with a sapphire stylus.

The Smooster value of the image-forming layer surface was 2.3 mmHg (approximately 0.31 kPa), though preferably 0.5 to 50 mmHg (approximately 0.0665 to 6.65 kPa), under a condition of 23° C.–55% RH.

Although it is preferably 0.2 or below, the static friction coefficient of the surface was 0.1 in the concrete.

The surface energy was 24 mJ/m$^2$, and the contact angle with respect to water was 108.1°.

The deformation rate of the light-to-heat conversion layer was 150% when the recording with laser light having light intensity of 1000 W/mm$^2$ at the exposed surface was carried out at a linear speed of 1 m/sec or higher.

[Preparation of Thermal Transfer Sheet M]

A thermal transfer sheet M was prepared in the same manner as the thermal transfer sheet K, except that the following coating composition for a magenta image-forming layer was used in place of the coating composition for the black image-forming layer. The image-forming layer of the thermal transfer sheet M thus prepared had a thickness of 0.38 μm.

(Composition of Mother Dispersion of Magenta Pigments)

| Magenta Pigment Composition (1): | |
|---|---|
| Polyvinyl butyral (Denka Butyral #2000-L, produced by Electro Chemical Industry Co., Ltd.; Vicat softening point: 57° C.) | 12.6 parts |
| Pigment Red 57:1 (C.I. No. 15850:1) (Symuler Brilliant Carmine 6B-229, produced by Dainippon Ink and Chemicals, Inc.) | 15.0 parts |
| Dispersing aid (Solsperse S-20000, produced by ICI Co., Ltd.) | 0.6 parts |
| n-Propyl alcohol | 80.4 parts |

| Magenta Pigment Composition (2): | |
|---|---|
| Polyvinyl butyral (Denka Butyral #2000-L, produced by Electro Chemical Industry Co., Ltd.; Vicat softening point: 57° C.) | 12.6 parts |
| Pigment Red 57:1 (C.I. No. 15850:1) (Lionol Red 6B-4290G, produced by Toyo Ink Mfg. Co., Ltd.) | 15.0 parts |
| Dispersing aid (Solsperse S-20000, produced by ICI Co., Ltd.) | 0.6 parts |
| n-Propyl alcohol | 79.4 parts |
| (Coating Composition for Magenta Image-forming Layer) | |
| The foregoing mother dispersion of Magenta pigments (Composition (1)/Composition (2) ratio = 95:5 by parts) | 163 parts |
| Polyvinyl butyral (Denka Butyral #2000-L, produced by Electro Chemical Industry Co., Ltd.; Vicat softening point: 57° C.) | 4.0 parts |
| Wax compounds | |
| Stearic acid amide (Neutron 2, produced by Nippon Fine Chemical Co., Ltd.) | 1.0 parts |
| Behenic acid amide (Diamid BM, produced by Nippon Kasei Chemical Co., Ltd.) | 1.0 parts |
| Lauric acid amide (Diamid Y, produced by by Nippon Kasei Chemical Co., Ltd.) | 1.0 parts |
| Palmitic acid amide (Diamid KP, produced by Nippon Kasei Chemical Co., Ltd.) | 1.0 parts |
| Erucic acid amide (Diamid L-200, produced by Nippon Kasei Chemical Co., Ltd.) | 1.0 parts |
| Oleic acid amide (Diamid O-200, produced by Nippon Kasei Chemical Co., Ltd.) | 1.0 parts |
| Nonionic surfactant (Chemistat 1100, produced by Sanyo Chemical Industries, Ltd.) | 0.7 parts |
| Rosin (KE-311, produced by Arakawa Chemical Industries, Ltd.) | 4.6 parts |
| Pentaerythritol tetraacrylate (NK Ester A-TMMT made by Shin-Nakamura Chemical Co., Ltd.) | 2.5 parts |
| Surfactant (Megafac F-176PF, solid content: 20%, produced by Dai-Nippon Ink & Chemicals Inc.) | 1.3 parts |
| n-Propyl alcohol | 848 parts |
| Methyl ethyl ketone | 246 parts |

The physical properties of the thus formed image-forming layer were as follows.

The thickness of the layer was 0.38 μm.

The surface hardness of the image-forming layer, though it is appropriately 10 g or higher, was at least 200 g in the concrete, as measured with a sapphire stylus.

The Smooster value of the image-forming layer surface was 3.5 mmHg (approximately 0.47 kPa), though preferably 0.5 to 50 mmHg (approximately 0.0665 to 6.65 kPa), under a condition of 23° C.–55% RH.

Although it is preferably 0.2 or below, the static friction coefficient of the surface was 0.08 in the concrete.

The surface energy was 25 mJ/m$^2$, and the contact angle with respect to water was 98.8°.

The deformation rate of the light-to-heat conversion layer was 160% when the recording with laser light having light intensity of 1000 W/mm$^2$ at the exposed surface was carried out at a linear speed of 1 m/sec or higher.

[Preparation of Thermal Transfer Sheet C]

A thermal transfer sheet C was prepared in the same manner as the thermal transfer sheet K, except that the following coating composition for a cyan image-forming layer was used in place of the coating composition for the black image-forming layer. The image-forming layer of the thermal transfer sheet C thus prepared had a thickness of 0.45 μm.

(Composition of Mother Dispersion of Cyan Pigments)

| Cyan Pigment Composition (1) | |
|---|---|
| Polyvinyl butyral (Esleck B BL-SH, produced by Sekisui Chemical Co., Ltd.) | 12.6 parts |
| Pigment Blue 15:4 (C.I. No. 74160) (Cyanine Blue 700-10FG, produced by Toyo Ink Mfg. Co., Ltd.) | 15.0 parts |
| Dispersing aid (PW-36, produced by Kusumoto Chemical Co., Ltd.) | 0.8 parts |
| n-Propyl alcohol | 110 parts |

| Cyan Pigment Composition (2): | |
|---|---|
| Polyvinyl butyral (Esleck B BL-SH, produced by Sekisui Chemical Co., Ltd.) | 12.6 parts |
| Pigment Blue 15 (C.I. No. 74160) (Lionol Blue 7027, produced by Toyo Ink Mfg. Co., Ltd.) | 5.0 parts |
| Dispersing aid (PW-36, produced by Kusumoto Chemical Co., Ltd.) | 0.8 parts |
| n-Propyl alcohol | 110 parts |
| (Coating Composition for Cyan Image-forming Layer) | |
| The foregoing mother dispersion of Cyan pigments (Composition (1)/Composition (2) ratio = 90:10 by parts) | 118 parts |
| Polyvinyl butyral (Esleck B BL-SH, produced by Sekisui Chemical Co., Ltd.) | 5.2 parts |
| Inorganic pigment (MEK-ST) | 1.3 parts |
| Wax compounds | |
| Stearic acid amide (Neutron 2, produced by Nippon Fine Chemical Co., Ltd.) | 2.0 parts |
| Lauric acid amide (Diamid Y, produced by by Nippon Kasei Chemical Co., Ltd.) | 2.0 parts |
| Erucic acid amide (Diamid L-200, produced by Nippon Kasei Chemical Co., Ltd.) | 1.0 parts |
| Oleic acid amide (Diamid O-200, produced by Nippon Kasei Chemical Co., Ltd.) | 1.0 parts |
| Rosin (KE-311, produced by Arakawa Chemical | 2.8 parts |

-continued

| Cyan Pigment Composition (2): | |
|---|---|
| Industries, Ltd.) | |
| Pentaerythritol tetraacrylate (NK Ester A-TMMT, made by Shin-Nakamura Chemical Co., Ltd.) | 1.7 parts |
| Surfactant (Megafac F-176PF, solid content: 20%, produced by Dai-Nippon Ink & Chemicals Inc.) | 1.7 parts |
| n-Propyl alcohol | 890 parts |
| Methyl ethyl ketone | 247 parts |

The physical properties of the thus formed image-forming layer were as follows.

The layer thickness was 0.45 μm.

The surface hardness of the image-forming layer, though it is appropriately 10 g or higher, was at least 200 g in the concrete, as measured with a sapphire stylus.

The Smooster value of the image-forming layer surface was 7.00 mmHg (approximately 0.93 kPa), though preferably 0.5 to 50 mmHg (approximately 0.0665 to 6.65 kPa), under a condition of 23° C.–55% RH.

Although it is preferably 0.2 or below, the static friction coefficient of the surface was 0.08 in the concrete.

The surface energy was 25 mJ/m$^2$, and the contact angle with respect to water was 98.8°.

The deformation rate of the light-to-heat conversion layer was 165% when the recording with laser light having light intensity of 1000 W/mm$^2$ at the exposed surface was carried out at a linear speed of 1 m/sec or higher.

[Preparation of Image-receiving Sheet]

Coating compositions for cushion and image-receiving layers were prepared using the following ingredients.

| (1) Coating Composition for Cushion Layer: | |
|---|---|
| Vinyl chloride-vinyl acetate copolymer (main binder, MPR-TSL, produced by Nisshin Chemical Industry Co., Ltd.) | 20 parts |
| Plasticizer (Paraplex G-40, produced by C P. Hall Company) | 10 parts |
| Surfactant (fluorinated type, coating aid) (Megafac F-177, produced by Dainippon Ink & Chemicals Inc.) | 0.5 parts |
| Antistatic agent (quaternary ammonium salt) (SAT-5 Supper (IC), produced by Nippon Junyaku Co., Ltd.) | 0.3 parts |
| Methyl ethyl ketone | 60 parts |
| Toluene | 10 parts |
| N,N-Dimethylformamide | 3 parts |
| (2) Coating Composition for Image-Receiving Layer: | |
| Polyvinyl butyral (Esleck B BL-SH, produced by Sekisui Chemical Co., Ltd.) | 8 parts |
| Antistatic agent (Sanstat 2012A, produced by Sanyo Chemical Industries, Ltd.) | 0.7 parts |
| Surfactant (Megafac F-177, produced by Dainippon Ink & Chemicals Inc.) | 0.1 parts |
| n-Propyl alcohol | 20 parts |
| Methanol | 20 parts |
| 1-Methoxy-2-propanol | 50 parts |

By use of a small-margin coater, the coating composition for a cushion layer was coated on a 130 μm-thick white PET support (Lumiler #130E58, produced by Toray Industries, Inc.), and then dried. Further, the coating composition for an image-receiving layer was coated on the cushion layer formed, and then dried. Therein, the amounts of the former and latter compositions coated were adjusted so as to have dry thicknesses of about 20 μm and about 2 μm, respectively. The white PET support was a voids-containing plastic support (total thickness: 130 μm, specific gravity: 0.8) made by laminating titanium dioxide-containing polyethylene terephthalate layers (thickness: 7 μm, titanium dioxide content; 2%) on both sides of the voids-containing polyethylene terephthalate layer (thickness; 116 μm, porosity: 20%). The laminate thus made was wound into a roll, stored for 1 week at room temperature, and used for recording of images by laser light.

The thus formed image-receiving layer had physical properties described below.

The surface roughness Ra, though it was appropriately from 0.4 to 0.01 μm, was 0.02 μm in the concrete.

The undulation of the image-receiving layer surface, though it was appropriately 2 μm or below, was 1.2 μm in the concrete.

The Smooster value of the image-receiving layer surface, though it was appropriately 0.5 to 50 mmHg (approximately 0.0665 to 6.65 kPa) under a condition of 23° C.–55% RH, was 0.8 mmHg (approximately 0.11 kPa) in the concrete under the same condition.

The static friction coefficient of the image-receiving layer surface, though it was appropriately 0.8 or below, was 0.37 in the concrete.

The surface energy of the image-receiving layer surface was 29 mJ/m$^2$, and the contact angle with respect to water was 87.0°.

The interlayer adhesion between the image-receiving layer and the cushion layer was 40 mN/cm, as measured by a 180° tape-peeling method.

[Formation of Transfer Images]

The system illustrated in FIG. 4 was adopted herein as an image-forming system. The recording apparatus used in the system was Luxel FINALPROOF 5600. Images were transferred to printing paper in accordance with the image-forming sequence of the present system and the transfer-to-paper method adopted therein.

In the feeding and conveying regions of thermal transfer sheets and those of image-receiving sheets, adhesive rollers made of materials set forth in Table 4 were installed.

The image-receiving sheet prepared above (measuring 56 cm×79 cm in size) was wound around a rotating drum having a diameter of 38 cm and being provided with 1-mm-dia suction holes for vacuum adsorption (in a density of one hole per area of 3 cm×8 cm), and made to adsorb thereto in vacuo. Then, the thermal transfer sheet K (black) cut in a size of 61 cm×84 cm in size was superposed on the image-receiving sheet so as to equally extend off the image-receiving sheet, and brought into a close contact with the image-receiving sheet while squeezing air by means of squeeze rollers and sucking air into the suction holes, thereby preparing a laminate of the image-receiving sheet and the thermal transfer sheet. Therein, the degree of decompression relative to one atmospheric pressure in a state that the suction holes were blocked was −150 mmHg (approximately 81.13 kPa).

Then, the drum was made to rotate and laser image (printing image) recording was performed on the laminate wound around the drum. Therein, semiconductor laser light having a wavelength of 808 nm was gathered on the laminate surface from the outside of the drum so as to form a spot measuring 7 μm in size on the light-to-heat conversion layer surface, and at the same time moved (sub-scanned) in the direction perpendicular to the rotating direction of the rotating drum (main scan direction). The laser irradiation conditions were as follows. The laser light used in this example was two-dimensional array of multiple beams with a parallerogram shape composed of 5 columns along the direction of the main-scan direction and 3 rows along the direction of the sub-scan direction.

| | |
|---|---|
| Laser power | 110 mW |
| Drum's revolution number | 500 rpm |
| Main-scan speed | 4 m/sec |
| Sub-scan pitch | 6.35 μm |

Surrounding temperature
and humidity
three conditions of 20° C.–40%, 23° C.–50% and 26° C.–65%

As the suitable diameter of an exposure drum was at least 360 mm, the drum having a diameter of 380 mm was used in this example.

After the laser recording, the laminate was demounted from the drum, and the thermal transfer sheet K was stripped off from the image-receiving sheet with the hands. As a result, it was confirmed that only the laser-irradiated areas of the image-forming layer were transferred from the thermal transfer sheet K to the image-receiving sheet.

In the same manner as described above, images were transferred from the thermal transfer sheet Y, the thermal transfer sheet M and the thermal transfer sheet C to the image-receiving sheet. The transferred images of four colors were further transferred to recording paper, thereby forming multicolored images. Even in the cases where laser recordings under different surrounding temperature-humidity conditions were carried out using high-energy laser light of multiple-beam two-dimensional array, multicolored images having high qualities and consistent transfer densities were formed.

The transfer to printing paper was carried out using a thermal transfer unit having an insertion board the material of which had a kinetic friction coefficient of 0.1 to 0.7 against the polyethylene terephthalate film and a conveyance speed adjusted to the range of 15 to 50 mm/sec. As the suitable Vickers hardness of a hot roll material was from 10 to 100 in a thermal transfer unit, the hot roll material having a Vickers hardness of 70 was used for the present thermal transfer unit.

The reflection optical densities of images transferred to specialty art paper used as printing paper were measured with a densitometer, X-rite 938 (made by X-rite Co.) in Y, X, C and K modes for Y, M, C and K colors respectively.

The reflection optical density of each color and the ratio of reflection optical density to image-forming layer thickness are shown in Table 3.

TABLE 3

| | Reflection optical density | Reflection optical density/ image-forming layer thickness |
|---|---|---|
| Y color | 1.01 | 2.40 |
| M color | 1.51 | 3.97 |
| C color | 1.59 | 3.03 |
| K color | 1.82 | 3.03 |

Reference Example 1-1

Transferred images were formed in the same manner as in Example 2-1, except that the adhesive rollers made from the material shown in Table 2 were used in place of the adhesive rollers used in Example 2-1.

Reference Example 1-2

Transferred images were formed in the same manner as in Example 2-1, except that the plasticizer used in the cushion layer of the image-receiving sheet was changed from FN-G40 to succinate polyester having a molecular weight equivalent to that of FN-G40.

The interlayer adhesion between the image-receiving layer and the cushion layer was 50 mN/cm, as measured by a 180° tape-peeling method.

TABLE 4

| | Adhesive rollers | | | |
|---|---|---|---|---|
| | Trade name | Main polymer of rubber | Filler | Plasticizer |
| Example 2-1 | CARBOLES MIMOZA-ST | Isobutylene polymer | $SiO_2$ $TiO_2$ $ZnO_2$ | Paraffin |
| Reference Example 1-2 | | | | Hydrocarbon compound having C—O and Si—O groups |
| Reference Example 1-1 | CLEANER GREEN | Isobutylene polymer | $SiO_2$ $BaSO_4$ $ZnO_2$ | Paraffin |

Results obtained in Example 2-1 and Reference Examples 1-1 and 1-2 are shown in Table 5.

As can be seen from Table 5, evaluation results on (1) white dropouts, (2) delamination of image-receiving film at the time of conveyance, (3) conveyance suitability and (4) spontaneous deterioration in adhesion were all good in Example 2-1. On the other hand, evaluation results on (2) delamination of image-receiving film at the time of conveyance, (3) conveyance suitability and (4) spontaneous deterioration in adhesion were all bad in Reference Example 1-1, and an evaluation result on (2) delamination of image-receiving film at the time of conveyance was bad in Reference Example 1-2.

TABLE 5

| | White dropouts | Delamination of image-receiving film at time of conveyance | Conveyance suitability | Spontaneous deterioration in adhesion |
|---|---|---|---|---|
| Example 2-1 | good | good | good | good |
| Reference Example 1-1 | good | bad | bad | bad |
| Reference Example 1-2 | good | bad | good | good |

The images obtained in Example 2-1 were evaluated as follows:

<Evaluation of Black Image Quality>

Black solid areas and line-drawing areas of the transferred images obtained using the thermal transfer sheets of four different colors were observed under an optical microscope. Under any of the surrounding conditions were obtained transferred black images having no slits in the solid areas, good resolution in the line-drawing areas and little dependence on the surrounding condition. The image quality was evaluated by visual observation based on the following criteria.

| | |
|---|---|
| Solid Area | |
| good | Neither slits nor transfer defects are duced at the time of recording. |
| unsatisfactory | Slits and transfer defects are produced places at the time of recording. |
| bad | Slits and transfer defects are produced in overall area at the time of recording. |
| Line-drawing area | |
| good | Line drawings have sharp edges and good solution |
| unsatisfactory | Line drawings have jaggies on their edges and dging is present in places. |
| bad | Bridging is present in all the area. |

(1) Dot Shape

Figure 13:
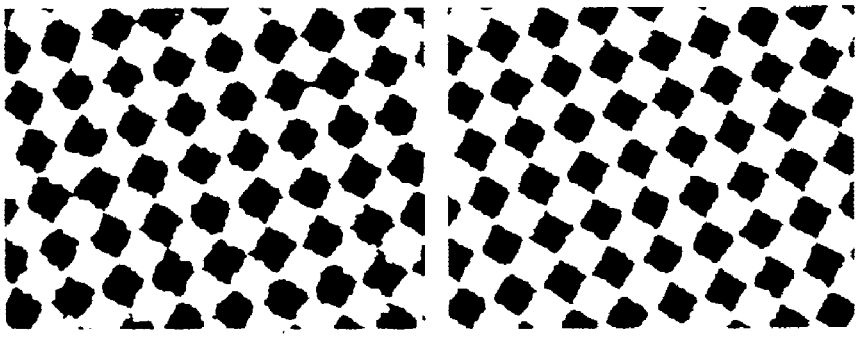
FIG. 13 shows dot shapes of the images obtained in Example 2-1. The distance between adjacent dots' centers is 125 $\mu$m.
Figure 14:
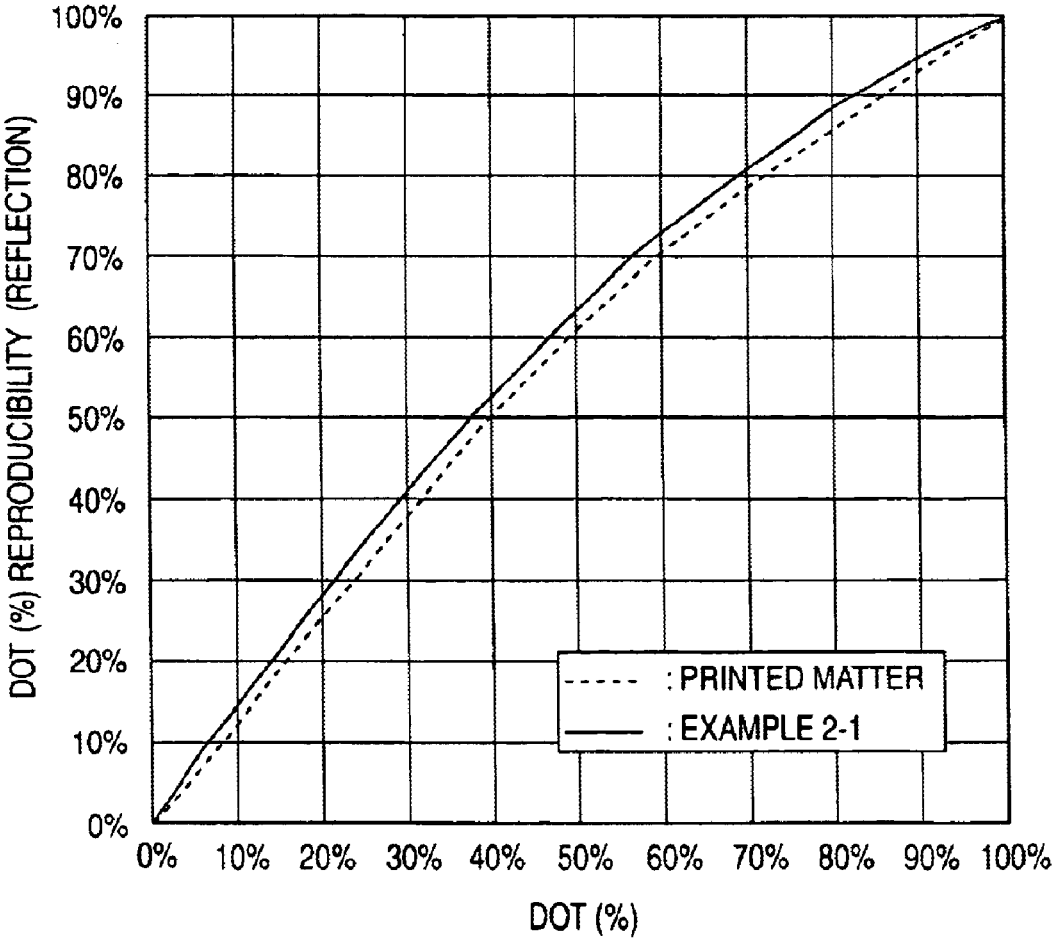
FIG. 14 is a graph showing dot reproducibility of the images obtained in Example 2-1. Therein, the dot area percent calculated from a reflection density is plotted as ordinate and the dot area percent of an input signal as abscissa.

The images obtained in Example 2-1 were halftone dot images formed at resolutions of 2,400 to 2,540 dpi in response to the numbers of printed lines. The individual dots ware almost free of bleeding and chips, and their shapes were very sharp. As shown in FIGS. 5 to 12, dots were formed clearly over a wide range from highlight through shadow. Additionally, FIGS. 5 to 12 demonstrate dot shapes of the images obtained in Example 2-1, and the distance between adjacent dots' centers is 125 μm. As a result, the present system enabled output of dots in high resolution and high definition on the level with those of image setters and CTP setters and, as shown in FIGS. 13 and 14, succeeded in reproduction of dots and gradation highly close to those of prints. More specifically, FIG. 13(*b*) shows dots of one of the images obtained in Example 2-1, wherein the distance of adjacent dots' centers is 125 μm; while FIG. 13(*a*) is a magnified view of dots of the original print. Thereby, it can be confirmed that (a) and (b) resemble each other very strongly in dot shape.

FIG. 14 shows dot reproducibility of the images obtained in Example 2-1. In the graph, the dot area percent calculated from a reflection density is plotted as ordinate and the dot area percent of an input signal as abscissa. The dotted line therein shows a characteristic curve of the print and the solid line shows a characteristic curve of the product obtained in Example 2-1.

Even in the cases of image formation at resolutions of 2,600 dpi or higher, the present product attained good results.

(2) Reproduction Repeatability

Figure 15:
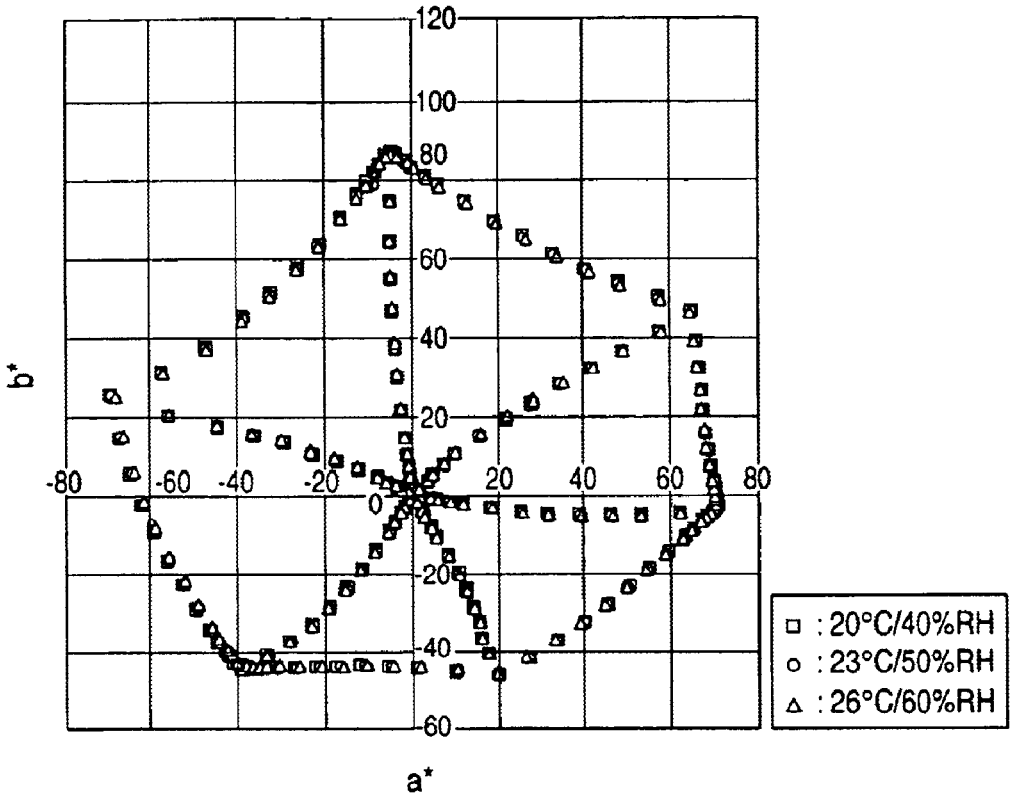
FIG. 15 shows reproduction repeatabilities of the images obtained in Example 2-1, which are plotted on the a*b* plane of L*a*b* color specification system.
Figure 16:
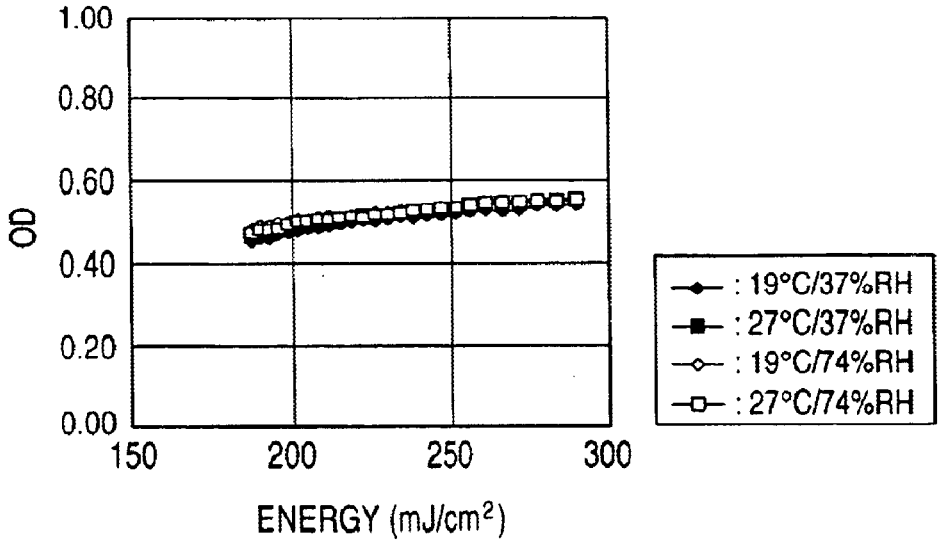
FIG. 16 is a graph showing reproduction repeatabilities of the images obtained in Example 2-1.

As it was sharp in dot shape, the product obtained in Example 2-1 enabled faithful reproduction of dots responsive to laser beams. Further, the recording characteristics thereof had very little dependence on surrounding temperature and humidity. Therefore, as shown in FIGS. 15 and 16, consistent reproduction repeatability was attained with respect to hue and density. Specifically, FIG. 15 shows reproduction repeatabilities of the images obtained in Example 2-1, which are plotted on the a*b* plane of L*a*b* color specification system. And FIG. 16 is a graph showing reproduction repeatabilities of the images obtained in Example 2-1.

Additionally, the numbers on the ordinate of the graph shown in FIG. 16 indicate the optical densities of images transferred to printing papers, which were obtained using the same image-forming materials in the same manner as in Example 2-1, except that the surrounding temperature-humidity condition of the system was changed to 19° C.–37% RH, 27° C.-37% RH, 19° C.–74% RH and 27° C.–74% RH, respectively, and the laser irradiation energy was changed to the 180–290 mJ/cm$^2$ range. As can be seen from this graph, the present system can produce images consistently over a wide range of temperature-humidity conditions even when the energy loads by laser vary to a certain degree.

(3) Color Reproduction

The thermal transfer sheets used in Example 2-1 contained as coloring materials colored pigments for printing ink use and ensured good reproduction repeatability, thereby enabling high-accuracy CMS. The hues of images obtained in Example 2-1 were in close agreement with those of the areas printed in Japan Colors. As to the variations in colors the images assumed between different light sources under which they are seen, e.g., a fluorescent lamp and an incandescent lamp, the images obtained in this example and those in the print were identical with each other.

(4) Quality of Characters

Figure 17:
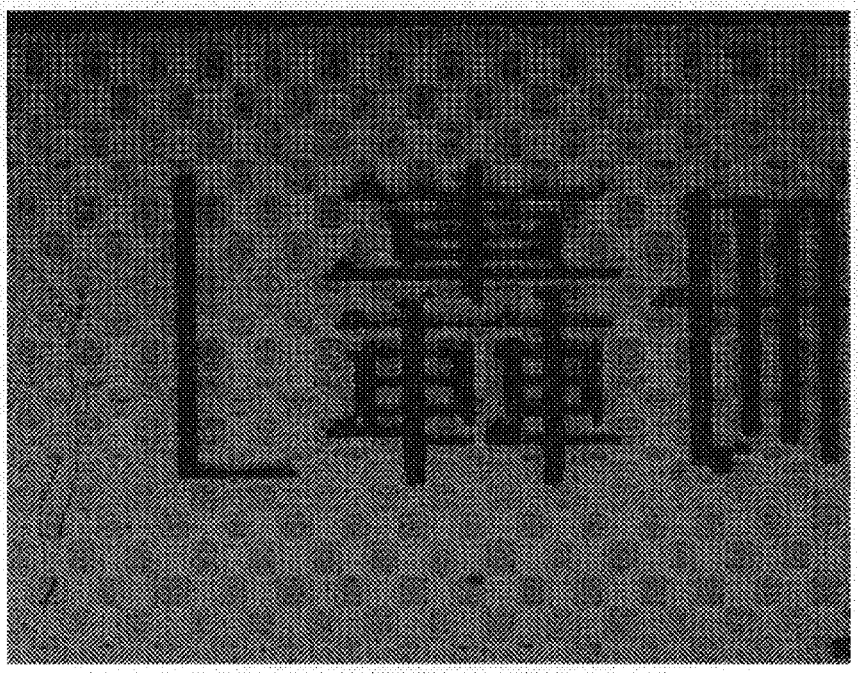
FIG. 17 shows the quality of two-point positive character images obtained in Example 2-1.
Figure 18:
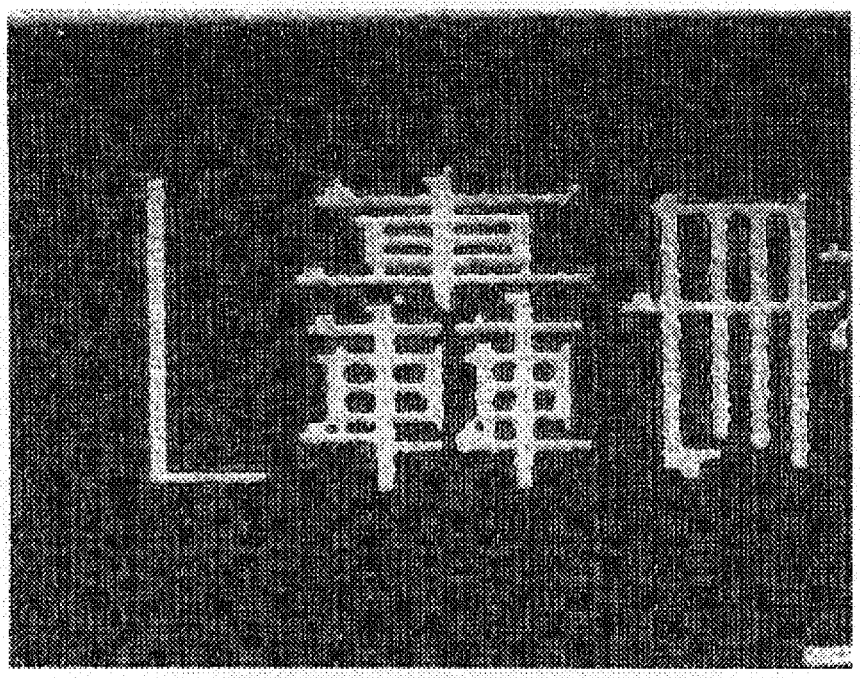
FIG. 18 shows the quality of two-point negative character images obtained in Example 2-1.

As the images obtained in Example 2-1 were sharp in dot shape, fine lines of minute characters were reproduced in good definition as shown in FIGS. 17 and 18. Specifically, FIG. 17 shows the quality of two-point positive character images obtained in Example 2-1, and FIG. 18 shows the quality of two-point negative character images obtained in Example 2-1. As can be seen from these figures, each individual fine line of the minute characters was reproduced in good definition.

EXAMPLE 3-1

Preparation of Thermal Transfer Sheet K (Black)

[Formation of Backing Layer]

(Preparation of Coating Composition for First Backing Layer)

| | |
|---|---|
| Aqueous dispersion of acrylic resin (Jurimer ET410, 20 wt % on solid basis, produced by Nippon Junyaku Co., Ltd.) | 2 parts |
| Antistatic agent (aqueous dispersion of tin oxide-antimony oxide mixture, average grain size: 0.1 μm, 17 wt %) | 7.0 parts |
| Polyoxyethylene phenyl ether | 0.1 parts |
| Melamine compound (Sumitics Resin M-3, produced by Sumitomo Chemical Co., Ltd.) | 0.3 parts |
| Distilled water to make | 100 parts |

One surface (rear surface) of a 75 μm-thick biaxially stretched polyethylene terephthalate film (Ra of both surfaces: 0.01 μm) as a substrate was subjected to corona treatment, coated with the coating composition for a fist backing layer so as to have a dry thickness of 0.03 μm, and then dried for 30 seconds at 180° C. Thus, the first backing layer was formed. The substrate used herein had Young's modulus of 450 kg/mm$^2$ (approximately 4.4 GPa) in the length direction and 500 kg/mm$^2$ (approximately 4.9 GPa) in the width direction. The F-5 value of the substrate in the length direction was 10 kg/mm$^2$ (approximately 98 MPa), while that in the width direction was 13 kg/mm$^2$ (approximately 127.4 MPa). The thermal shrinkage ratios of the substrate in the length and width directions under heating at 100° C. for 30 minutes were 0.3% and 0.1%, respectively. The tensile strength of the substrate at break was 20 kg/mm$^2$ (approximately 196 MPa) in the length direction, while that in the wide direction was 25 kg/mm$^2$ (approximately 245 MPa). The elasticity modulus of the substrate was 400 kg/mm$^2$ (approximately 3.9 GPa).

(Preparation of Coating Composition for Second Backing Layer)

| | |
|---|---|
| Polyolefin (Chemipearl S-120, 27 wt %, produced by Mitsui Petrochemical Industries, Ltd.) | 3.0 parts |
| Antistatic agent (aqueous dispersion of tin oxide-antimony oxide mixture, average grain size: 0.1 μm, 17 wt %) | 2.0 parts |
| Colloidal silica (Snowtex C, 20 wt %, produced by Nissan Chemical Industries, Ltd.) | 2.0 parts |
| Epoxy compound | 0.3 parts |

-continued

| | |
|---|---|
| (Dinakole Ex-614B, Nagase Kasei Co., Ltd.) | |
| Distilled water to make | 100 parts |

On the first backing layer, the coating composition for a second backing layer was coated so as to have a dry thickness of 0.03 μm, and then dried for 30 seconds at 170° C. Thus, the second backing layer was formed.

[Formation of Light-to-Heat Conversion Layer]

(Preparation of Coating Composition for Light-to-Heat Conversion Layer)

The following ingredients were stirred with a stirrer into a mixture, thereby preparing a coating composition for a light-to-heat conversion layer.

Coating Composition for Light-to-Heat Conversion Layer:

Infrared absorbing dye 7.6 parts (NK-2014, cyanine dye of the following structural formula, a product of Nippon Kanko Shikiso Co., Ltd.)

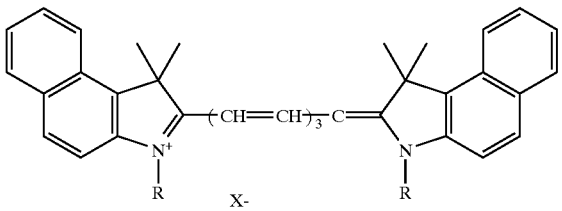

(wherein R is $CH_3$, and $X^-$ is $CLO_4^-$)

Polyimide resin of the following formula 29.3 parts (Rika Coat SN-20F; a product of New Japan Chemical Co., Ltd.; thermal decomposition temperature: 510° C.)

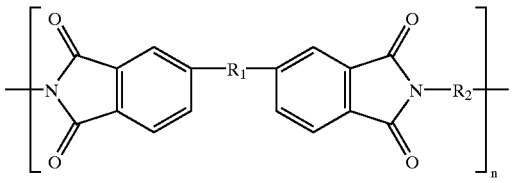

(wherein $R_1$ is $SO_2$, and $R_2$ represents

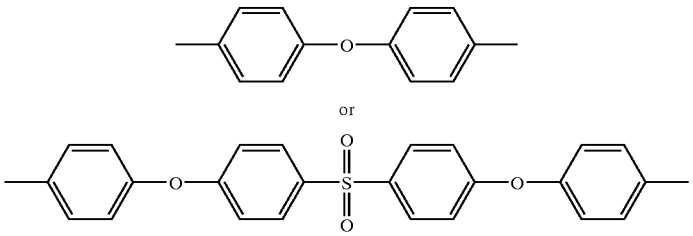

| | |
|---|---|
| Exxon Naphtha | 5.8 parts |
| N-Methyl-2-Pyrrolidone (NMP) | 1500 parts |
| Methyl ethyl ketone | 360 parts |
| Surfactant of fluorinated type (Megafac F-176PF, produced by Dai-Nippon Ink & Chemicals Inc.) | 0.5 parts |
| Matting agent dispersion of the composition described below | 14.1 parts |

Preparation of Matting Agent Dispersion:

A mixture of 10 parts of genuinely spherical particulate silica having an average particle size of 1.5 μm (Seehoster KE-P150, produced by Nippon Shokubai Co., Ltd.), 2 parts of a dispersant polymer (acrylate-styrene copolymer, Juncryl 611, produced by Johnson Polymer Inc.), 16 parts of methyl ethyl ketone and 64 parts of N-methyl pyrrolidone was placed in a 200 ml of polyethylene vessel together with 30 parts of glass beads measuring 2 mm in diameter, and dispersed for 2 hours by means of a paint shaker (made by Toyo Seiki). Thus, a dispersion of particulate silica was prepared.

(Formation of Light-to-Heat Conversion Layer on Substrate Surface)

On the other surface of the 75 μm-thick polyethylene terephthalate film (substrate), the coating composition described above was coated with a wire bar, and then dried for 2 minutes in a 120° C. oven to form a light-to-heat converting layer on the substrate. The optical density at a wavelength of 808 nm, $OD_{LH}$, was 1.03 as measured with a UV-Spectrophotometer UV-240 made by Shimadzu Corp. The cross-section of the light-to-heat conversion layer was observed under a scanning electron microscope, and thereby the thickness of the layer was found to be 0.3 μM on the average.

Additionally, the optical density ($OD_{LH}$) of the light-to-heat conversion layer constituting the present thermal transfer sheet refers to the absorbance of the light-to-heat conversion layer at the peak wavelength of laser light used for recording on the present image-forming material, and can be measured with a known spectrophotometer. In the invention, as described above, a UV-Spectrophotometer UV-240 made by Shimadzu Corp. was used. And the optical density ($OD_{LH}$) defined above was a value obtained by subtracting the substrate-alone optical density from the substrate-inclusive optical density.

[Formation of Image-Forming Layer]

(Preparation of Coating Composition for Forming Black Image-forming Layer)

The following ingredients were placed in the mill of a kneader, and subjected to pretreatment for dispersion while adding a small amount of solvent and imposing shearing stress thereon. To the dispersion obtained, the solvent was further added so that the following composition was prepared finally, and subjected to 2-hour dispersion with a sand mill. Thus, a mother dispersion of pigments was obtained.

(Composition of Mother Dispersion of Black Pigments)

| Composition (1): | |
|---|---|
| Polyvinyl butyral (Esleck B BL-SH, produced by Sekisui Chemical Co., Ltd.) | 12.6 parts |
| Pigment Black 7 (Carbon black C.I. No. 77266) (Mitsubishi Carbon Black #5 produced by Mitsubishi Chemical Corporation, PVC blackness: 1) | 4.5 parts |
| Dispersing aid (Solsperse S-20000, produced by ICI Co., Ltd.) | 0.8 parts |
| n-Propyl alcohol | 79.4 parts |

| Composition (2): | |
|---|---|
| Polyvinyl butyral (Esleck B BL-SH, produced by Sekisui Chemical Co., Ltd.) | 12.6 parts |
| Pigment Black 7 (Carbon black C.I. No. 77266) (Mitsubishi Carbon Black MA100, produced by Mitsubishi Chemical Corporation, PVC blackness: 10) | 10.5 parts |
| Dispersing aid (Solsperse S-20000, produced by ICI Co., Ltd.) | 0.8 parts |
| n-Propyl alcohol | 79.4 parts |

Then, the following ingredients were mixed with stirring by means of a stirrer to prepare a coating composition for a black image-forming layer.

(Coating Composition for Black Image-forming Layer)

| | |
|---|---|
| The foregoing mother dispersion of black pigments (Composition (1)/Composition (2) ratio = 70:30 by parts) | 185.7 parts |
| Polyvinyl butyral (Esleck B BL-SH, produced by Sekisui Chemical Co., Ltd.) | 11.9 parts |
| Wax compounds | |
| Stearic acid amide (Neutron 2, produced by Nippon Fine Chemical Co., Ltd.) | 3.4 parts |
| Lauric acid amide (Diamid Y, produced by Nippon Kasei Chemical Co., Ltd.) | 1.7 parts |
| Palmitic acid amide (Diamid KP, produced by Nippon Kasei Chemical Co., Ltd.) | 3.4 parts |
| Oleic acid amide (Diamid O-200, produced by Nippon Kasei Chemical Co., Ltd.) | 1.7 parts |
| Rosin (KE-311, produced by Arakawa Chemical Industries, Ltd., containing 80–97% of resin acids constituted of 30–40% of abietic acid, 10–20% of neoabietic acid, 14% of dihydroabietic acid and 14% of tetrahydro-abietic acid) | 11.4 parts |
| Surfactant (Megafac F-176PF, solid content: 20%, produced by Dai-Nippon Ink & Chemicals Inc.) | 2.1 parts |

-continued

| Composition (2): | |
|---|---|
| Inorganic pigment (MEK-ST, 30% methyl ethyl ketone solution, produced by Nissan Chemical Industries, Ltd.) | 7.1 parts |
| n-Propyl alcohol | 1050 parts |
| Methyl ethyl ketone | 295 parts |

Particles in the thus prepared coating composition for a black image forming layer were examined with a laser-scatter particle size analyzer, and thereby it was found that the average particle size was 0.25 μm and the proportion of particles having sizes of 1 μm or greater was 0.5%.

(Formation of Black Image-Forming Layer on Light-to-Heat Conversion Layer)

On the light-to-heat conversion layer surface, the foregoing coating composition for black image-forming layer was coated over 1 minute by means of a wire bar, and then dried for 2 minutes in a 100° C. oven, thereby forming a black image forming layer on the light-to-heat conversion layer. In accordance with the process mentioned above, the light-to-heat conversion layer and the black image-forming layer were provided on the substrate in order of mention, thereby preparing a thermal transfer sheet (Hereinafter, this sheet was referred to as "thermal transfer sheet K". Similarly thereto, the transfer sheet provided with a yellow image-forming layer was referred to as "thermal transfer sheet Y", the transfer sheet provided with a magenta image-forming layer was referred to as "thermal transfer sheet M", and the transfer sheet provided with a cyan image-forming layer was referred to as "thermal transfer sheet C").

The optical density (OD) of the black image-forming layer constituting the thermal transfer sheet K was measured with a Macbeth densitometer TD-904 (W filter), and thereby OD was found to be 0.91. And the thickness of the black image-forming layer was found to be 0.60 μm on the average.

The physical properties of the thus formed image-forming layer were as follows.

The surface roughness Rz of the image-forming layer was 0.70 μm.

The surface hardness of the image-forming layer, though it is appropriately 10 g or higher, was at least 200 g in the concrete, as measured with a sapphire stylus.

The Smooster value of the image-forming layer surface was 9.3 mmHg (approximately 1.24 kPa), though preferably 0.5 to, 50 mmHg (approximately 0.0665 to 6.65 kPa), under a condition of 23° C.–55% RH.

Although it is preferably 0.2 or below, the static friction coefficient of the surface was 0.08 in the concrete.

The surface energy was 29 $mJ/m^2$, and the contact angle with respect to water was 94.8°.

The deformation rate of the light-to-heat conversion layer was 168% when the recording with laser light having light intensity of 1000 $W/mm^2$ at the exposed surface was carried out at a linear speed of 1 m/sec or higher.

[Preparation of Thermal Transfer Sheet Y]

A thermal transfer sheet Y was prepared in the same manner as the thermal transfer sheet K, except that the following coating composition for a yellow image-forming layer was used in place of the coating composition for the black image-forming layer. The image-forming layer of the thermal transfer sheet Y thus prepared had a thickness of 0.42 μm.

(Composition of Mother Dispersion of Yellow Pigments)

| Yellow Pigment Composition (1): | |
|---|---|
| Polyvinyl butyral (Esleck B BL-SH, produced by Sekisui Chemical Co., Ltd.) | 7.1 parts |
| Pigment Yellow 180 (C.I. No. 21290) (Novoperm Yellow P-HG, produced by Clariant Japan Co., Ltd.) | 12.9 parts |
| Dispersing aid (Solsperse S-20000, produced by ICI Co., Ltd.) | 0.6 parts |
| n-Propyl alcohol | 79.4 parts |

| Yellow Pigment Composition (2): | |
|---|---|
| Polyvinyl butyral (Esleck B BL-SH, produced by Sekisui Chemical Co., Ltd.) | 7.1 parts |
| Pigment Yellow 139 (C.I. No. 56298) (Novoperm Yellow M2R 70, produced by Clariant Japan Co., Ltd.) | 12.9 parts |
| Dispersing aid (Solsperse S-20000, produced by ICI Co., Ltd.) | 0.6 parts |
| n-Propyl alcohol | 79.4 parts |
| (Coating Composition for Yellow Image-forming Layer) | |
| The foregoing mother dispersion of yellow pigments (Composition (1)/Composition (2) ratio = 95:5 by parts) | 126 parts |
| Polyvinyl butyral (Esleck B BL-SH, produced by Sekisui Chemical Co., Ltd.) | 4.6 parts |
| Wax compounds | |
| Stearic acid amide (Neutron 2, produced by Nippon Fine Chemical Co., Ltd.) | 0.7 parts |
| Behenic acid amide (Diamid BM, produced by Nippon Kasei Chemical Co., Ltd.) | 0.7 parts |
| Lauric acid amide (Diamid Y, produced by Nippon Kasei Chemical Co., Ltd.) | 0.7 parts |
| Palmitic acid amide (Diamid KP, produced by Nippon Kasei Chemical Co., Ltd.) | 0.7 parts |
| Erucic acid amide (Diamid L-200, produced by Nippon Kasei Chemical Co., Ltd.) | 0.7 parts |
| Oleic acid amide (Diamid O-200, produced by Nippon Kasei Chemical Co., Ltd.) | 0.7 parts |
| Nonionic surfactant (Chemistat 1100, produced by Sanyo Chemical Industries, Ltd.) | 0.4 parts |
| Rosin (KE-311, produced by Arakawa Chemical Industries, Ltd.) | 2.4 parts |
| Surfactant (Megafac F-176PF, solid content: 20%, produced by Dai-Nippon Ink & Chemicals Inc.) | 0.8 parts |
| n-Propyl alcohol | 793 parts |
| Methyl ethyl ketone | 198 parts |

The physical properties of the thus formed image-forming layer were as follows.

The surface roughness Rz of the image-forming layer thus prepared was 0.78 $\mu$m.

The reflection optical density was 1.01.

The surface hardness of the image-forming layer, though it is appropriately 10 g or higher, was at least 200 g in the concrete, as measured with a sapphire stylus.

The Smooster value of the image-forming layer surface was 2.3 mmHg (approximately 0.31 kPa), though preferably 0.5 to 50 mmHg (approximately 0.0665 to 6.65 kPa), under a condition of 23° C.–55% RH.

Although it is preferably 0.2 or below, the static friction coefficient or the surface was 0.1 in the concrete.

The surface energy was 24 mJ/m$^2$, and the contact angle with respect to water was 108.1°.

The deformation rate of the light-to-heat conversion layer was 150% when the recording with laser light having light intensity of 1000 W/mm$^2$ at the exposed surface was carried out at a linear speed of 1 m/sec or higher.

[(Preparation of Thermal Transfer Sheet M]

A thermal transfer sheet was prepared in the same manner as the thermal transfer sheet K, except that the following coating composition for a magenta image-forming layer was used in place of the coating composition for the black image-forming layer. The image-forming layer of the thermal transfer sheet M thus prepared had a thickness of 0.38 $\mu$m.

(Composition of Mother Dispersion of Magenta Pigments)

| Magenta Pigment Composition (1): | |
|---|---|
| Polyvinyl butyral (Denka Butyral #2000-L, produced by Electro Chemical Industry Co., Ltd.; Vicat softening point: 57° C.) | 12.6 parts |
| Pigment Red 57:1 (C.I. No. 15850:1) (Symuler Brilliant Carmine 6B-229, produced by Dainippon Ink and Chemicals, Inc.) | 15.0 parts |
| Dispersing aid (Solsperse S-20000, produced by ICI Co., Ltd.) | 0.6 parts |
| n-Propyl alcohol | 80.4 parts |

| Magenta Pigment Composition (2): | |
|---|---|
| Polyvinyl butyral (Denka Butyral #2000-L, produced by Electro Chemical Industry Co., Ltd.; Vicat softening point: 57° C.) | 12.6 parts |
| Pigment Red 57:1 (C.I. No. 15850:1) (Lionol Red 6B-4290G, produced by Toyo Ink Mfg. Co., Ltd.) | 15.0 parts |
| Dispersing aid (Solsperse S-20000, produced by ICI Co., Ltd.) | 0.6 parts |
| n-Propyl alcohol | 79.4 parts |
| (Coating Composition for Magenta Image-forming Layer) | |
| The foregoing mother dispersion of Magenta pigments (Composition (1)/Composition (2) ratio = 95:5 by parts) | 163 parts |
| Polyvinyl butyral (Denka Butyral #2000-L, produced by Electro Chemical Industry Co., Ltd.; Vicat softening point: 57° C.) | 4.0 parts |
| Wax compounds | |
| Stearic acid amide (Neutron 2, produced by Nippon Fine Chemical Co., Ltd.) | 2.0 parts |
| Lauric acid amide (Diamid Y, produced by by Nippon Kasei Chemical Co., Ltd.) | 1.0 parts |
| Palmitic acid amide (Diamid KP, produced by Nippon Kasei Chemical Co., Ltd.) | 2.0 parts |
| Oleic acid amide (Diamid O-200, produced by Nippon Kasei Chemical Co., Ltd.) | 1.0 parts |
| Nonionic surfactant (Chemistat 1100, produced by Sanyo Chemical Industries, Ltd.) | 0.7 parts |
| Rosin (KE-311, produced by Arakawa Chemical Industries, Ltd.) | 4.6 parts |
| Pentaerythritol tetraacrylate (NK Ester A-TMMT made by Shin-Nakamura Chemical Co., Ltd.) | 2.5 parts |
| Surfactant (Megafac F-176PF, solid content: 20%, produced by Dai-Nippon Ink & Chemicals Inc.) | 1.3 parts |
| n-Propyl alcohol | 848 parts |
| Methyl ethyl ketone | 246 parts |

The physical properties of the thus formed image-forming layer were as follows.

The thickness of the layer was 0.38 μm.

The surface roughness Rz of the image-forming layer was 0.90 μm.

The surface hardness of the image-forming layer, though it is appropriately 10 g or higher, was at least 200 g in the concrete, as measured with a sapphire stylus.

The Smooster value of the image-forming layer surface was 3.5 mmHg (approximately 0.47 kPa), though preferably 0.5 to 50 mmHg (approximately 0.0665 to 6.65 kPa), under a condition of 23° C.–55% RH.

Although it is preferably 0.2 or below, the static friction coefficient of the surface was 0.08 in the concrete.

The surface energy was 25 mJ/m$^2$, and the contact angle with respect to water was 98.8°.

The deformation rate of the light-to-heat conversion layer was 160% when the recording with laser light having light intensity of 1000 W/mm$^2$ at the exposed surface was carried out at a linear speed of 1 m/sec or higher.

[Preparation of Thermal Transfer Sheet C]

A thermal transfer sheet C was prepared in the same manner as the thermal transfer sheet K, except that the following coating composition for a cyan image-forming layer was used in place of the coating composition for the black image-forming layer. The image-forming layer of the thermal transfer sheet C thus prepared had a thickness of 0.45 μm.

(Composition of Mother Dispersion of Cyan Pigments)

| Cyan Pigment Composition (1) | |
|---|---|
| Polyvinyl butyral (Esleck B BL-SH, produced by Sekisui Chemical Co., Ltd.) | 12.6 parts |
| Pigment Blue 15:4 (C.I. No. 74160) (Cyanine Blue 700-10FG, produced by Toyo Ink Mfg. Co., Ltd.) | 15.0 parts |
| Dispersing aid (PW-36, produced by Kusumoto Chemical Co., Ltd.) | 0.8 parts |
| n-Propyl alcohol | 110 parts |

| Cyan Pigment Composition (2): | |
|---|---|
| Polyvinyl butyral (Esleck B BL-SH, produced by Sekisui Chemical Co., Ltd.) | 12.6 parts |
| Pigment Blue 15 (C.I. No. 74160) (Lionol Blue 7027, produced by Toyo Ink Mfg. Co., Ltd.) | 15.0 parts |
| Dispersing aid (PW-36, produced by Kusumoto Chemical Co., Ltd.) | 0.8 parts |
| n-Propyl alcohol | 110 parts |
| (Coating Composition for Cyan Image-forming Layer) | |
| The foregoing mother dispersion of Cyan pigments (Composition (1)/Composition (2) ratio = 90:10 by parts) | 118 parts |
| Polyvinyl butyral (Esleck B BL-SH, produced by Sekisui Chemical Co., Ltd.) | 5.2 parts |
| Inorganic pigment (MEK-ST) | 1.3 parts |
| Wax compounds | |
| Behenic acid amide (Diamid BM, produced by Nippon Fine Chemical Co., Ltd.) | 2.0 parts |
| Lauric acid amide (Diamid Y, produced by by Nippon Kasei Chemical Co., Ltd.) | 1.0 parts |
| Erucic acid amide (Diamid L-200, produced | 2.0 parts |

-continued

| Cyan Pigment Composition (2): | |
|---|---|
| by Nippon Kasei Chemical Co., Ltd.) | |
| Oleic acid amide (Diamid O-200, produced by Nippon Kasei Chemical Co., Ltd.) | 1.0 parts |
| Rosin (KE-311, produced by Arakawa Chemical Industries, Ltd.) | 2.8 parts |
| Pentaerythritol tetraacrylate (NK Ester A-TMMT, made by Shin-Nakamura Chemical Co., Ltd.) | 1.7 parts |
| Surfactant (Megafac F-176PF, solid content: 20%, produced by Dai-Nippon Ink & Chemicals Inc.) | 1.7 parts |
| n-Propyl alcohol | 890 parts |
| Methyl ethyl ketone | 247 parts |

The physical properties of the thus formed image-forming layer were as follows.

The layer thickness was 0.45 μm.

The surface roughness Rz of the image-forming layer was 0.81 μm.

The surface hardness of the image-forming layer, though it is appropriately 10 g or higher, was at least 200 g in the concrete, as measured with a sapphire stylus.

The Smooster value of the image-forming layer surface was 7.0 mmHg (approximately 0.93 kPa), though preferably 0.5 to 50 mmHg (approximately 0.0665 to 6.65 kPa), under a condition of 23° C.–55% RH.

Although it is preferably 0.2 or below, the static friction coefficient of the surface was 0.08 in the concrete.

The surface energy was 25 mJ/m$^2$, and the contact angle with respect to water was 98.8°.

The deformation rate of the light-to-heat conversion layer was 165% when the recording with laser light having light intensity of 1000 W/mm$^2$ at the exposed surface was carried out at a linear speed of 1 m/sec or higher.

[Preparation of Image-receiving Sheet]

Coating compositions for cushion and image-receiving layers were prepared using the following ingredients.

| (1) Coating Composition for Cushion Layer: | |
|---|---|
| Vinyl chloride-vinyl acetate copolymer (main binder, MPR-TSL, produced by Nisshin Chemical Industry Co., Ltd.) | 20 parts |
| Plasticizer (Paraplex G-40, produced by C P. Hall Company) | 10 parts |
| Surfactant (fluorinated type, coating aid) (Megafac F-177, produced by Dainippon Ink & Chemicals Inc.) | 0.5 parts |
| Antistatic agent (quaternary ammonium salt) (SAT-5 Supper (IC), produced by Nippon Junyaku Co., Ltd.) | 0.3 parts |
| Methyl ethyl ketone | 60 parts |
| Toluene | 10 parts |
| N,N-Dimethylformamide | 3 parts |

| (2) Coating Composition for Image-Receiving Layer: | |
|---|---|
| Polyvinyl butyral (Esleck B BL-SH, produced by Sekisui Chemical Co., Ltd.) | 8 parts |
| Antistatic agent (Sanstat 2012A, produced by Sanyo Chemical Industries, Ltd.) | 0.7 parts |
| Surfactant | 0.1 parts |

-continued

| (2) Coating Composition for Image-Receiving Layer: | |
|---|---|
| (Megafac F-177, produced by Dainippon Ink & Chemicals Inc.) | |
| n-Propyl alcohol | 20 parts |
| Methanol | 20 parts |
| 1-Methoxy-2-propanol | 50 parts |

By use of a small-margin coater, the coating composition for a cushion layer was coated on a 130 μm-thick white PET support (Lumiler #130E58, produced by Toray Industries, Inc.), and then dried. Further, the coating composition for an image-receiving layer was coated on the cushion layer formed, and then dried. Therein, the amounts of the former and latter compositions coated were adjusted so as to have dry thicknesses of about 20 μm and about 2 μm, respectively. The white PET support was a voids-containing plastic support (total thickness: 130 μm, specific gravity: 0.8) made by laminating titanium dioxide-containing polyethylene terephthalate layers (thickness: 7 μm titanium dioxide content: 2%) on both sides of the voids-containing polyethylene terephthalate layer (thickness: 116 μm porosity: 20%). The laminate thus made was wound into a roll, stored for 1 week at room temperature, and used for recording of images by laser light.

The thus formed image-receiving layer had physical properties described below.

The surface roughness Rz of the image-receiving layer was 0.6 μm.

The Smooster value of the image-receiving layer surface, though it was appropriately 0.5 to 50 mmHg (approximately 0.0665 to 6.65 kPa) under a condition of 23° C.–55% RH, was 0.8 mmHg (approximately 0.11 kPa) in the concrete under the same condition.

The static friction coefficient of the image-receiving layer surface, though it was appropriately 0.8 or below, was 0.37 in the concrete.

The surface energy of the image-receiving layer surface was 29 mJ/m$^2$, and the contact angle with respect to water was 85.0°.

[Formation of Transfer Images]

The system illustrated in FIG. 4 was adopted herein as an image-forming system. The recording apparatus used in the system was Luxel FINALPROOF 5600. Images were transferred to printing paper in accordance with the image-forming sequence of the present system and the transfer-to-paper method adopted therein.

In the feeding and conveying regions of thermal transfer sheets and those of image-receiving sheets, adhesive rollers made of materials set forth in Table 4 were installed.

The image-receiving sheet prepared above (measuring 56 cm×79 cm in size) was wound around a rotating drum having a diameter of 38 cm and being provided with 1-mm-dia suction holes for vacuum adsorption (in a density of one hole per area of 3 cm×8 cm), and made to adsorb thereto in vacuo. Then, the thermal transfer sheet K (black) cut in a size of 61 cm×84 cm in size was superposed on the image-receiving sheet so as to equally extend off the image-receiving sheet, and brought into a close contact with the image-receiving sheet while squeezing air by means of squeeze rollers and sucking air into the suction holes, thereby preparing a laminate of the image-receiving sheet and the thermal transfer sheet. Therein, the degree of decompression relative to 1 atmospheric pressure in a state that the suction holes were blocked was −150 mmHg (approximately 81.13 kPa).

Then, the drum was made to rotate and laser image (printing image) recording was performed on the laminate wound around the drum. Therein, semiconductor laser light having a wavelength of 808 nm was gathered on the laminate surface from the outside of the drum so as to form a spot measuring 7 μm in size on the light-to-heat conversion layer surface, and at the same time moved (sub-scanned) in the direction perpendicular to the rotating direction of the rotating drum (main scan direction). The laser irradiation conditions were as follows. The laser light used in this example was two-dimensional array of multiple beams with a parallerogram shape composed of 5 columns along the direction of the main-scan direction and 3 rows along the direction of the sub-scan direction.

| | |
|---|---|
| Laser power | 110 mW |
| Drum's revolution number | 500 rpm |
| Main-scan speed | 4 m/sec |
| Sub-scan pitch | 6.35 μm |
| Surrounding temperature and humidity | three conditions of 20° C.-40%, 23° C.-50% and 26° C.-65% |

As the suitable diameter of an exposure drum was at least 360 mm, the drum having a diameter of 380 mm was used in this example.

Additionally, the image size was 515 mm×728 mm, and the resolution was 2,600 dpi.

After the laser recording, the laminate was demounted from the drum, and the thermal transfer sheet K was stripped off from the image-receiving sheet with the hands. As a result, it was confirmed that only the laser-irradiated areas of the image-forming layer were transferred from the thermal transfer sheet K to the image-receiving sheet.

In the same manner as described above, images were transferred from the thermal transfer sheet Y, the thermal transfer sheet M and the thermal transfer sheet C to the image-receiving sheet. The transferred images of four colors were further transferred to recording paper, thereby forming multicolored images. Even in the cases where laser recordings under different surrounding temperature-humidity conditions were carried out using high-energy laser light of multiple-beam two-dimensional array, multicolored images having high qualities and consistent transfer densities were formed.

The transfer to printing paper was carried out using a thermal transfer unit having an insertion board the material of which had a kinetic friction coefficient of 0.1 to 0.7 against the polyethylene terephthalate film and a conveyance speed adjusted to the range of 15 to 50 mm/sec. As the suitable Vickers hardness of a hot roll material was from 10 to 100 in a thermal transfer unit, the hot roll material having a Vickers hardness of 70 was used for the present thermal transfer unit.

The images obtained under three different surrounding temperature-humidity conditions were all good in quality.

The reflection optical densities of images transferred to specialty art paper used as printing paper were measured with a densitometer, X-rite 938 (made by X-rite Co.) in Y, M, C and K modes for Y, M, C and K colors respectively.

The reflection optical density of each color and the ratio of reflection optical density to image-forming layer thickness (μm) are shown in Table 6.

TABLE 6

| | Reflection optical density | Reflection optical density/ image-forming layer thickness |
|---|---|---|
| Y color | 1.01 | 2.40 |
| M color | 1.51 | 3.97 |
| C color | 1.59 | 3.03 |
| K color | 1.82 | 3.03 |

Reference Examples are explained below.

In Reference Example 2-1, transferred images were formed in the same manner as in Example 3-1, except that the pressure for suction was changed to 30 mmHg.

In Reference Example 2-2, on the other hand, transferred images were formed in the same manner as in Example 3-1, except that the pressure for suction was changed to 600 mmHg.

In Reference Example 2-3, transferred images were formed in the same manner as in Example 3-1, except that the particulate silica, Seehoster KE-P150, was removed from the matting agent dispersion used in each of the thermal transfer sheets of different colors.

As to the surface roughness, the Rz values of the black, yellow, magenta and cyan image-forming layers were 0.16 μm, 0.17 μm, 0.15 μm and 0.13 μm, respectively.

The results of Example and Reference Examples are shown in Table 7.

TABLE 7

| | Air trapping between Image-receiving sheet and thermal transfer sheet | Imprint of suction holes on transferred images |
|---|---|---|
| Example 3-1 | invisible | invisible |
| Reference Example 2-1 | visible | invisible |
| Reference Example 2-2 | invisible | visible |
| Reference Example 2-3 | visible | invisible |

In Example 3-1, as shown in Table 7, no air trapping between the image-receiving sheet and each of the thermal transfer sheets was visible to the naked eye, and no imprints of suction holes on transferred images were visually recognized.

On the other hand, in Reference Examples 2-1 and 2-3, air trapping between the image-receiving sheet and each of the thermal transfer sheets was visible to the naked eye, and the imprints of suction holes on the transferred images were visually recognized in Reference Example 2-2. Namely, every reference example was inferior in examination results to Example 3-1.

When the other performances (Dot shape, Repeating reproducibility, Reproduction of color and Quality of letter) in Example 3-1 were evaluated, the results was excellent the same as in Example 2-1.

The proof products developed by the invention have solved new problems of a laser thermal transfer system on the basis of thin-film transfer techniques, and have realized sharp dots for enhancing image quality by interlarding the thin-film thermal transfer system with various techniques. Specifically, the invention has developed a laser thermal-transfer recording system for DDCP comprised of transfer to printing paper, output of real dots, use of pigments, B2-size image-forming materials, image-receiving sheets enabling continuous stacking of many sheets, an output device and high-grade CMS software. In this way, the invention has formulated a system structure making full use of capabilities of high-resolution materials. More specifically, the invention provides contract proofs capable of taking the place of galley proofs and analog-mode color proofs in response to CTP-age filmless platemaking. The present proofs can achieve color reproduction matching with prints for customer approval and analog-mode color proofs. The invention uses coloring materials of pigment type, enables transfer to printing paper, and can provide a moire-free digital direct color proof system (DDCP) system. Further, the invention enables transfer to printing paper and uses coloring materials of pigment type, and can provide a DDCP system of forming large-size (A2/B2-size or larger) proofs highly resemble to prints. In the invention, the laser thin-film thermal transfer method is adopted, pigment-type coloring materials are used, real-dot recording is carried out, and the transfer to printing paper is performed. Furthermore, the invention can provide a multicolor image forming method which enables formation of images of high quality and consistent transfer densities on image-receiving sheets even when high-energy laser recording is carried out using multi-beam two-dimensional array of laser light under different temperature-humidity conditions.

The entire disclosure of each and every foreign patent application from which the benefit of foreign priority has been claimed in the present application is incorporated herein by reference, as if fully set forth.

What is claimed is:

1. A laser thermal transfer recording method, which comprises:

dispensing a thermal transfer sheet and an image-receiving sheet from a roll of each sheet to an exposure recording device, in which the thermal transfer sheet includes an image-forming layer, and the image-receiving sheet includes an image-receiving layer, and the image-receiving layer surface of the image-receiving sheet in the roll is disposed outward;

cutting each of the sheets into pieces of a predetermined length;

superposing each of the cut pieces of the image-receiving sheet on each of the cut pieces of the thermal transfer sheet, so that the image-receiving layer of the image-receiving sheet is opposed to the image-forming layer of the thermal transfer sheet;

loading an exposure drum installed in the exposure recording device with the thus superposed pieces of sheets; and irradiating the sheets loaded on the exposure drum with a laser beam according to image information, in which the laser beam is absorbed in the thermal transfer sheet and converted into a heat, and an image is transferred onto the image-receiving sheet by the heat converted from the laser beam, wherein each surface of the thermal transfer sheet and the image-receiving sheet is cleaned by contacting with an adhesive roller that includes an adhesive material on its surface, in which the adhesive roller is disposed in any one of a feeding part and a conveying part of the thermal transfer sheet and the image-receiving sheet in the exposure recording device, and the image-receiving sheet has a thickness of 110 to 160 μm and has a stiffness of 50 to 80 g, and at least one of pieces of the thermal transfer sheet and pieces of the image-receiving sheet is stacked while be beina blown with air.

2. A laser thermal transfer recording method, which comprises:

dispensing a thermal transfer sheet and an image-receiving sheet from a roll of each sheet to an exposure recording device, in which the thermal transfer sheet includes an image-forming layer, and the image-receiving sheet includes an image-receiving layer, and the image-receiving layer surface of the image-receiving sheet in the roll is disposed outward;

cutting each of the sheets into pieces of a predetermined length;

superposing each of the cut pieces of the image-receiving sheet on each of the cut pieces of the thermal transfer sheet, so that the image-receiving layer of the image-receiving sheet is opposed to the image-forming layer of the thermal transfer sheet;

loading an exposure drum installed in the exposure recording device with the thus superposed pieces of sheets; and irradiating the sheets loaded on the exposure drum with a laser beam according to image information, in which the laser beam is absorbed in the thermal transfer sheet and converted into a heat, and an image is transferred onto the image-receiving sheet by the heat converted from the laser beam, wherein each surface of the thermal transfer sheet and the image-receiving sheet is cleaned by contacting with an adhesive roller that includes an adhesive material on its surface, in which the adhesive roller is disposed in any one of a feeding part and a conveying part of the thermal transfer sheet and the image-receiving sheet in the exposure recording device, and the image-forming layer surface in the thermal transfer sheet has a surface roughness: Rz of 0.5 to 3.0 μm, and the image-receiving layer surface in the image-receiving sheet has a surface roughness: Rz of 4.0 μm or less, and the superposed pieces of the thennal transfer sheet and the image-receiving sheet are loaded the exposure drum by suction under a reduced pressure of 50 to 500 mmHg.

3. A laser thermal transfer recording method as described in claim 1 or 2, wherein the image-receiving sheet has an adhesion strength of 20 to 100 mN/cm between surface of the image-receiving layer and an underlayer provided underneath the image-receiving layer, and the adhesive roller is an adhesive rubber roller containing titanium dioxide and compound having at least one of C—O and Si—O functional groups as a roller material.

4. A laser thermal transfer recording method as described in claim 3, wherein the image-forming layer surface in the thermal transfer sheet has a surface roughness: Rz of 0.5 to 3.0 μm and a friction coefficient of 0.8 or less, and the image-receiving layer surface in the image-receiving sheet has a surface roughness: Rz of 4 μm or less, and a friction coefficient of 0.7 or less.

5. A laser thermal transfer recording method as described in claim 1 or 2, wherein the transferred image has a resolution of 2,400 dpi or more.

6. A laser thermal transfer recording method as described in claim 1 or 2, wherein the image-forming layer in the thermal transfer sheet has a ratio of an optical density (OD) to a layer thickness: OD/layer thickness (μm unit) of 1.80 or more.

7. A laser thennal transfer recording method as in claim 1 or 2, wherein the image-forming layer in the thermal transfer sheet and the image-receiving layer in the image-receiving sheet each has a contact angle with water of from 7.0 to 120.0°.

8. A laser thermal transfer recording method as described in claim 1 or 2, wherein a recording area of the multicolor image is defined by a product of a length of 515 mm or more and width of 728 mm or more.

9. A laser thermal transfer recording method as described in claim 1 or 2, wherein a recording area of the multicolor image is defined by a product of a length of 594 mm or more and width of 841 mm or more.

10. A laser thermal transfer recording method as described in claim 1 or 2, wherein the ratio of an optical density (OD) of the image-forming layer in the thermal transfer sheet to a thickness of the image-forming layer: OD/layer thickness (μm unit) is 1.80 or more and the image-receiving layer in the image-receiving sheet has a contact angle with water of 86° or less.

11. A laser thermal transfer recording method as described in claim 1 or 2, wherein the image-forming layer in the thermal transfer sheet has a ratio of an optical density (OD) to a layer thickness: OD/layer thickness (μm unit) of 2.50 or more.

12. A laser thermal transfer recording apparatus, wherein a thermal transfer sheet and an image-receiving sheet are dispensed from a roll of each sheet to an exposure recording device, in which the thermal transfer sheet includes an image-forming layer, and the image-receiving sheet includes an image-receiving layer, and the image-receiving layer surface of the image-receiving sheet in the roll is disposed outward, each of the sheets is cut into pieces of a predetermined length, and each of the cut pieces of the image-receiving sheet is superposed on each of the cut pieces of the thermal transfer sheet, so that the image-receiving layer of the image-receiving sheet is opposed to the image-forming layer of the thermal transfer sheet, an exposure drum installed in the exposure recording device is loaded with the thus superposed pieces of sheets by suction under a reduced pressure of 50 to 500 mmHg, the sheets loaded on the exposure drum are irradiated with a laser beam according to image information, in which the laser beam is absorbed in the thermal transfer sheet and converted into a heat, and an image is transferred onto the image-receiving sheet by the heat converted from the laser beam, wherein the exposure recording device is equipped with an adhesive roller in at least one of a feeding part and a conveying part of the thermal transfer sheet and the image-receiving sheet, and the adhesive roller has an adhesive material at its surface, wherein the thermal transfer sheet and the image-receiving sheet are brought into contact with the adhesive roller to clean surfaces of the sheets, and the laser thermal transfer recording apparatus is provided with an air stacking apparatus in the neighborhood of a discharge port, in which the air stacking apparatus blows air to at least one of the pieces of the thermal transfer sheet and the pieces of the image-receiving sheet when the sheets each is stacked.

13. A laser thermal transfer recording apparatus as described in claim 12, wherein said adhesive roller is an adhesive rubber roller containing titanium dioxide and compound having at least one of C—O and Si—O functional group as a roller material.

* * * * *